US007860425B2

(12) United States Patent
Mima et al.

(10) Patent No.: US 7,860,425 B2
(45) Date of Patent: Dec. 28, 2010

(54) PRINTING SYSTEM, JOB PROCESSING METHOD, AND STORAGE MEDIUM

(75) Inventors: Tsuyoshi Mima, Kawasaki (JP); Kazuhiko Ushiyama, Edogawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 42 days.

(21) Appl. No.: 12/237,217

(22) Filed: Sep. 24, 2008

(65) Prior Publication Data

US 2009/0252523 A1 Oct. 8, 2009

Related U.S. Application Data

(63) Continuation of application No. 11/329,122, filed on Jan. 11, 2006, now Pat. No. 7,440,709.

(30) Foreign Application Priority Data

Jan. 14, 2005 (JP) ..... 2005-007986
Dec. 13, 2005 (JP) ..... 2005-359536

(51) Int. Cl.
*G03G 15/00* (2006.01)

(52) U.S. Cl. ..... 399/82; 399/364

(58) Field of Classification Search ..... 399/82, 399/364

See application file for complete search history.

(56) References Cited

U.S. PATENT DOCUMENTS 5,666,208 A 9/1997 Farrell et al.
6,118,950 A 9/2000 Wibbels et al.
6,373,042 B1 4/2002 Kretschmann et al.
6,511,239 B1 * 1/2003 Kretschmann et al. ..... 400/579
2004/0083917 A1 5/2004 Kujirai
2004/0251611 A1 12/2004 Rapkin
2005/0100378 A1 5/2005 Kimura et al.
2006/0055968 A1 3/2006 Sato et al.

FOREIGN PATENT DOCUMENTS

JP 2000137595 A 5/2000
JP 2000177197 A 6/2000
JP 2002-049187 A 2/2002
JP 2003025644 A 1/2003
JP 2004-310746 11/2004

OTHER PUBLICATIONS

European Office Action dated Apr. 26, 2010 concerning European Patent Application No. 06000579.0.

* cited by examiner

*Primary Examiner*—David M Gray
*Assistant Examiner*—Erika Villaluna
(74) *Attorney, Agent, or Firm*—Fitzpatrick, Cella, Harper & Scinto

(57) ABSTRACT

In order to build a convenient printing environment which can meet various needs associated with double-sided printing (e.g., a reduction of the load on the operator) from users upon double-sided printing and can cope with the POD environment, a user request associated with a double-sided printing job to be executed by a printing system which includes a printing apparatus that can execute a double-sided printing operation is accepted from the user via a user interface unit. When the user request accepted via the user interface unit is a specific user request, the printing apparatus is controlled to execute a series of double-sided printing operations using a function of adjusting a printing position of data to be printed on one of first side and second side of a printing medium in the double-sided printing job to be processed.

8 Claims, 37 Drawing Sheets

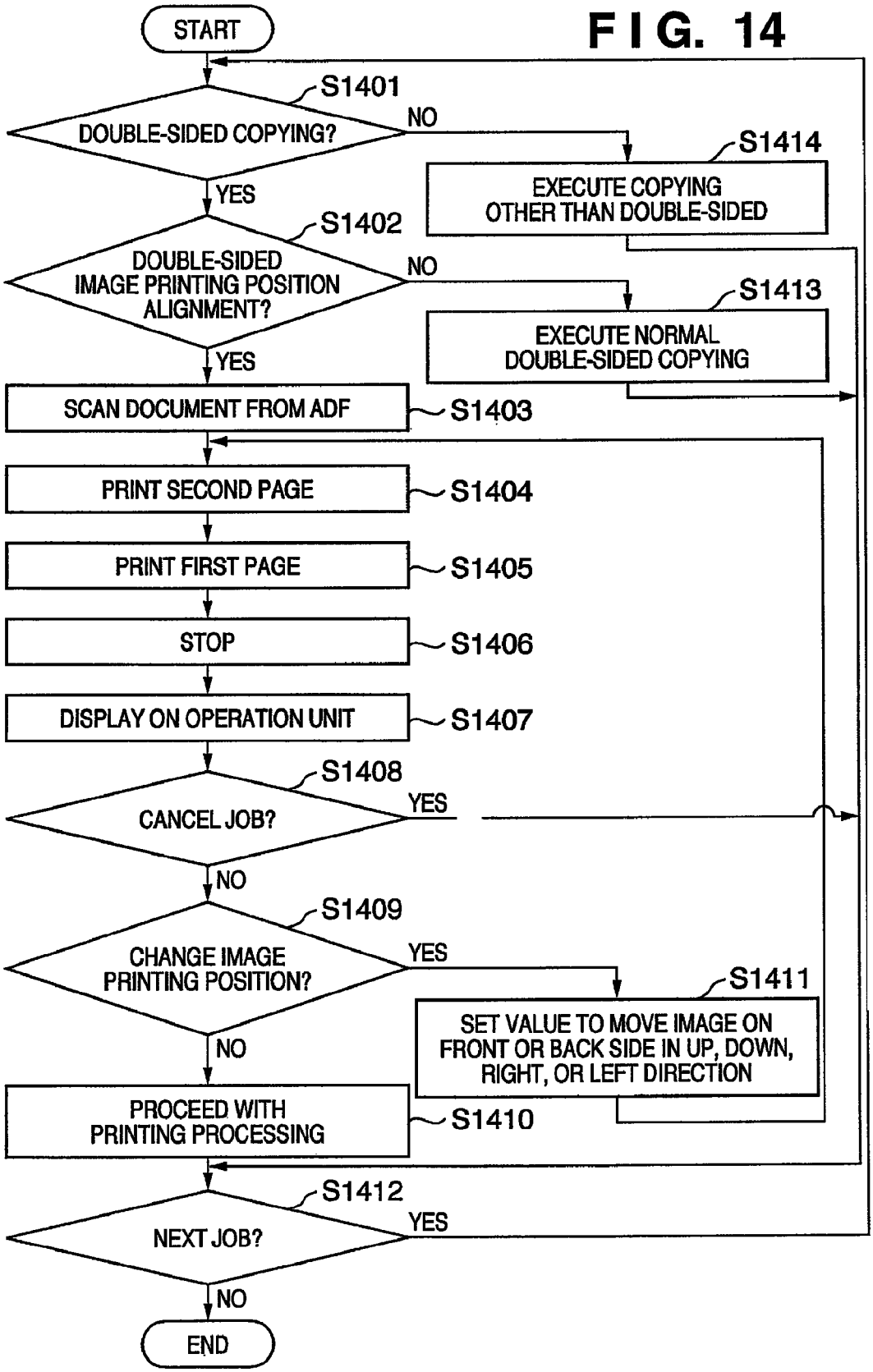
FIG. 14
START
S1401
DOUBLE-SIDED COPYING?
NO
S1414
EXECUTE COPYING OTHER THAN DOUBLE-SIDED
YES
S1402
DOUBLE-SIDED IMAGE PRINTING POSITION ALIGNMENT?
NO
S1413
EXECUTE NORMAL DOUBLE-SIDED COPYING
YES
SCAN DOCUMENT FROM ADF
S1403
PRINT SECOND PAGE
S1404
PRINT FIRST PAGE
S1405
STOP
S1406
DISPLAY ON OPERATION UNIT
S1407
S1408
CANCEL JOB?
YES
NO
S1409
CHANGE IMAGE PRINTING POSITION?
YES
S1411
SET VALUE TO MOVE IMAGE ON FRONT OR BACK SIDE IN UP, DOWN, RIGHT, OR LEFT DIRECTION
NO
PROCEED WITH PRINTING PROCESSING
S1410
S1412
NEXT JOB?
YES
NO
END

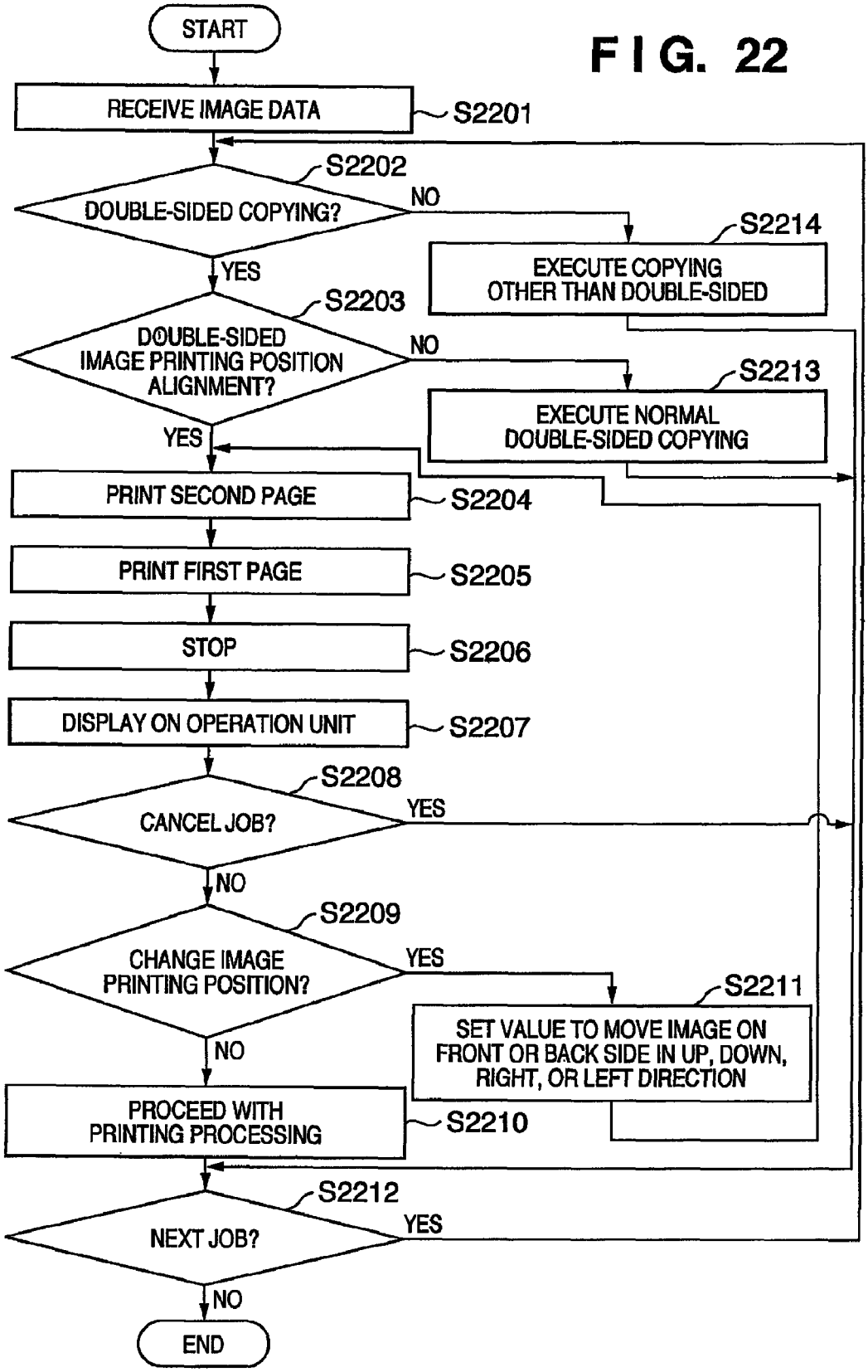
FIG. 22
START
RECEIVE IMAGE DATA
S2201
S2202
DOUBLE-SIDED COPYING?
NO
S2214
EXECUTE COPYING OTHER THAN DOUBLE-SIDED
YES
S2203
DOUBLE-SIDED IMAGE PRINTING POSITION ALIGNMENT?
NO
S2213
EXECUTE NORMAL DOUBLE-SIDED COPYING
YES
PRINT SECOND PAGE
S2204
PRINT FIRST PAGE
S2205
STOP
S2206
DISPLAY ON OPERATION UNIT
S2207
S2208
CANCEL JOB?
YES
NO
S2209
CHANGE IMAGE PRINTING POSITION?
YES
S2211
SET VALUE TO MOVE IMAGE ON FRONT OR BACK SIDE IN UP, DOWN, RIGHT, OR LEFT DIRECTION
NO
PROCEED WITH PRINTING PROCESSING
S2210
S2212
NEXT JOB?
YES
NO
END FIG. 25
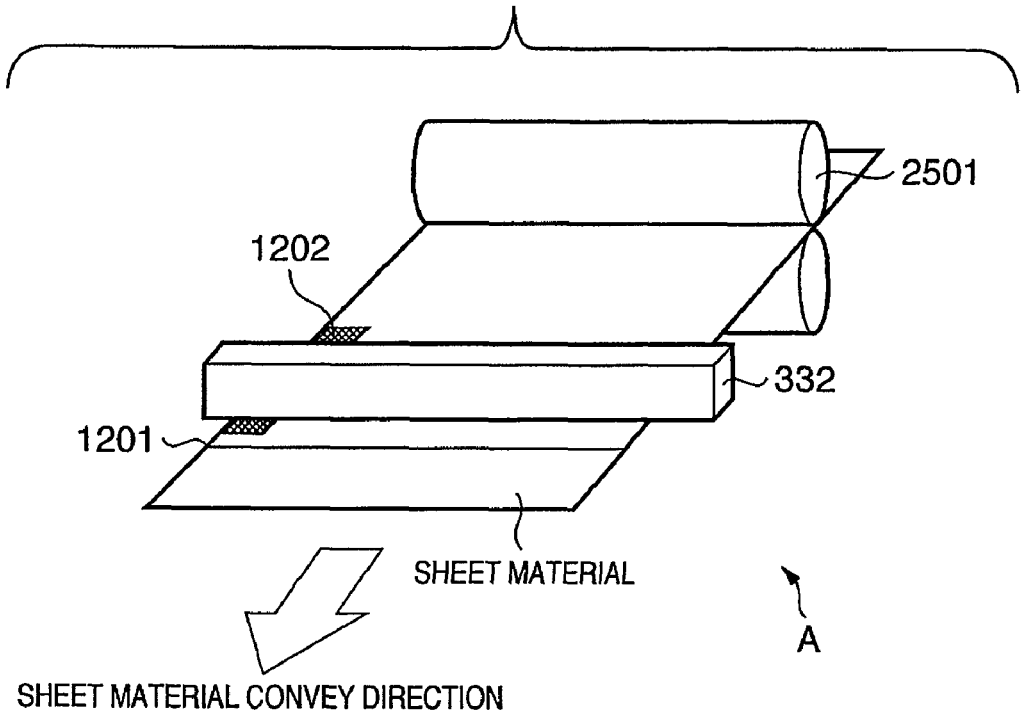
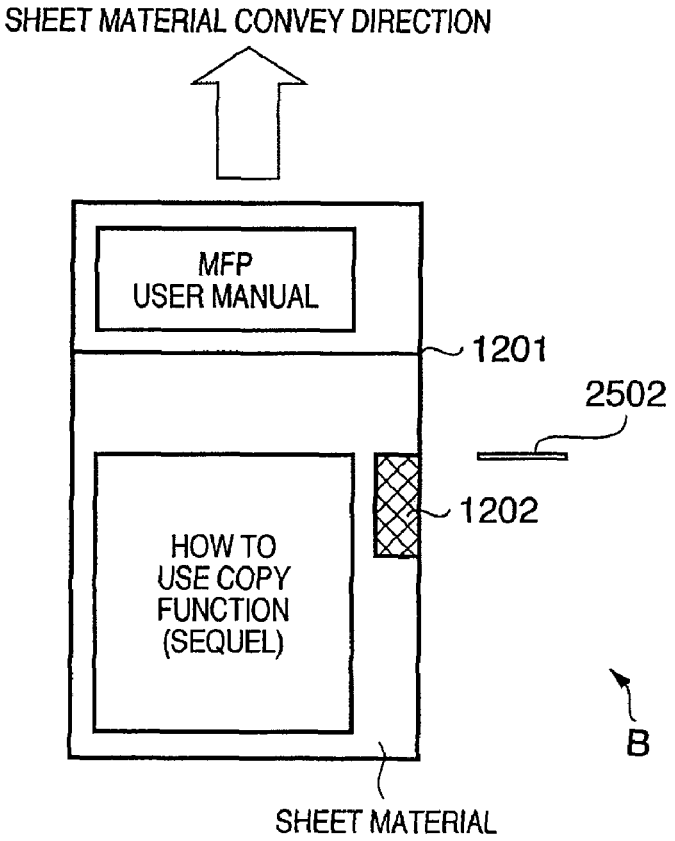

PRINTING SYSTEM, JOB PROCESSING METHOD, AND STORAGE MEDIUM

This application is a continuation application of application Ser. No. 11/329,122, now allowed, filed Jan. 11, 2006, which is incorporated herein by reference.

FIELD OF THE INVENTION

The present invention relates to a printing apparatus which allows double-sided printing.

BACKGROUND OF THE INVENTION

In recent years, colorization, digitization, and speeding up of printing apparatuses have advanced, and such advanced printing apparatuses on some level have began to prevail. Use applications of such printing apparatuses are not only markets mainly including the office equipment field such as offices and the like but also become diffused to the printing business field that requires advanced bookbinding and the like. For example, a POD market has been examined in recent years. This market is in the following environment. That is, an operator who undertakes a printing request from a customer operates a printing apparatus to generate a print product that the customer wants. Then, the print product of a final product as an article is delivered to the customer, thus getting a reward from the customer (see Japanese Patent Laid-Open No. 2004-310746).

In the above POD market, a case is assumed wherein the customer often requires various kinds of post-processing such as bookbinding, stitching, and the like for printing materials printed by the printing apparatus. In addition, a case is assumed wherein the customer requires not only single-sided printing but also double-sided printing as a printing mode of data to be output.

Therefore, in order to cope with such cases, it is desired to improve functions associated with double-sided printing provided by the printing apparatus not to a level required in the office environment but to a level that can meet the needs required in the POD market. For example, a printing apparatus which comprises a function designed with advanced post-processing required in the POD environment in place of a simple double-sided printing function is to be provided. In other words, it is desirable to provide a printing apparatus which can suppress a double-sided printing result which is useless as an article from being printed out, and can generate a double-sided printing result with high precision. For example, it is desirable to provide an advanced double-sided image alignment function or the like under the condition of post-processing or the like.

Upon delving the above items to be examined, in general, in an office environment, printing materials printed by the printing apparatus are rarely bound up as an article. For example, in the office environment, even if the positions of images printed on the front and back sides of a printing material in the double-sided printing mode are misaligned, that print product is not handled as an article. Hence, the user neither regards nor sees such product as a problem.

On the other hand, in the POD environment, a case is assumed wherein a print product is bound up as a manual, guide book, or the like, and is delivered as an article to the customer. In addition, the print product to be bound up may undergo double-sided printing on the front and back sides of a single printing material in some cases. In such case, if the printing position of an image printed on the front side of the printing material is misaligned from that of an image printed on the back side of the printing material, the print product is unlikely to be adopted as an article. Such print product is more unlikely to be adopted with increasing degree of misalignment (misalignment amount) between the printing positions of images on the front and back sides. In this manner, the position misalignment of the printing result of the images on the front and back sides in double-sided printing, which is not apprehended in the office environment, must be coped with in the POD environment in some cases.

Upon further delving the above examinations, the position misalignment between the images on the front and back sides of a printing material in double-sided printing results from, e.g., the alignment precision of a printing material in the printing apparatus. For example, if the product specification associated with the alignment precision of images on a printing material of the printing apparatus itself is 2 mm, the positions of images on the front and back sides are likely to be misaligned by a maximum of 4 mm. If the printing apparatus outputs such printing result in which the positions of images on the front and back sides are misaligned by 4 mm under such product specification, such position misalignment is on a negligible level in the office environment.

However, a print product which suffers even the position misalignment which is on the negligible level in the office environment is unlikely to be adopted as an article in the POD environment. In this manner, in the POD environment, when the operator detects the position misalignment on such level upon inspecting a print product as an article, it is more likely to be re-printed. Such image position misalignment phenomenon may take place due to, e.g., shrinkage of a printing material (to be also simply referred to as a sheet hereinafter) under the influence of environmental changes of an ambient temperature, humidity, and the like while the printing apparatus conveys the printing material. In this manner, the above phenomenon takes place due to not only internal causes of the printing apparatus itself but also external causes surrounding the printing apparatus.

Under such circumstances, on the actual spot of the POD environment, the operator may be required to have advanced skills and to do many works so as to suppress the above situation upon execution of double-sided image printing for bookbinding. For example, the operator manually performs fine adjustment of image positions of image data input to the printing apparatus based on his or her empirical rules from the beginning while calculating the misalignment amount. Also, the operator aligns images by executing pre-printing or the like.

Upon completion of the alignment work of images on the front and back sides through a variety of operations, the operator finally saves the image data that has undergone the image alignment, and performs actual printing using the saved image data. In some cases, the operator on the spot of the POD environment is required to do such advanced and complicated works.

As described above, the alignment precision of a printing material in the printing apparatus may change due to a plurality of factors such as the environmental conditions, i.e., the ambient temperature, humidity, and the like of the installation location of the printing apparatus, shrinkage of a sheet upon fixing, displacement in a paper convey path, and the like. In other words, the image position misalignment amount may dynamically vary on a dairy basis. Therefore, even if the image data which has undergone image alignment on the front and back sides by the aforementioned method can be saved to be re-usable even after it is printed once, that image data cannot be used intact in the next printing processing. That is, even when identical image data is re-usably held, the operator must consequently redo image alignment every time that data is used. From such viewpoint, a reduction of the work load on the operator upon performing image alignment will be further pressed in the future.

SUMMARY OF THE INVENTION

It is an object of the present invention to provide a printing system, job processing method, and storage medium which can solve the aforementioned problems.

It is another object of the present invention to establish a convenient printing environment which can solve the aforementioned problems, can flexibly meet various needs of users involved in double-sided printing such as a reduction of the load on the operator and the like upon execution of double-sided printing, and can also cope with the POD environment.

It is still another object of the present invention to establish a convenient printing environment which can solve the aforementioned problems and considers the productivity of a printing apparatus and a reduction of the work load on the operator, even when image alignment that corrects misalignment of image positions is performed upon printing in a printing apparatus which allows double-sided printing.

In order to achieve the above objects, a printing system according to the present invention comprises the following arrangement. That is, a printing system comprising a printing apparatus which can execute a double-sided printing operation, comprising:

an acceptor adapted to accept a user request associated with a double-sided printing job from a user via a user interface unit; and a controller adapted to control the printing apparatus to execute a series of double-sided printing operations using a function of adjusting a printing position of data to be printed on one of a first side and second side of a printing medium in the double-sided printing job to be processed when the user request accepted via the user interface unit is a specific user request.

According to the present invention, a convenient printing environment which can flexibly meet various needs of users involved in double-sided printing such as a reduction of the load on the operator and the like upon execution of double-sided printing, and can also cope with the POD environment can be established.

For example, according to the present invention, a convenient printing environment which can solve the aforementioned problems and considers the productivity of a printing apparatus and a reduction of the work load on the operator, even when image alignment that corrects misalignment of image positions upon printing in a printing apparatus which allows double-sided printing, can be established.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 14 is a flowchart for explaining one example of the data processing method of a print job to be controlled by the embodiment of the present invention;

FIG. 22 is a flowchart for explaining one example of the data processing method of a print job to be controlled by the embodiment of the present invention;

FIG. 25 is a view for explaining a control example using a sensor arranged on a sheet convey path of the printing apparatus to be controlled by the embodiment of the present invention;

DETAILED DESCRIPTION OF THE PREFERRED EMBODIMENTS

Figure 1:
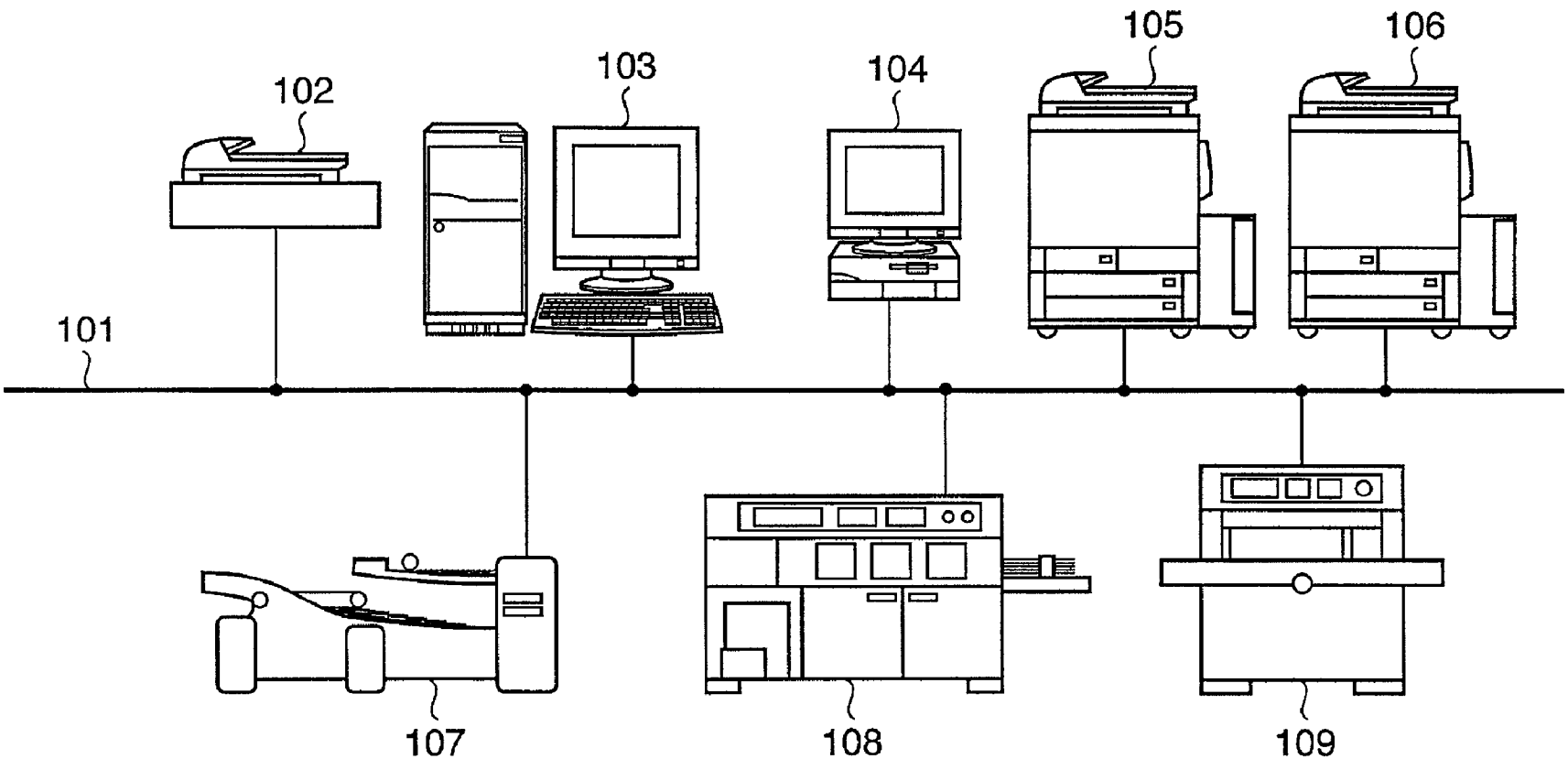
FIG. 1 is a diagram showing an example of the arrangement of the overall printing system including printing apparatuses (MFPs 105 and 106) to be controlled by an embodiment of the present invention.

Preferred embodiments of the present invention will now be described in detail in accordance with the accompanying drawings.

An overview of respective embodiments of the present invention will be explained first. The first and second embodiments of those to be described hereinafter comprise an arrangement for reducing the work load on the operator upon executing image alignment that corrects the misalignment of image positions upon printing.

As a practical arrangement, for example, a controller according to an embodiment of the present invention controls the printing apparatus to start the printing operation of a job which is to be printed in a double-sided printing mode, and to automatically pause the printing operation of that job upon completion of the printing operation for a predetermined number of copies. During pause of the printing operation of the job, a setting window (double-sided image alignment detailed setting window) used to correct image printing positions of the job on the basis of a user's instruction is displayed on a user interface unit.

The first and second embodiment comprise an arrangement which controls to restart the printing operation of the job whose printing operation is paused under the image position adjustment control according to the user's instruction input via that window.

Note that the first embodiment will mainly explain a control example upon processing print data of a job accepted via a scanner unit of the printing apparatus. The second embodiment will mainly explain a control example upon processing print data of a job accepted from a client (host computer) corresponding to one example of an external apparatus which can make data communications with the printing apparatus.

The first and second embodiments comprise an arrangement that can execute control associated with correction of printing position misalignment of data of a job which is to be double-sided printed on the basis of an instruction from the operator.

By contrast, the third embodiment comprises a detector which detects printing position misalignment of data of a job which is to be double-sided printed. Hence, the third embodiment comprises an arrangement that can automatically execute control associated with correction of printing position misalignment of data of a job upon detection of the printing position misalignment, irrespective of an instruction from the operator.

In addition, the arrangement of the printing apparatus or printing system to be provided by the embodiments of the present invention may comprise all constituent elements of the embodiments of the present invention which include the first, second, and third embodiments and will be described hereinafter, or a plurality of (e.g., two or the like) arrangements, and may selectively execute them. Alternatively, the arrangement of the printing apparatus or printing system may implement only one of the embodiments to be described hereinafter. In other words, any of the arrangements of the embodiments of the present invention may be adopted or may be combined within a consistent range as long as they can solve the problems assumed in the prior art.

First Embodiment

<Arrangement of Overall Printing System>

FIG. 1 is a diagram showing the arrangement (one example) of the overall printing system which comprises printing apparatuses (MFPs 105 and 106), computers (103 and 104), sheet processing apparatuses (108 and 109), and the like to be provided by the embodiments of the present invention including the first embodiment and embodiments to be described later of the present invention.

A prepress server 103 scans a paper document accepted from an end user by a device (scan device) having a scan function such as a scanner 102, MFP 105, MFP 106, or the like, and captures the scanned paper document as a scan image file. Also, the prepress server 103 executes image correction such as skew correction, spot removal, and the like of the captured data. The prepress server 103 executes various kinds of edit processing of data of a plurality of document/image files received from the end user or a plurality of scan image files scanned by the scan device. For example, the prepress server 103 performs merging of a plurality of data, insertion/deletion of pages, addition of page numbers and annotations, and insertion of index sheets, cover sheets, and interleaving sheets. Furthermore, the prepress server 103 executes various kinds of page layout edit processing and page imposition processing such as designation of an N-in-1 printing mode, page repeat printing mode, and the like. A controller of the server 103 controls to execute such various kinds of processing in response to an operation from the operator of the server 103.

Note that the arrangement of the printing system may include one prepress server 103 and a client PC 104, as shown in FIG. 1, or may include a plurality of client PCs without any prepress server 103.

In the printing system shown in FIG. 1, when a paper document is copied and undergoes bookbinding, the paper document is scanned by the scan device such as the MFP 105, MFP 106, or the like, and the obtained scan image file is printed by a print function of the MFP 105 or 106.

On the other hand, in the printing system shown in FIG. 1, when image data is to be printed and undergoes bookbinding, the prepress server 103 or client PC 104 fetches a document/image file received from the end user. If there are a plurality of document/image files received from the end user or scan image files scanned by the scan device, these files are merged. When the document/image file received from the end user or the scan image file scanned by the scan device is to be further edited, the following operations can be executed. For example, the operator inserts a page from another file into a file to be edited or deletes a page of the file to be edited while confirming the layout of a plurality of pages. Also, the following processing can be executed in response to a request from the operator. For example, page numbers and annotations (text or image such as a watermark, logo, or the like indicating secret information) can be added, or an N-in-1 printing mode or page repeat printing mode (printing mode that lays out a plurality of pages on a single print surface) can be designated. Also, index sheets, cover sheets, or interleaving sheets can be inserted, and post-processing such as staple, punch, Z-folding, and the like can be designated. In this way, various kinds of page layout edit processing and page imposition processing can be executed.

When the prepress server 103 or client PC 104 transmits the document/image file or scan image file that has undergone these processes, to the MFP 105 or 106, the file is printed using the print function of the MFP 105 or 106.

In this arrangement, a variable printing system which prints a plurality of copies of an identical document while replacing addresses and related data in collaboration with a database formed in the prepress server 103 or another server (not shown) can be built. In this manner, one-to-one marketing such as address printing of direct mail and customer-dependent broachers can be realized.

The printing business uses an output called a color comprehensive layout, which is formed for the purpose of presentation to an advertiser prior to the prepress/printing step. Hence, to cope with such color comprehensive layout, the printing apparatus of this embodiment can print a digital color image, which is processed by DTP that creates a publication using a personal computer or CEPS used in image correction or composition in the print step. In this way, such digital color image can be used for the aforementioned color comprehensive layout. Note that DTP is an abbreviation for DeskTop Publishing, and CEPS is an abbreviation for Color Electronic Prepress System.

In consideration of the POD environment, the MFP 105 or 106 can execute proof printing processing as well as layout confirmation corresponding to the color comprehensive layout, and detailed tint confirmation corresponding to basic tint confirmation or proofing.

In this way, with this arrangement, in order to confirm the layout or tint of a final product as needed, data can be proof-output to the MFP 105 or 106.

The prepress server 103, client PC 104, scanner 102, and MFPs 105 and 106 are connected to a network, and comprise a data communication function. With this function, the devices exchange image data of jobs to be processed and control commands, and can process accepted jobs.

A sheet folding machine 107 executes processing for folding printed sheets for a manual or guidebook, which are printed by the printing apparatus (105 or 106) of this embodiment by a designated sheet folding method on the basis of an instruction from the operator input via an operation unit of the sheet folding machine 107.

A case binder 108 enwraps and adheres the output document folded by the sheet folding machine 107 with a sheet that serves as a cover sheet of the manual or guidebook.

A trimmer 109 trims the output document to which the cover sheet is adhered by the case binder 108. The trimmer 109 can trim sheets at the positions of marks called registry guides as indications of the trimming positions on sheets printed by the printing apparatus (105 or 106) of this embodiment. As the type of trimming, the trimmer 109 can execute three-side trimming that trims three end portions except for the adhered portion of the four end portions of a case-bound print product.

In this embodiment, the MFPs 105 and 106 each of which comprises a plurality of functions are exemplified as the printing apparatus. However, the present invention is not particularly limited to such MFPs. For example, the present invention can be applied to a single-function printing apparatus such as a printing apparatus comprising only a function of printing print data from a computer or the like. Note that such apparatus will be referred to as an SFP (Single Function Peripheral) hereinafter.

<Functional Arrangement of MFPs 105 and 106>

The arrangement of the MFP (Multi Function Peripheral) will be described below using FIG. 2.

Each of the MFPs 105 and 106 comprises a memory such as a hard disk or the like, which can store data of a plurality of jobs to be processed in the self apparatus. The MFP comprises a copy function of printing job data accepted from a scanner unit 201 of the self apparatus by a printer unit 203 via the memory. The MFP also has a print function of printing job data accepted from an external apparatus such as a computer or the like via a communication unit using the printer unit 203 and the like via the memory. The MFP is a printing apparatus (also called an image forming apparatus) which comprises these plurality of functions.

In general, a full-color apparatus and monochrome apparatus are available as the MFP, and the full-color apparatus often includes the arrangement of the monochrome apparatus in a basic part except for color processing, internal data, and the like. Hence, the following description will be given focused on the full-color apparatus, and a description of the monochrome apparatus will be added as needed. In other words, the present invention can be applied to either arrangement of a printing apparatus which can execute color printing processing or that which can execute monochrome printing processing as long as it can execute various kinds of control described in the embodiment of the present invention.

Figure 2:
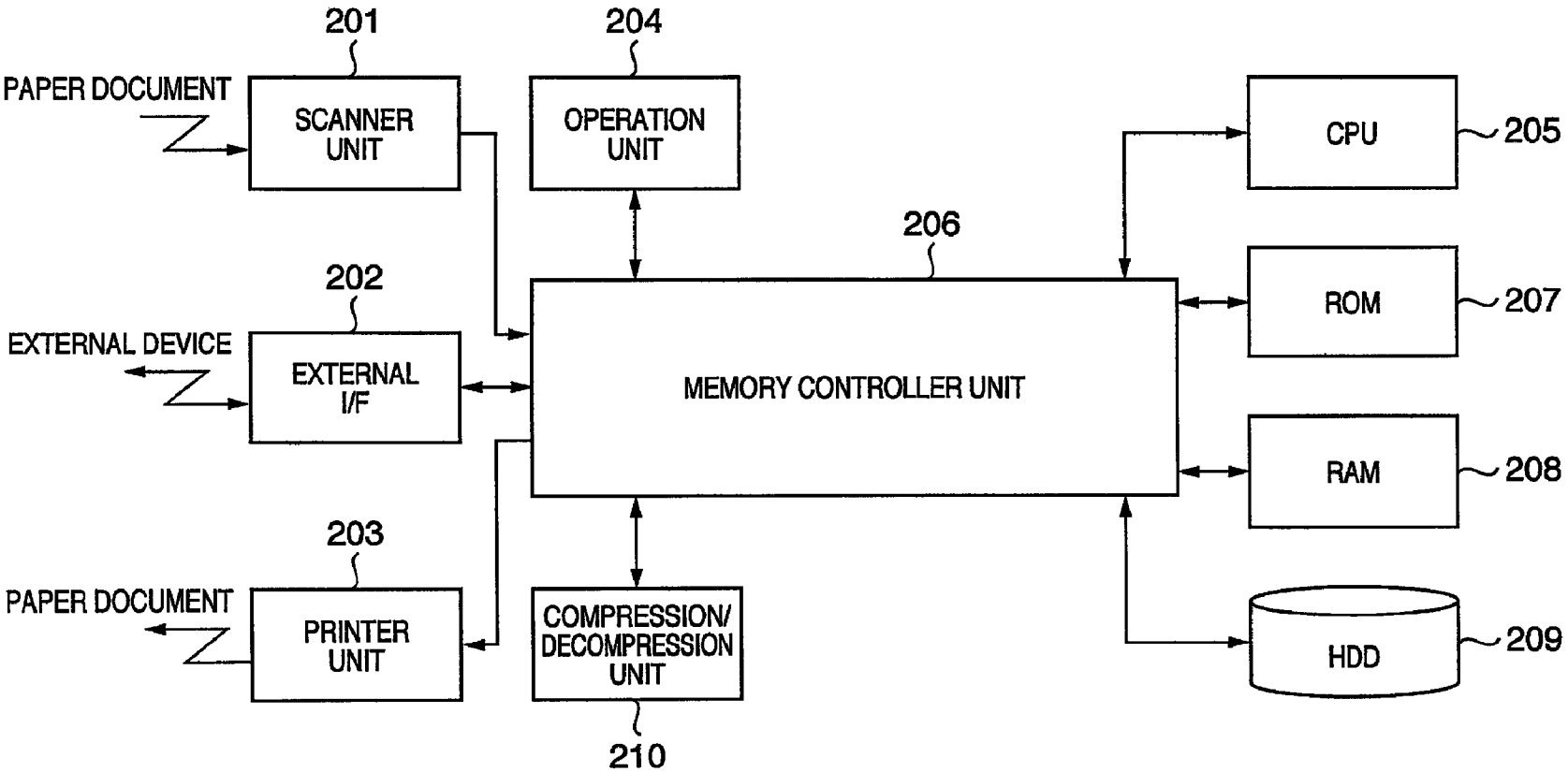
FIG. 2 is a block diagram showing an example of the arrangement of the printing apparatus to be controlled by the embodiment of the present invention.

FIG. 2 is a block diagram showing an example of the arrangement of the printing apparatus (MFP 105 or 106) of this embodiment. The printing apparatus of this embodiment comprises the scanner unit 201 which scans a document image and applies image processing to the scanned image data. The apparatus comprises an external I/F unit 202 which exchanges image data and the like with a facsimile, network connection apparatus, and external dedicated apparatus. The apparatus comprises a hard disk 208 which can store image data of a plurality of jobs to be printed accepted from one of the scanner unit 201 and the external I/F unit 202. The apparatus comprises the printer unit 203 which executes printing processing of data of the jobs to be printed stored in the hard disk 208 onto printing materials. The printing apparatus also comprises an operation unit 204 which has a display unit as an example of a user interface unit of this printing system.

A CPU 205 corresponding to an example of a control unit of this printing system systematically controls processes, operations, and the like of various units of this printing apparatus. A ROM 207 stores various control programs required by this embodiment, which include programs for implementing various kinds of processing and the like of the flowcharts shown in FIGS. 14, 22, and 29 to be described later. The ROM 207 also stores a display control program required to display various user interface windows on the display unit of this embodiment, which include operation windows shown in FIGS. 6 to 11, FIGS. 15 and 16, and FIGS. 26 to 28. The CPU 205 reads out and executes the programs in the ROM 207 to control this printing apparatus to execute various operations described in this embodiment. A program required to interpret PDL (page description language) code data received from an external apparatus (103, 104, or the like) via the external I/F unit 202 and to rasterize to raster image data (bitmap image data) and the like are also stored in the ROM 207. These are processed by software.

A memory controller unit 206 controls access to the ROM 207, a RAM 208, and the HDD 209 as connected storage devices. Upon contention of memory access from connected master devise, the memory controller unit 206 performs arbitration to access slave memories selected in turn by priorities.

The ROM 207 is a read-only memory, and pre-stores various programs such as programs such as a boot sequence, font information, and the aforementioned programs.

The RAM 208 is a random access memory, which stores image data sent from the scanner unit 201 or external I/F unit 202 via the memory controller unit 206, various programs, and setting information.

The HDD (hard disk) 209 is a large-capacity storage device which stores image data compressed by a compression/decompression unit 210. The HDD 209 can hold a plurality of data such as print data of jobs to be processed and the like. The CPU 205 controls the printer unit 203 to execute, via the HDD 209, printing processing of data of jobs to be processed input via various input units such as the scanner unit 201, external I/F unit 202, and the like. The CPU 205 also controls to transmit such data to an external apparatus via the external I/F unit 202. In this way, the CPU 205 controls to execute various kinds of output processing of data of jobs to be processed stored in the HDD 209.

The compression/decompression unit 210 compresses/decompress image data stored in the RAM 208 and HDD 209 by various compression methods such as JBIG, JPEG, and the like.

<Hardware Arrangement of MFP>

Figure 3:
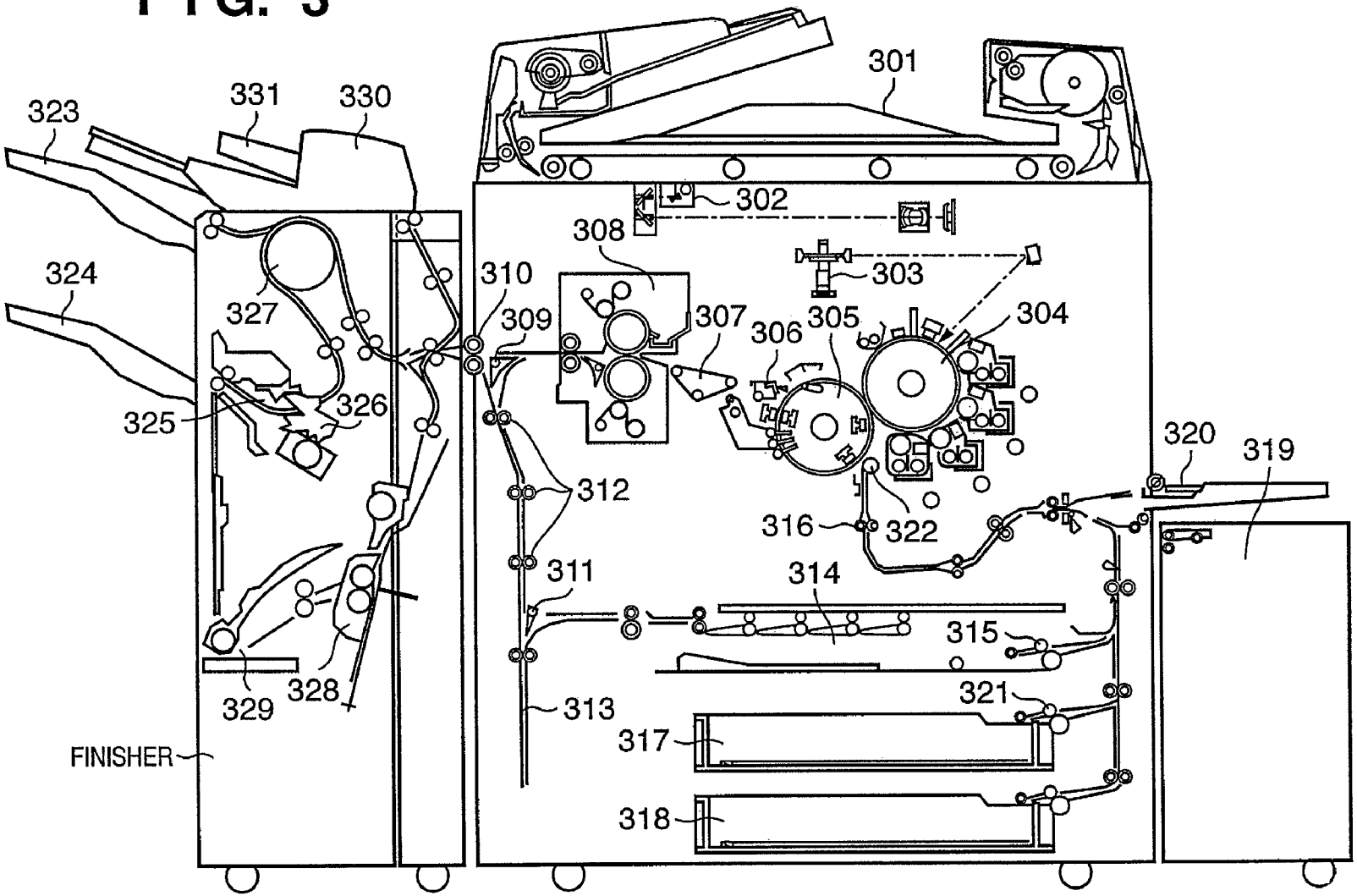
FIG. 3 is a sectional view showing an example of the hardware arrangement of the printing apparatus to be controlled by the embodiment of the present invention.

The hardware arrangement of the MFP 105 or 106 will be described below using FIG. 3. In this embodiment, the arrangement of a ID type color MFP will be explained. Note that 4D type color and monochrome MFPs are also examples of the printing apparatus of this embodiment, but a description thereof will be omitted.

An auto document feeder (ADF) 301 separates a bundle of documents set on a stacking surface of a document tray, and conveys each separated document onto a platen glass to scan the document by a scanner 302.

The scanner 302 reads a document image conveyed onto the platen glass and converts the read document image into image data by a CCD. A rotary polygonal mirror (polygon mirror or the like) 303 receives light such as a laser beam or the like, which is modulated according to the image data, and irradiates a photosensitive drum 304 with reflected scanning light via a reflection mirror.

A latent image formed by the laser beam on the surface of the photosensitive drum 304 is developed by toner to form a toner image, which is transferred onto a sheet material adhered on a transfer drum 305. A series of image forming processes is executed in turn for yellow (Y), magenta (M), cyan (C), and black (K) toners, thus forming a full-color image. After the four image forming processes, the sheet material on the transfer drum 305 on which the full-color image is formed is separated by a separation pawl 306 and is conveyed to a fixing unit 308 by a pre-fixing convey unit 307.

The fixing unit 308 comprises a combination of belts and rollers, incorporates a heat source such as a halogen heater or the like, and melts and fixes the toner on the sheet material on which the toner image is transferred by heat and pressure.

An exhaust flapper 309 is configured to be swingable about its swing shaft, and specifies a convey direction of the sheet material. When the exhaust flapper 309 swings clockwise in FIG. 3, the sheet material is conveyed upright, and is exhausted outside the apparatus by exhaust rollers 310. On the other hand, when images are to be formed on the two sides of the sheet material, the exhaust flapper 309 swings counterclockwise in FIG. 3 to change the path of the sheet material downward, and is fed into a double-sided convey unit.

The double-sided convey unit comprises a reversal flapper 311, reversal rollers 312, reversal guide 313, and double-sided tray 314. The reversal flapper 311 is configured to be swingable about its swing shaft to specify the convey direction of the sheet material. Upon processing a double-sided print job, the CPU 205 controls the reversal flapper 311 to swing counterclockwise in FIG. 3, and to feed the sheet material which has undergone the printing process of the first side in the printer unit 203 into the reversal guide 313 via the reversal rollers 312. After the trailing end of the sheet material is clamped between the reversal rollers 312, the CPU 205 temporarily stops the reversal rollers 312, and then controls the reversal flapper 311 to swing clockwise. In addition, the CPU 205 controls the reversal rollers 312 in the reverse direction. In this manner, the CPU 205 controls to switch back the sheet, and to guide it onto the double-sided tray 314 while the positions of the trailing and leading ends of the sheet are switched.

The double-sided tray 314 temporarily stacks the sheet material, which is then fed into registration rollers 316 by re-feed rollers 315. At this time, the sheet material is fed while the side opposite to that of the transfer step of the first side opposes the photosensitive drum. In the same manner as in the aforementioned processes, an image for the second side is formed on the second side of the sheet. The images are formed on the two sides of the sheet material, and the sheet is exhausted from the interior of the printing apparatus main body to outside the apparatus via the exhaust rollers 310 via the fixing step. The CPU 205 allows the printing apparatus of this embodiment to execute double-sided printing processing of the data of the job which is to be double-sided printed for the two sides, i.e., the first and second sides of the sheet by executing such series of double-sided printing sequences.

A paper feed/convey unit includes paper feed cassettes 317 and 318, paper deck 319, manual insertion tray 320, and the like as paper feed units that store sheets required in printing processing. Units for feeding sheets stored in these paper feed units, paper feed rollers 321, the registration rollers 316, and the like are arranged.

The paper feed cassettes 317 and 318 and paper deck 319 can be distinctly set with sheets of various sheet sizes and various materials for respective paper feed units. Also, the manual insertion tray 320 can be set with various print materials including special sheets such as OHP sheets and the like. The paper feed rollers 321 are respectively provided to the paper feed cassettes 317 and 318, paper deck 319, and manual insertion tray 320 to be able to continuously feed sheets one by one. For example, stacked sheet materials are sequentially picked up by a pickup roller, and a separation roller which is arranged to oppose the paper feed roller 321 prevents double feeding, thus feeding sheet materials into convey guides one by one. The separation roller receives a drive force for rotating it in a direction opposite to the convey direction via a torque limiter. When only one sheet material enters a nip formed with the paper feed roller, the separation roller rotates in the convey direction to be driven by the sheet material. On the other hand, when double feeding has occurred, the separation roller rotates in the direction opposite to the convey direction to return the double-fed sheet material, thus feeding the only one uppermost sheet material.

The fed sheet material is guided between the convey guides, and is conveyed to the registration rollers 316 by a plurality of convey rollers. At this time, the registration rollers 316 stand still, and the leading end of the sheet material abuts against a nip formed between the registration rollers 316, so that the sheet material forms a loop, thus correcting a skew. After that, the registration rollers 316 begin to rotate to convey the sheet material in synchronism with the timing of a toner image formed on the photosensitive drum 304 by an image forming unit.

The sheet material fed by the registration rollers 316 are electrostatically attached onto the surface of the transfer drum 305 by an attraction roller 322.

The sheet material exhausted from the fixing unit 308 enters an online finisher unit (if the finisher is connected). The online finisher unit includes a sample tray 323 and stack tray 324, and the sheet material is exhausted while switching these trays in accordance with the type of job and the number of sheet materials to be exhausted.

Note that the printing apparatus of this embodiment comprises a shift sheet function. This function exhausts a plurality of sheets stacked on a processing tray 325 in the finisher as bundles of sheets onto the tray 324 while shifting these sheets for each bundle of sheets. In this manner, a plurality of bundles of sheets can be stacked on the tray 325 while being divided for respective bundles.

The printing apparatus of this embodiment also comprises an electronic sort function. This function stores all pages of print data to be processed including a plurality of pages in the HDD 209, repetitively reads out the data of that job in the order of pages for the number of copies set by the user, and controls the printer unit 203 to print them. In this manner, a plurality of copies of printing results with the uniform page order can be output onto the tray 324 without any mechanical sort function using a plurality of bins.

Furthermore, the printing apparatus of this embodiment comprises a group sort function. This function stores all pages of a job which includes a plurality of pages and is set to be printed by a plurality of copies in the HDD 209, continuously reads out identical page data from the HDD 209 for the designated number of copies to be printed, and controls the printer unit 203 to print them. This function repetitively executes this processing for all the pages. In this manner, a plurality of copies of printing results can be output onto the tray 324 while being divided for respective pages. The CPU 205 controls to execute such various functions for a job to be processed in accordance with print settings from the user via the user interface unit.

Furthermore, when the user sets a staple mode for a job to be output, the CPU 205 controls the finisher to process sheets of that job as follows. For example, printed sheets of that job from the printer unit 203 are sequentially stacked on the processing tray 325 in the finisher until they are stacked on the tray 325 for a bundle. After all the sheets which belong to one bundle are stacked on the tray 325, the bundle of sheets of that job on the processing tray 325 is stapled by a stapler 326. After that, the stapled bundle of sheets of the job is exhausted from the tray 325 onto the stack tray 324. In this way, this printing system can provide a staple function.

In addition, this printing system comprises a punch function. For example, when a punch processing setting is made via the user interface unit as a setting associated with sheet processing of a job to be printed, the CPU 205 operates as follows. That is, the CPU 205 controls a puncher 327 to execute punch processing (e.g., two holes, three holes, or the like) for a print sheet of that job. After that, the CPU 205 controls to exhaust the sheet of that job onto a stacking unit such as the stack tray 324, sample tray 323, or the like.

This printing system comprises a saddle stitching function by a saddle stitcher 328 of the finisher. The saddle stitcher 328 executes processing (saddle stitching processing) for forming a booklet such as a brochure or the like by center-folding sheet materials by nipping their central portion by rollers after the central portions of the sheet materials are bound at two positions. The sheet materials which are bound by the saddle stitcher 328 are exhausted onto a booklet tray 329. The CPU 205 determines based on the sheet processing setting by the user for a job to be processed whether or not to execute the sheet processing operation such as the saddle stitching processing by the saddle stitcher 328 or the like, as described above.

This printing system comprises an insert function by an inserter 330 of the finisher. For example, when a job set with this function is to be processed, the CPU 205 controls to convey printed special sheets for cover sheets and the like set on an insert tray 331 to the stacking unit such as the stack tray 324, sample tray 323, or the like without going through the printer unit. In this way, insert processing of sheets from the inserter 330 into sheets printed by the printer unit 203 can be executed. Note that the user sets sheets facing up on the insert tray 331 of the inserter 330, and these sheets are fed by the pickup roller in turn from the uppermost one.

Therefore, the sheet material from the inserter 330 is conveyed to the stack tray 324 or sample tray 323 intact, and is exhausted facing down. When such sheet material is to be fed to the saddle stitcher 328, it is fed into the puncher side, and is then switched back and fed into the saddle stitcher 328, thus adjusting the direction of the side. The CPU 205 also determines based on the sheet processing setting by the user for a job to be processed whether or not to execute the sheet processing operation such as the insert processing by the inserter 330 or the like, as described above.

<Arrangement of Operation Units of MFPs 105 and 106>

Figure 4:
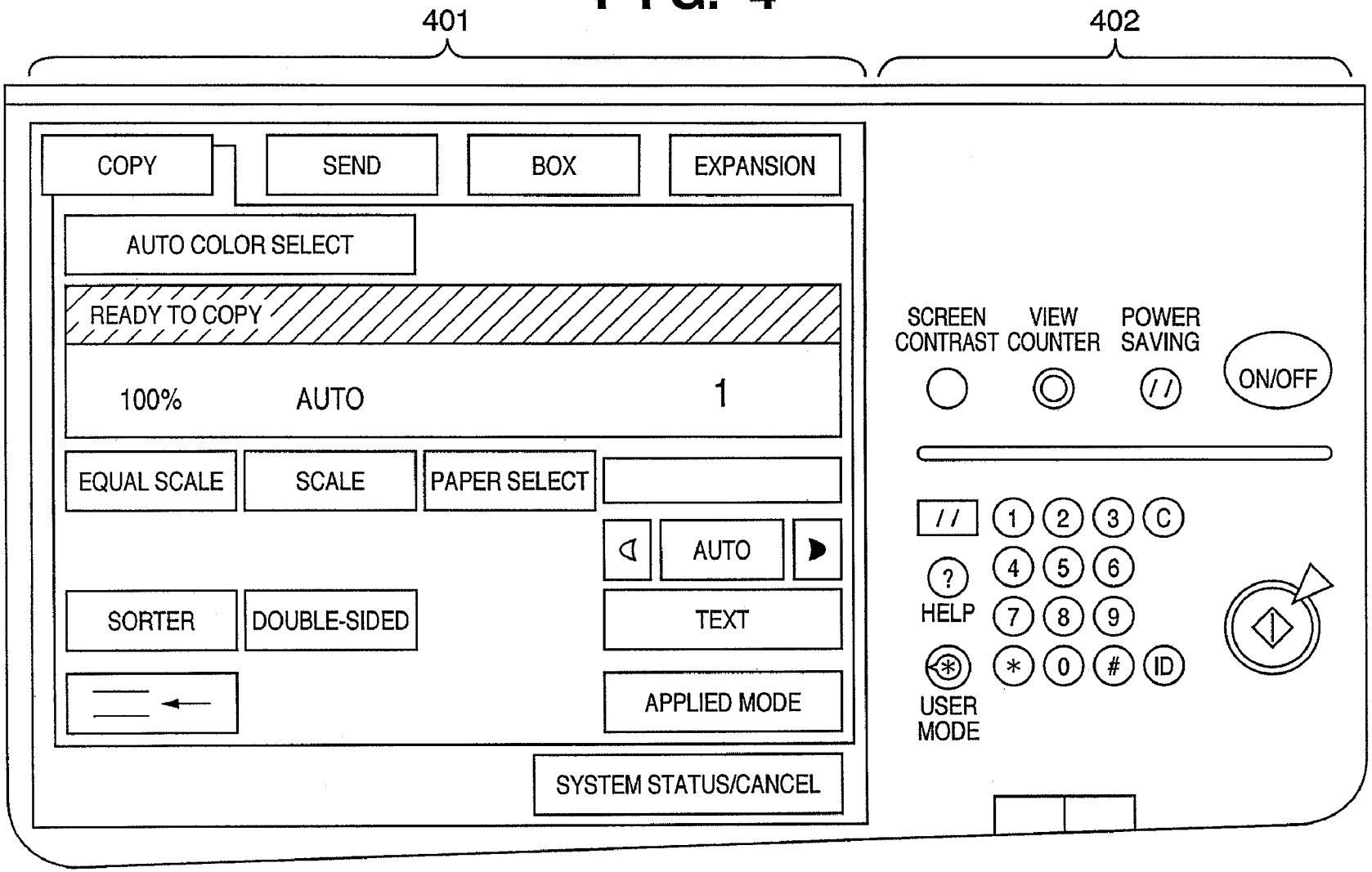
FIG. 4 is a view for explaining one example of a UI unit to be controlled by the embodiment of the present invention.

The operation unit 204 corresponding to an example of the user interface unit of the printing apparatus (MFP 105 or 106) of this printing system will be described below using FIG. 4. The operation unit 204 has a key input unit 402 which can accept user's operations by hardware keys, and a touch panel unit 401 as an example of a display unit which can accept user's operations by software keys (display keys).

Figure 5:
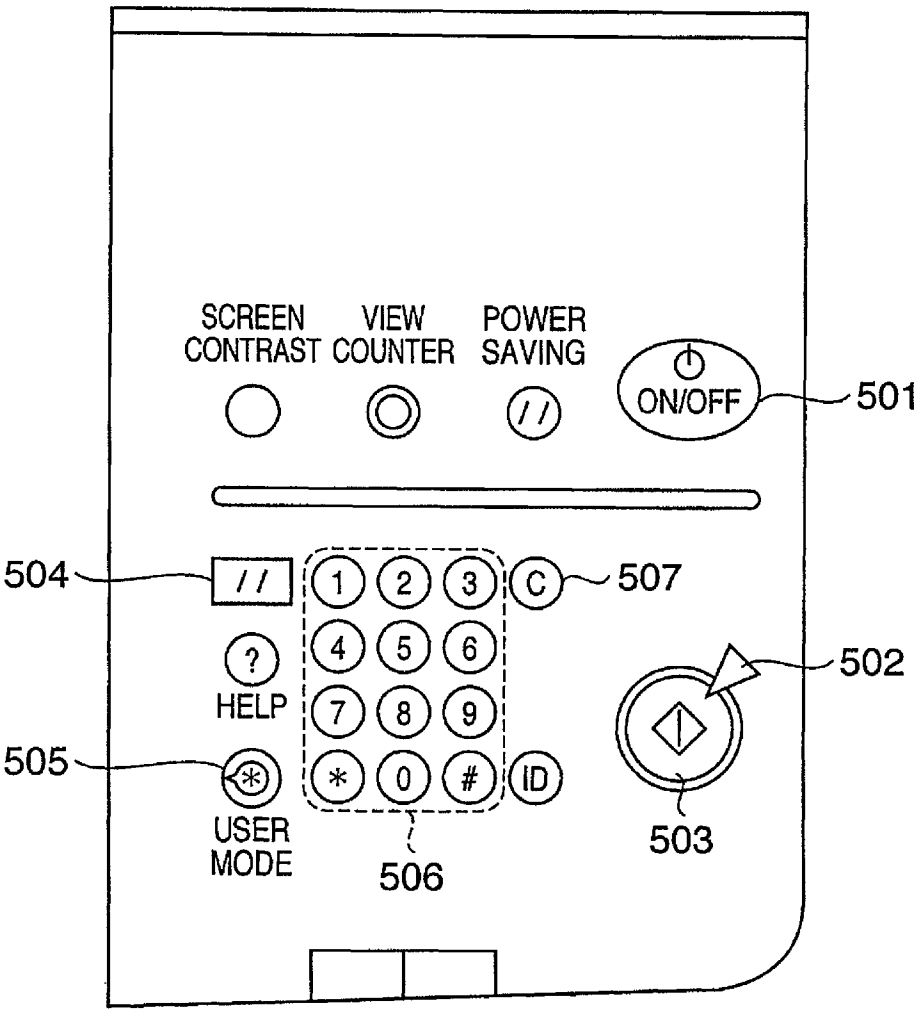
FIG. 5 is a view for explaining one example of the UI unit to be controlled by the embodiment of the present invention.

As shown in FIG. 5, the key input unit 402 comprises an operation unit power switch 501. In response to the user's operation of the switch 501, the CPU 205 controls to selectively switch a standby mode and sleep mode. Note that the standby mode corresponds to a normal operation state, and the sleep mode corresponds to a state in which the program is suspended in an interrupt waiting state to prepare for network printing processing, facsimile processing, or the like, thus saving power consumption. The CPU 205 controls to accept the user's operation of the switch 501 while a main power switch (not shown) which is used to supply electric power of the entire system is ON.

A start key 503 can accept from the user an instruction that makes the printing apparatus start job processing designated by the user such as the copying operation, transmission operation, or the like of a job to be processed. A stop key 502 can accept from the user an instruction that makes the printing apparatus cancel the processing of the accepted job. A numeric keypad 506 allows the user to set numerical values of various settings. A clear key 507 is used to clear various parameters such as numerical values and the like set via the numeric keypad 506. A reset key 504 accepts from the user an instruction to disable all settings set for a job to be processed by the user and to revert setting values to default values. A user mode key 505 is used to shift to a system setting window for each user.

Figure 6:
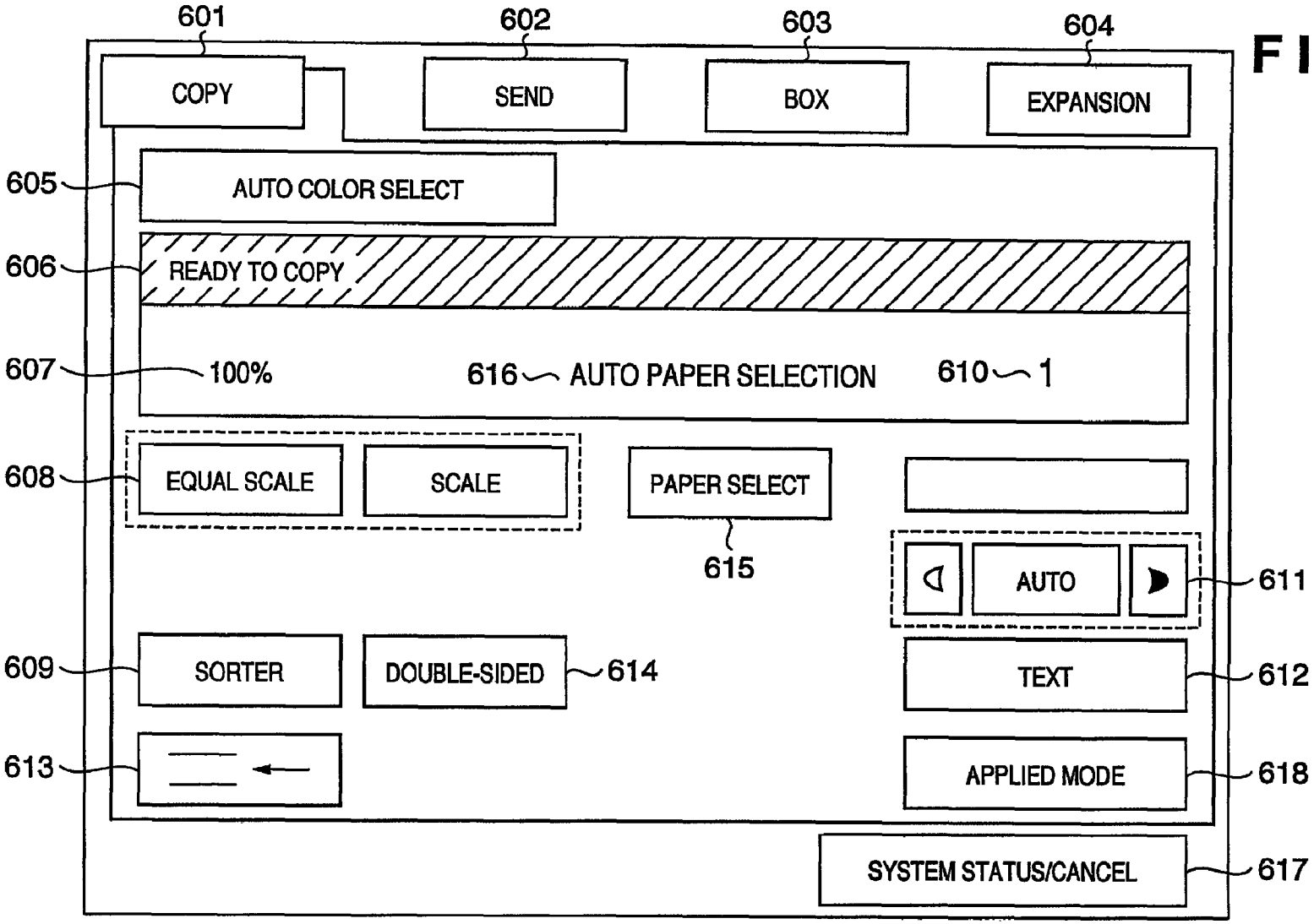
FIG. 6 is a view for explaining one example of the UI unit to be controlled by the embodiment of the present invention.
Figure 7:
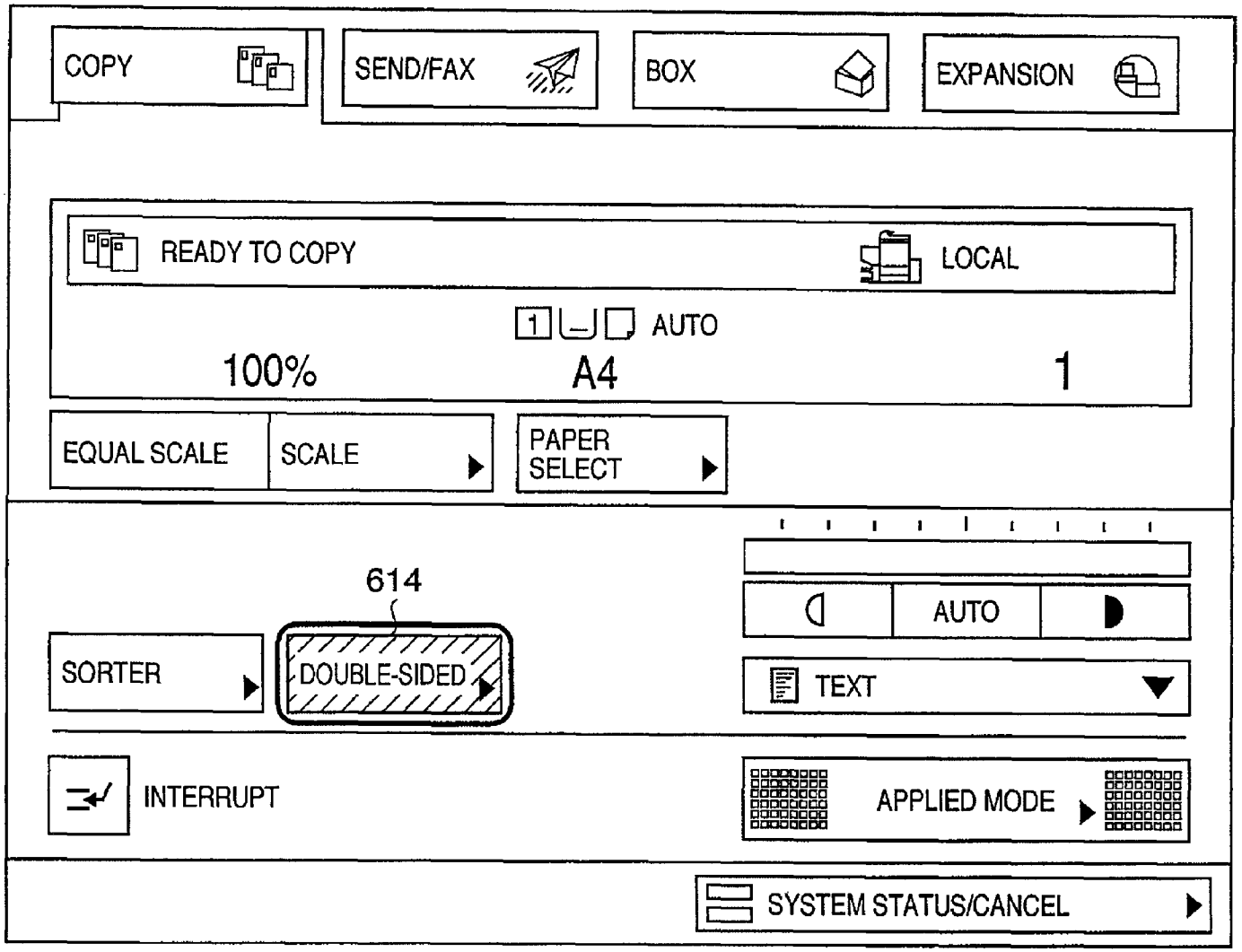
FIG. 7 is a view for explaining one example of the UI unit to be controlled by the embodiment of the present invention.

FIG. 6 is a view for explaining the touch panel unit (to be also referred to as a display unit hereinafter) 401 corresponding to an example of the user interface unit provided by this printing system. The touch panel unit 401 has an LCD (Liquid Crystal Display) and a touch panel display which is adhered on the LCD and has transparent electrodes. The unit 401 has both a function of accepting various settings from the operator, and a function of presenting information to the operator. For example, upon detection of user's depression on a portion corresponding to a display key in an active display state on the LCD, the CPU 205 controls to display an operation window corresponding to the key operation on the display unit 401 according to a display control program pre-stored in the ROM 207. Note that FIG. 6 shows an example of an initial window to be displayed on the display unit 401 when the state of this printing apparatus is a standby mode (there are no jobs to be processed by the printing apparatus).

When the user presses a copy tab 601 on the display unit 401 shown in FIG. 6, the CPU 205 controls to display the operation window of the copying function of this printing apparatus on the display unit 401. When the user presses a send tab 602, the CPU 205 controls to display the operation window of a data send function such as facsimile, e-mail sending, and the like of this printing apparatus on the display unit 401. When the user presses a box tab 603, the CPU 205 controls to display the operation window of a box function of this printing apparatus.

Note that the box function uses a plurality of data storage boxes (to be referred to as boxes hereinafter) which are virtually assured on the HDD 209 and can be distinctly used for respective users. With this function, the CPU 205 allows the user to select a desired one of the plurality of boxes via the user interface unit, and controls to accept a desired operation from the user.

For example, the CPU 205 controls the HDD 209 to store document data of a job accepted from the scanner unit 201 of this printing apparatus in the box selected by the user in response to a user's instruction input via the operation unit 204. The same applies to document data of a job or the like accepted from an external apparatus (e.g., the host computer 103, 104, or the like) via the external I/F unit 202. More specifically, the CPU 205 controls the HDD 209 to store data in the box designated by the user in accordance with a user's instruction of the external apparatus designated via the user interface unit of the external apparatus.

The CPU 205 controls, e.g., the printer unit 203 to print data of a job stored in the box in an output mode of user's choice or controls the external I/F unit 202 to transmit that data to an external apparatus of user's choice in accordance with a user's instruction from the operation unit 204. In order to allow the user to execute various box operations in this way, the CPU 205 controls to display the operation window of the box function on the display unit 401 in response to user's depression on the box tab 603.

When the user presses an expansion tab 604 on the display unit 401 of FIG. 6, the CPU 205 controls the display unit 401 to display a window to set an expansion function of scanner settings and the like. When the user presses a system monitor key 617, the CPU 205 controls the display unit 401 to display a display window to inform the user of the status and conditions of the MFP.

A color selection/setting key 605 is a display key which allows the user to select color copy, monochrome copy, or automatic selection. Scale setting keys 608 are used to display, on the display unit 401, a setting window that allows the user to make scale settings such as an equal scale, enlarged scale, reduced scale, or the like. When the user presses a sorter key 609, the CPU 205 controls the display unit 401 to display a window that allows the user to input an instruction to execute one of various kinds of sheet processing such as staple, punch, and the like, which can be executed by the aforementioned finisher of this system.

When the user presses a double-sided key 614, the CPU 205 controls the display unit 401 to display a window that allows the user to set whether to execute single-sided printing or double-sided printing in the printing processing of a job to be printed.

When the user presses a paper selection key 615, the CPU 205 controls the display unit 401 to display a window that allows the user to set a paper feed unit, sheet size, and sheet type (media type) required in the printing processing of a job to be printed.

In response to user's depression of a key 612, the CPU 20 controls the display unit 401 to display a window that allows the user to select an image processing mode suited to a document image such as a text mode, photo mode, or the like. When the user presses one of density setting keys 611, the density of an output image of a job to be printed can be adjusted.

As described above, the CPU 205 controls the display unit 401 to make display corresponding to a user's instruction, and controls this system to execute processing according to various processing conditions corresponding to user's instructions accepted via the display in a job to be processed.

Referring to FIG. 6, the CPU 205 controls to make display that allows the user to confirm the operation state of a current event in this printing apparatus such as standby, warming up, printing, jam, error, and the like, on a status display field 606 of the display unit 401.

The CPU 205 controls to display information that makes the user confirm the print scale of a job to be processed on a display field 607. Also, the CPU 205 controls to display information that makes the user confirm the sheet size and paper feed mode of a job to be processed on a display field 616. Furthermore, the CPU 205 controls to display information that makes the user confirm the number of copies to be printed of a job to be processed, and information that makes the user confirm the page number which is being printed during the printing operation on a display field 610. In this manner, the CPU 205 controls the display unit 401 to display various kinds of information to be notified the user.

Furthermore, when the user presses an interrupt key 613, the CPU 205 interrupts the printing processing of a job which is being printed by this printing apparatus and allows to execute printing processing of a job of that user. When the user presses an applied mode key 618, the CPU 205 controls the display unit 401 to display a window to set various kinds of image processing, layouts, and the like such as page continuous shot, cover sheet/interleaving sheet settings, reduced-scale layout, image move, and the like.

Note that the arrangement of the printing apparatus (MFP 105 or 106) described using FIGS. 1 to 6 are the basic arrangement common to all the embodiments of the present invention including the first to third embodiments.

<Display Control Example upon Executing Double-Sided Printing of Job of Copying Function by this Printing Apparatus>

A description pertaining to the operation flow upon executing as a processing target job double-sided printing of print data of a job of the copying function as one of principal characteristic features of this embodiment will be given using FIGS. 6 to 11. In this example, a control example of the CPU 205 upon executing double-sided printing of print data of a job to be processed accepted via the scanner unit 201 of this printing apparatus by the printer unit 203 via the HDD 209 will be explained.

Figure 8:
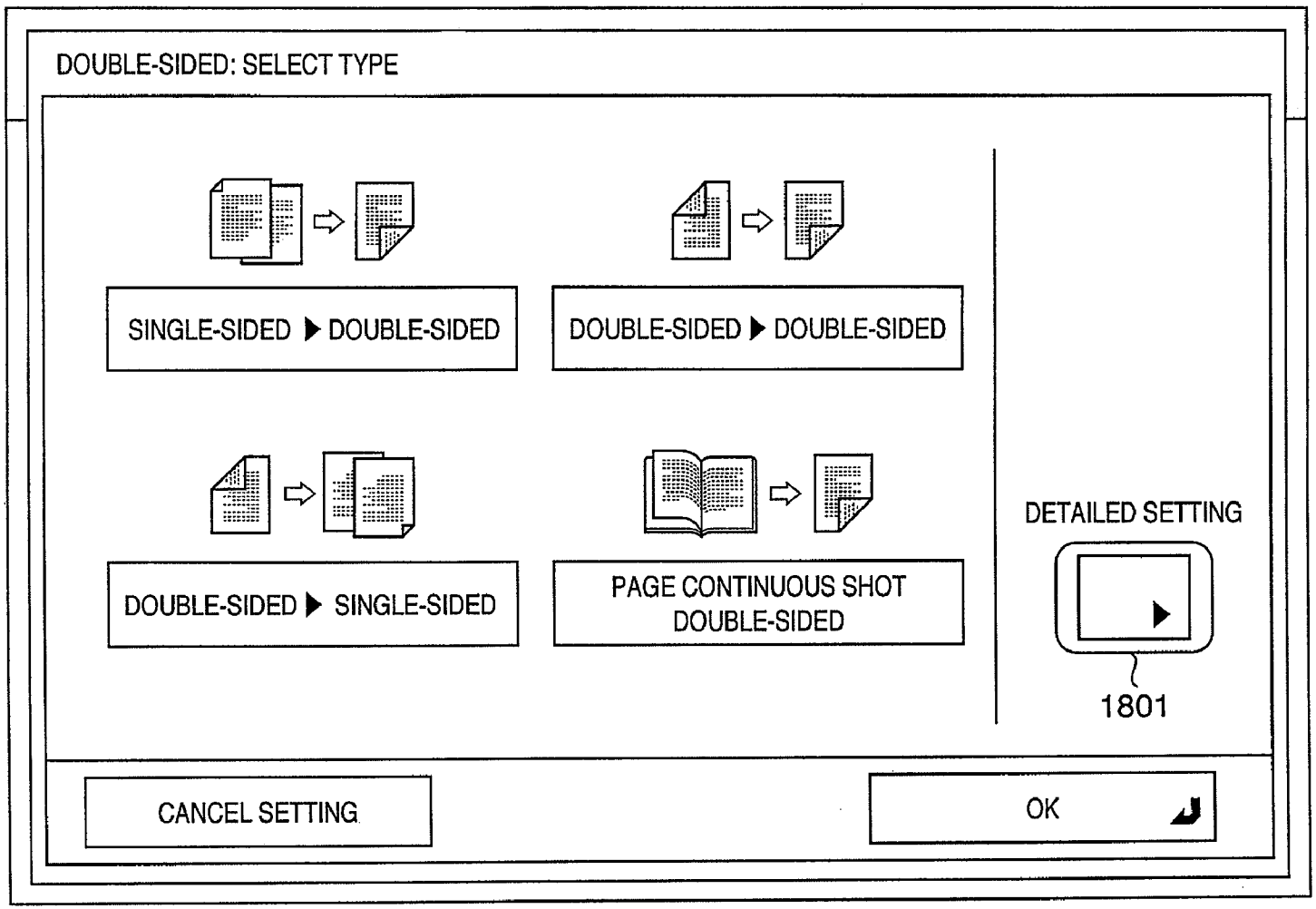
FIG. 8 is a view for explaining one example of the UI unit to be controlled by the embodiment of the present invention.

When the operator presses the double-sided setting key 614 on the initial window of the display unit 401 shown in FIG. 6, the CPU 205 displays the double-sided setting key 614 in a selected state (see FIG. 7), and then displays a window shown in FIG. 8 on the display unit 401. The CPU 205 controls the display unit 401 to accept, from the user, a setting associated with double-sided printing of a job to be processed via the window shown in FIG. 8 displayed on the display unit 401.

When the user presses a "single-sided→double-sided" key of four instruction keys which are displayed on the central portion of the window in FIG. 8 and are used to instruct printing modes, the CPU 205 controls the scanner unit 201 to execute single-sided scanning processing of a job to be processed of a series of documents including a plurality of pages. Also, the CPU 205 controls the HDD 209 to store the scanned print data of the job. Furthermore, the CPU 205 controls the printer unit 203 to execute double-sided printing processing for printing the print data of the job in the HDD 209 on the front and back sides of sheets.

On the other hand, when the user presses a "double-sided→double-sided" key on the window of FIG. 8, the CPU 205 controls the scanner unit 201 to execute double-sided scanning processing of a job to be processed of a series of documents including a plurality of pages. Also, the CPU 205 controls the HDD 209 to store the scanned print data of the job. Furthermore, the CPU 205 controls the printer unit 203 to execute double-sided printing processing for printing the print data of the job in the HDD 209 on the front and back sides of sheets.

When the user presses a "double-sided→single-sided" key on the window of FIG. 8, the CPU 205 controls the scanner unit 201 to execute double-sided scanning processing of a job to be processed of a series of documents including a plurality of pages. Also, the CPU 205 controls the HDD 209 to store the scanned print data of the job. Furthermore, the CPU 205 controls the printer unit 203 to execute single-sided printing processing for printing the print data of the job in the HDD 209 on only one side of each sheet.

In this manner, the CPU 205 controls units such as the scanner unit 201, HDD 209, printer unit 203, and the like to make this printing apparatus execute the operations according to the user's setting associated with double-sided printing.

With this configuration, assume that the user presses the "single-sided→double-sided" key or "double-sided→double-sided" key on the window in FIG. 8. In this case, that is, when the double-sided printing setting is made for a job to be processed, the CPU 205 controls the display unit 401 to set a detail setting key on the window in FIG. 8 in an active display state to allow the user to press that key.

In this manner, when the double-sided printing setting is made for a job to be processed, the CPU 205 controls to accept detailed settings associated with double-sided printing from the user via the user interface unit. For example, in response to depression of a detail setting key 801 by the operator on the window in FIG. 8, the CPU 205 displays a detail setting window shown in FIG. 9 on the display unit 401.

Figure 9:
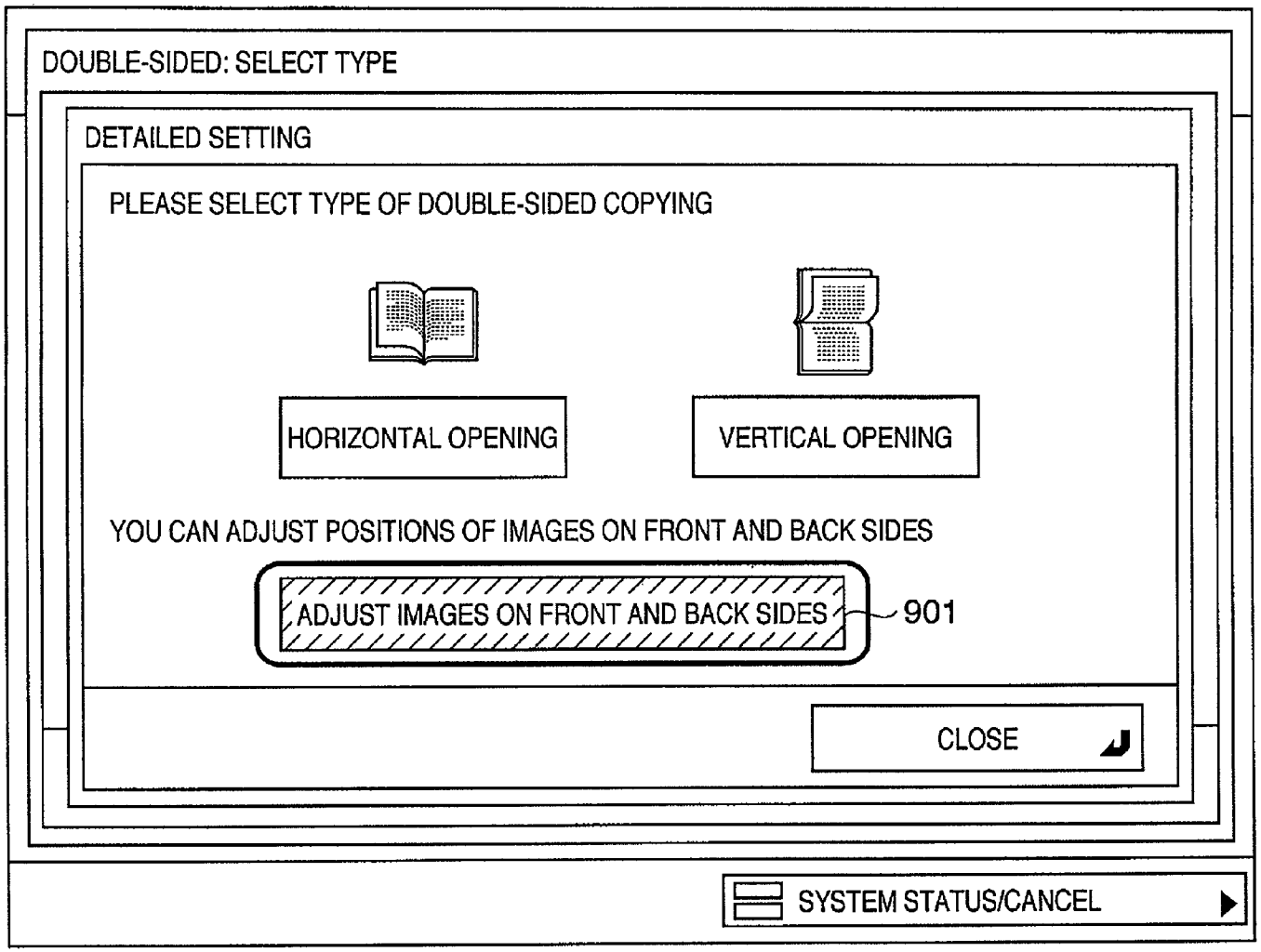
FIG. 9 is a view for explaining one example of the UI unit to be controlled by the embodiment of the present invention.

The window shown in FIG. 9 which is displayed on the display unit 401 by the CPU 205 comprises an "adjust images on front and back sides" key 901 as one of characteristics features of this embodiment in addition to "horizontal opening" and "vertical opening" keys which allows the user to set the type of double-sided printing. When the user presses the key 901, the CPU 205 controls this printing apparatus to output a double-sided printing result in a state wherein the positions of images on the front and back sides of a sheet are adjusted in a job to be double-sided printed.

For example, of two images, i.e., a front side image and back side image which are printed on the front and back sides of a sheet in the job to be double-sided printed, the printing position of the image on one side on the sheet is controlled not to be misaligned from that of the image to be printed on the other side on the sheet by a predetermined value or more. To this end, the image is printed on one side of the sheet while a printing region of the image to be printed on one side is shifted in a predetermined direction by the predetermined value. A series of control processes by the CPU 205 will be described later.

Figure 10:
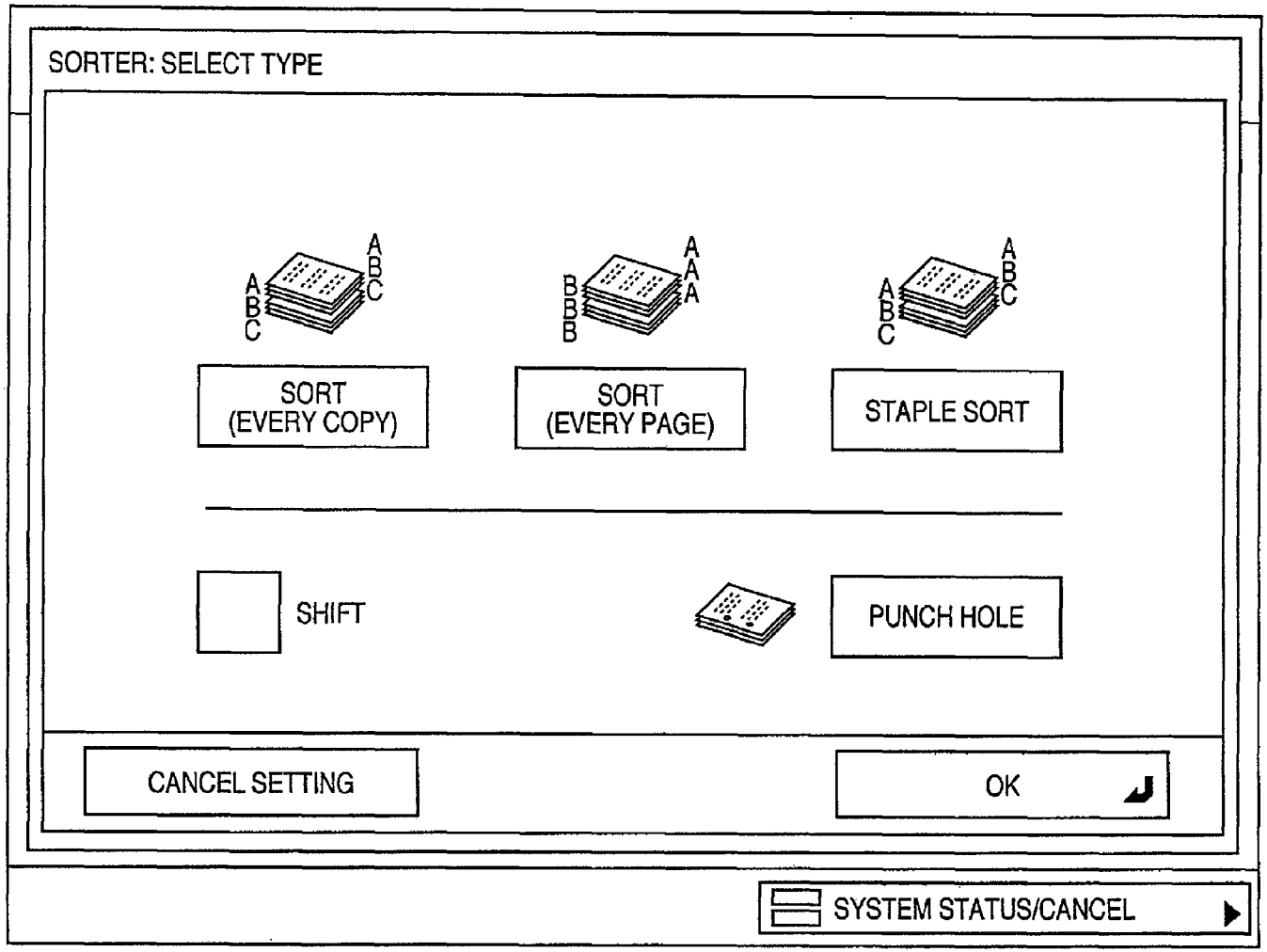
FIG. 10 is a view for explaining one example of the UI unit to be controlled by the embodiment of the present invention.

When the operator presses the sorter key 609 on the window in FIG. 6, the CPU 205 displays a window in FIG. 10 on the display unit 401.

The window shown in FIG. 10 comprises a "sort (every copy)" key, "sort (every page)" key, and "staple sort" key which allows the user to set the type of finishing to be executed by the finisher. As in the above example, the CPU 205 controls the display unit 401 to make display that allows the user to set processing to be executed by the sheet processing apparatus of this system in a job to be processed from a plurality of types of sheet processing. Note that the plurality of types of sheet processing to be executed by the sheet processing apparatus of this system include sort, staple, punch, shift, bookbinding, and the like.

Figure 11:
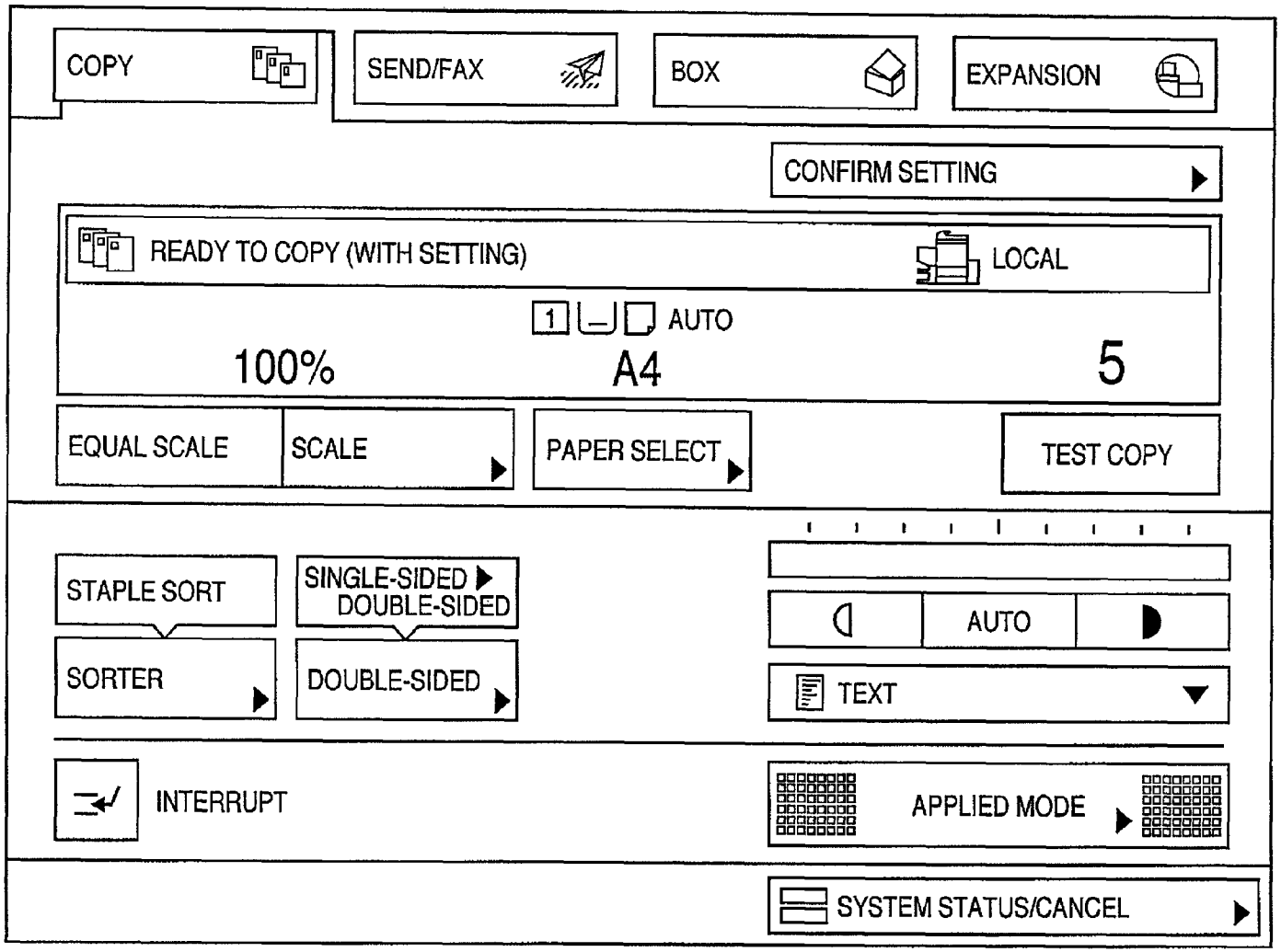
FIG. 11 is a view for explaining one example of the UI unit to be controlled by the embodiment of the present invention.

Upon completion of a series of printing settings for a job to be processed by the user via the windows shown in FIGS. 6 to 10 and the like, the CPU 205 controls the display unit 401 to make display that allows the user to confirm the printing conditions set by the user. FIG. 11 shows this display example. Note that the CPU 205 allows the user to set the number of copies to be printed of the job to be processed using numeric keypad 506.

In the example of FIG. 11, the user makes the following settings via the user interface unit as the printing conditions of the job to be processed.

Number of copies to be printed: "5" copies

Print scale: "100%"

setting of single- or double-sided printing: "double-sided printing"

Sheet processing to be executed by sheet processing apparatus: "staple"

Size and type of sheet to be used: "A4 size and plain paper"

In this way, in response to depression of the start key 503 by the user after a series of printing conditions for the job to be processed are accepted from the user, the CPU 205 controls this printing apparatus to execute the processing of the job according to the user's printing conditions.

<Copy Example in Double-Sided Copying>

A copying example upon executing double-sided copying for bookbinding of a manual, guidebook, or the like will be described below.

Figure 12:
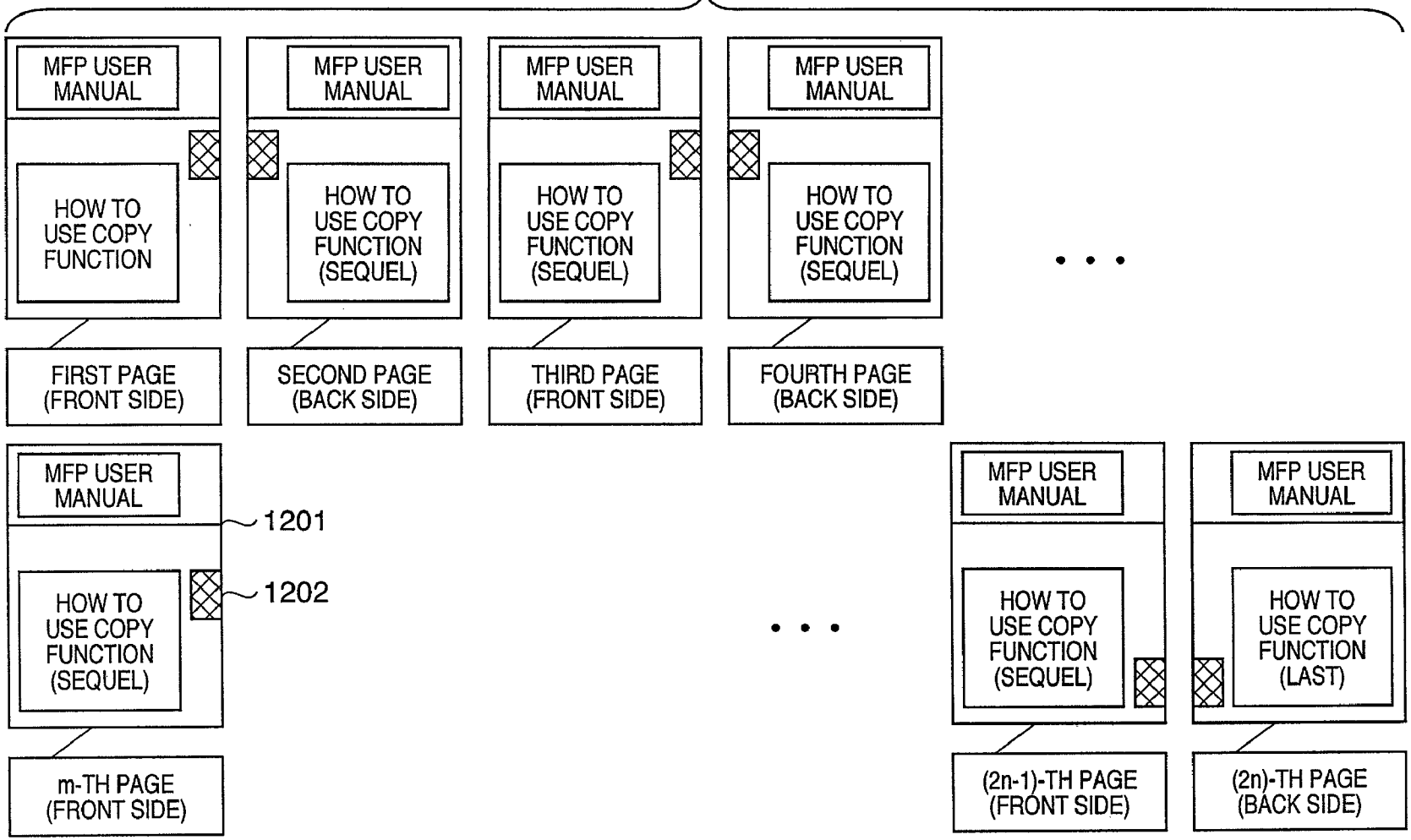
FIG. 12 is a view for explaining one example of a data processing method of a print job to be controlled by the embodiment of the present invention.

FIG. 12 is a view for explaining an example when the printing apparatus (MFP 105 or 106) of this embodiment is used to create, e.g., a manual (guidebook) of a product as a print product. The print product is an example when it is printed in the double-sided printing mode.

An example when document data with a document name "MFP user's manual" is printed in the double-sided printing mode will be explained. This job includes a series of print data of a plurality of pages like the first page, second page, third page, fourth page, . . . , and the last page is the (2n)-th page. That is, the job includes document data for 2n pages as the total number of pages.

Note that the printing apparatus of this embodiment is configured to accept data of a job to be printed from the scanner unit 201 of the self apparatus, and is also configured to accept data of a job to be printed transmitted from an external apparatus via the external I/F unit 202. With this configuration, the CPU 205 controls the HDD 209 which can store data of a plurality of jobs to sequentially store data of these jobs to be processed. The CPU 205 controls the printer unit 203 to print data of the job to be printed of those of the plurality of jobs stored in the HDD 209. Note that the CPU 205 controls in accordance with the printing processing conditions from the user set via the user interface unit of this system.

When a job to be processed is accepted from the scanner unit 201, the printing processing conditions of that job are accepted from the user using the operation unit 204 of this printing apparatus. On the other hand, when a job to be processed is accepted from an external apparatus, the printing processing conditions of that job are accepted from the user via the user interface unit of the external apparatus. In this way, in this embodiment, the user can set the processing conditions of a job to be processed via the user interface unit of the apparatus which serves as a transmission source of print data of that job.

Since such arrangement is adopted, when the document data with the document name "MFP user's manual" is input from the scanner unit 201, the CPU 205 accepts the printing processing conditions of that job from the user via the operation unit 204 of this printing apparatus. On the other hand, when the data of that job is input from an external apparatus, the CPU 205 allows the user to set the printing processing conditions of this job via the user interface unit of the external apparatus. In addition, the CPU 205 accepts printing condition data of the job via the external I/F unit 202 together with the print data of that job.

A case will be exemplified in FIG. 12 wherein the manual of a product is printed as a print product in consideration of the POD environment. Also, the job of interest includes an example of print data including three types of image data. The three types of image data include contents (image data of a body text part), frame image data 1201 corresponding to a frame part of the contents, and index image data 1202 corresponding to an index part of the contents.

Also, the job of interest includes document data which is to be double-sided printed. Therefore, as for data of each odd page to be printed on the first side (front side) of a sheet, the index image data 1202 is laid out so that the index image 1202 is printed on the right end portion of the sheet when the first side of the sheet is viewed from an erected state.

In the example of FIG. 12, data of (the first, third, . . . , m-th, . . . , (2n−1)-th pages) of that job fall into this case. Also, as for data of each even page to be printed on the second side (back side) of a sheet, the index image data 1202 is laid out so that the index image 1202 is printed on the left end portion of the sheet when the second side of the sheet is viewed from an erected state.

In the example of FIG. 12, data of (the second, fourth, . . . , (2n)-th pages) of that job fall into that case.

Furthermore, the job of interest is a print product to be output as a manual. Therefore, index images are laid out so as to distinguish index parts for respective chapters of print data including a plurality of chapters like the first chapter, second chapter, and the like. In the example of FIG. 12 as well, the index images are laid out so that the printing regions of index images are shifted in increments of chapter number.

A practical example will be explained below. An index image of each page which belongs to a predetermined chapter to be printed is laid out so that its printing position shifts downward by one index from that of an index image of each page which belongs to the immediately preceding chapter. For example, an index image of each page which belongs to the second chapter is laid out so that its printing position shifts downward of the sheet by one index from that of an index image of each page which belongs to the first chapter. Note that all the index images of pages which belong to the same chapter are laid out to have the same printing positions.

For example, all the index images of pages which belong to the second chapter are laid out to have the same printing positions. This embodiment comprises a function of controlling to prevent the printing positions of index images of pages which belong to the same chapter from being misaligned on the front and back sides of the sheet, which undergoes double-sided printing, as much as possible, when print data of the job with such data format are to be printed on the front and back sides of sheets. This example is the "adjust positions of images on back and front sides" function.

Figure 13:
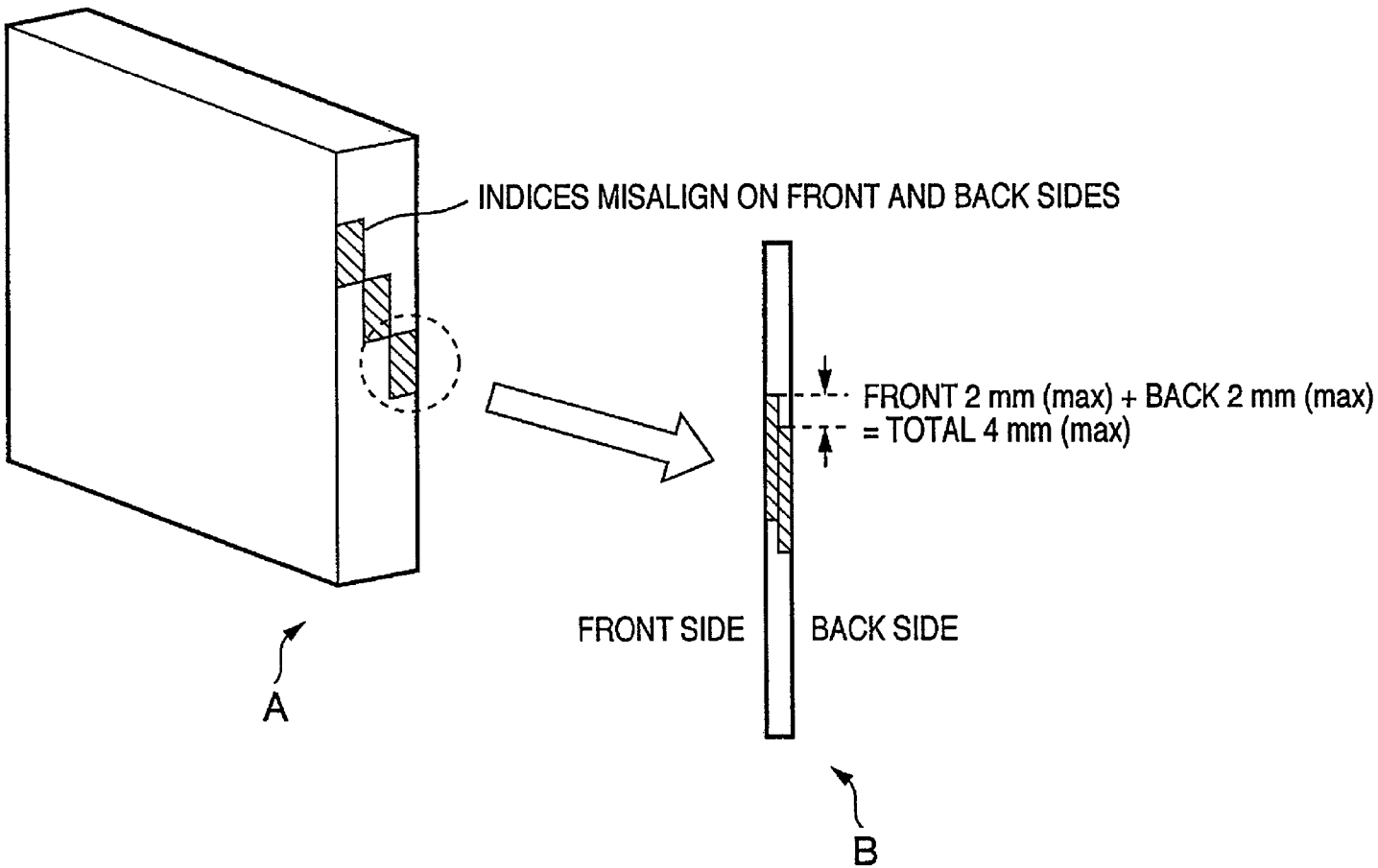
FIG. 13 is a view for explaining one example of the data processing method of a print job to be controlled by the embodiment of the present invention.

A and B of FIG. 13 show an example of the print product bound up as the printing result of the job shown in FIG. 12 as schematic views. The example of FIG. 13 corresponds to a case wherein the printing processing of a job to be double-sided printed is executed without using the "adjust positions of images on back and front sides" function that can be executed in such job in the printing system.

A of FIG. 13 shows the print product as a three-dimensional projected view. When the job shown in FIG. 12 undergoes double-sided printing and the printed sheets are bound up, the index images printed on the end portions of respective pages are reflected as the printing result shown in A of FIG. 13 on a portion (called a fore edge) opposite to a back portion of the print product since the pages are combined into a bundle as a bound product. A of FIG. 13 indicates the result indicating that there are three portions to be distinguished from other blocks like the first, second, and third chapters, and the index images are respectively assigned to these portions.

B of FIG. 13 shows a sectional view of an arbitrary paper sheet which forms an index in a portion encircled by a dotted circle in A of FIG. 13. In other words, B of FIG. 13 shows a sectional view of one sheet on the front and back sides of which index images have already been printed in the double-sided printing mode. In the example of B of FIG. 13, data to be processed were laid out to print index images on the front and back sides on print regions originally corresponding to an identical portion. As a result of actual double-sided printing on the front and back sides of a sheet, position misalignment has occurred in this example.

When double-sided printing processing is executed without using the "adjust positions of images on back and front sides" function of this embodiment, position misalignment of images on the front and back sides is likely to occur, as shown in B of FIG. 13, due to the precision associated with position alignment of the printing apparatus. In other words, a phenomenon that the image printing position of an index image 1202 for the front side to be printed on the front side of a sheet cannot be precisely aligned with that of an index image 1202 for the back side to be printed on the back side of the sheet may occur. Such phenomenon resulting from the precision of the image alignment mechanism associated with the printing process of the printing apparatus may occur. The position misalignment phenomenon of the front and back images is negligible for the user in an environment which is not an environment that creates print products as articles. However, for example, if products that consider the POD environment or the like are put into practical use, more convenient printing environment can be provided by taking a measure against the above phenomena.

A case will be examined below wherein the position misalignment of images on the front and back sides is conspicuous as a printing result. For example, assume that data of a job to be printed is print data which is more likely to be printed in the POD environment such as print data which has index images and is to be printed as a manual or guidebook, or the like as in the example of FIG. 12. If the images on the front and back sides are misaligned in the job in which images must be printed on end portions of a sheet in the double-sided printing mode as in the example of FIG. 12, their position misalignment may become conspicuous in the printing result, as shown in FIG. 13. In addition, if a sheet bundle that has undergone double-sided printing includes only one sheet, even when position misalignment on the front and back sides has occurred in the printing result, it is unlikely to be conspicuous.

However, when one sheet bundle that has undergone double-sided printing includes a plurality of sheets, as shown in FIG. 12, if position misalignment between the images on the front and back sides has occurred per sheet, the position misalignment of images may become conspicuous since pages can be compared with other pages upon combining into one bundle, as shown in FIG. 13. In other words, indices 1202 may be printed in a jagged pattern for respective pages depending on the alignment precision, and may be very conspicuous when they are checked with eyes of the operator.

As for the precision of image position alignment of the printing apparatus, there is an error of 2 mm as the alignment precision. In this case, an image may be printed to be misaligned by a maximum of 2 mm from the image position to be originally printed. Upon executing double-sided printing in such circumstances, if an image printing position is misaligned by 2 mm on the front side and that of an image on the back side is misaligned by 2 mm in the direction opposite to the misalignment direction of the image on the front side, these images may be misaligned by 4 mm as a total of the image position misalignment amounts of the images to be printed on the front and back sides of the sheet.

In this manner, when the misalignment amount becomes large to some extent, such products may be unsalable in environments that handle print products as articles like the POD environment and the like.

Factors of occurrence of the image position misalignment in the printing result include external factors associated with environmental conditions such as the ambient temperature, humidity, and the like of the installation place of the printing apparatus. Also, such factors of occurrence include internal factors such as shrinkage of paper sheets due to heat generated upon fixing by the fixing unit in the printing apparatus, displacement of a sheet in the paper convey path, and the like. In other words, there are a plurality of factors of occurrence of the image position misalignment in the printing apparatus including the external and internal factors. The image position misalignment amount which may be generated in the printing apparatus in association with such plurality of factors may dynamically change every time a job is printed or on a dairy basis.

This embodiment provides the "adjust positions of images on front and back sides" function to cope with such situation. The CPU 205 controls to execute this function by this printing apparatus. With the above arrangement, this embodiment provides a scheme which can prevent the problems assumed in the prior art from occurring, and can reduce the work load (e.g., the operator re-does complicated works and the like for image position alignment as needed) as much as possible.

Not only the work efficiency of the operator involved in double-sided printing can be improved, but also high productivity of jobs to be processed by the printing system can also be taken into consideration while assuring the high efficiency. Also, high productivity can be maintained. This example will be described below.

<Image Printing Position Alignment Function of Double-Sided Printing Job According to User's Instruction from Operation Unit 204>

This example corresponds to a control example when the CPU 205 controls the printing apparatus to execute the image printing position alignment operation for a job to be double-sided printed in accordance with a user's instruction input via the operation unit 204 of the printing apparatus itself as an example of the user interface unit of this embodiment.

This practical example will be described using the processing shown in the flowchart of FIG. 14. In this case, a control sequence when print data of a job which is accepted from the scanner unit 201 of the printing apparatus (MFP 105, 106, or the like) and includes a plurality of pages to be double-sided printed is printed in the double-sided printing mode by the printer unit 203 in accordance with an instruction from the operation unit 204 will be explained. The CPU 205 controls this printing apparatus to execute that processing by reading out and executing a program associated with the processing of this flowchart pre-stored in the ROM 207.

In response to depression of the start key 503 of the operation unit 204 by the user, the CPU 205 checks in step S1401 if a job to be printed requires double-sided printing processing. In this case, the CPU 205 uses setting information from the operation unit 204 (e.g., information indicating whether or not the double-sided printing setting is made for the job using the double-sided key 614, and the like) as information for making a decision.

If the job to be processed does not require any double-sided printing processing, the flow advances to step S1414, and the CPU 205 controls this printing apparatus to execute processing other than the double-sided printing processing. For example, the CPU 205 controls the printer unit 203 to execute single-sided printing processing of data of a job input from the scanner 201 via the HDD 209 under the printing processing conditions set via the operation unit 204.

On the other hand, if the job to be processed requires the double-sided printing processing, the flow advances to step S1402.

The CPU 205 checks in step S1402 whether or not the job to be double-sided printed requires the double-sided image printing position alignment operation by this printing apparatus. In this case, for example, the CPU 205 uses information indicating whether or not the "adjust images on front and back sides" key 901 on the window in FIG. 9 displayed on the display unit 401 has been pressed, i.e., whether or not the user inputs an instruction to adjust images on the front and back sides via the operation unit 204 as that for making a decision.

If the job to be double-sided printed is a print job that does not require any double-sided image printing position alignment operation by this printing apparatus (if the key 901 in FIG. 9 is not selected), the flow advances to step S1413. In step S1413, for example, the CPU 205 controls the printer unit 203 to execute the double-sided printing operation of the job to be processed while inhibiting this printing apparatus from executing the image position alignment operation. As one example, the CPU 205 controls the printer unit 203 to execute a normal double-sided printing operation of data of a job input from the scanner unit 201 via the HDD 209 under the printing processing conditions set via the operation unit 204 while skipping processes in steps S1409 and S1411 and the like.

On the other hand, if the job to be double-sided printed is a print job that requires the double-sided image printing position alignment operation by this printing apparatus (if the key 901 in FIG. 9 is selected), the flow advances to step S1403.

In step S1403, the CPU 205 controls the scanner unit 201 to execute the scanning operation of documents of the job to be double-sided printed that requires the printing position alignment operation of images on the front and back sides, which are set on the ADF 301 of the scanner unit 201. For example, in this case, the CPU 205 controls to feed a bundle of documents of that job, which are set on the ADF 301 and include a plurality of pages, to the scanning positions of the scanner unit 201 in turn from the first page, and controls the scanner unit 201 to scan these documents. The CPU 205 also controls the HDD 209 to store scanned image data of the documents of the job in turn from the first page. The CPU 205 controls to execute the storage operation of the job data in the HDD 209 until the last page of the bundle of documents of the job is stored in the HDD 209.

In step S1404, the CPU 205 controls to read out document data of the second page of the job stored in the HDD 209 in step S1403 from the HDD 209. Also, the CPU 205 controls the printer unit 203 to print the document data of the second page of the job read out from the HDD 209 on a side as the second side (back side) of a first printing sheet required in printing of the job.

In step S1405, the CPU 205 controls to read out document data of the first page stored in the HDD 209 in step S1403 from the HDD 209. Also, the CPU 205 controls the printer unit 203 to print the document data of the first page of the job read out from the HDD 209 on a side as the first side (front side) of the first printing sheet required in printing of the job. Note that the first printing sheet required in the job that requires the printing position alignment operation of images on the front and back sides is a sheet which has already been fed from the paper feed unit and on the second side of which the image of the second page has been printed at the stage of step S1405.

An example of the control by the CPU 205 for the printer unit 203 upon executing double-sided printing in this embodiment will be described below using FIG. 3. The CPU 205 controls the printer unit 203 to pass a sheet on the second side of which printing processing has been executed through the fixing unit 308 prior to printing processing on its first side, and then to guide the sheet toward the double-sided tray 314 side via the member 309. Furthermore, the CPU 205 performs sheet convey control of the printer unit to guide the sheet so that an image can be printed on the first side. In addition, the CPU 205 exhausts the sheet outside the apparatus after the printing processing has been done on the first side of the sheet. In this case, the CPU 205 reverses the first and second sides of the sheet immediately before the sheet is exhausted outside the apparatus.

By executing a series of control processes described above, the CPU 205 controls the exhaust unit to stack the sheet on the first and second sides of which double-sided printing processing has been executed while the second side faces up and the first side faces down. The CPU 205 controls this printing apparatus to execute such double-sided printing sequence. In this manner, the exhaust unit can stack a plurality of sheets which are to be double-sided printed of a job including a plurality of pages in turn from the first page.

Since the aforementioned sequence is adopted, this embodiment controls to execute the printing processing of the second side prior to that of the first side. In other words, in a printing apparatus which executes the printing processing on the first side prior to that of the second side since an exhaust unit stacks a print product with a uniform print order, the arrangement other than that described above need not be adopted. For example, the processing in step S1405 may be executed prior to that in step S1404. In this way, this embodiment can be applied to printing apparatuses with any double-sided printing sequences as long as they can execute the image position alignment operation to be described later.

This embodiment includes many schemes that can improve productivity as much as possible. An example of such schemes is the processing start timing of step S1404. More specifically, at the execution timing of processing in step S1403, when neither a job whose printing processing is underway nor a job in a printing waiting state are present in the HDD 209 except for the job to be double-sided printed that requires the printing position alignment operation of images on the front and back sides, the CPU 205 executes the following control.

For example, in this case, when data of the first and second pages of the job to be double-sided printed that requires the printing position alignment operation of images on the front and back sides are stored in the HDD 209, the CPU 205 controls the printer unit 203 to execute a series of double-sided printing operations in steps S1404 and S1405.

Parallel to (simultaneously with) the series of double-sided printing operations, the CPU 205 controls this printing apparatus to execute a series of storage operations for storing print data of respective pages, i.e., from the third page to the last page of that job in the HDD 209. For this purpose, the CPU 205 controls the related units such as the scanner unit 201, HDD 209, and the like. The CPU 205 executes such control when there are no jobs to be printed except for the job that requires the position alignment operation of images on the front and back sides.

More specifically, the CPU 205 controls the printer unit 203 to execute a predetermined double-sided printing operation as the printing position alignment operation of images on the front and back sides when the data of the first and second pages of the job to be double-sided printed that requires the printing position alignment operation of images on the front and back sides are stored in the HDD 209. As this predetermined double-sided printing operation, in this embodiment, the CPU 205 controls to print, on the front and back sides of the sheet, the print data of the first and second pages of the job itself to be double-sided printed that requires the printing position alignment operation of images on the front and back sides to be printed on the respective sides of one sheet.

In addition, the CPU 205 controls to execute the storage operation of data of the third page and subsequent pages of that job in the HDD 209 during the printing operation. In this way, the CPU 205 allows to start the processing in step S1404 and subsequent steps without waiting for storage, in the HDD 209, of data of all the pages of the job to be double-sided printed that requires the printing position alignment operations of images on the front and back sides.

As a result, the total time period required to complete all processes of the job to be double-sided printed that requires the printing position alignment operations of images on the front and back sides can be shortened, thus improving the productivity. Note that this embodiment adopts the aforementioned operation to improve the productivity. Therefore, the above arrangement need not always be adopted depending on the convenience of the apparatus or user's needs.

The processing in step S1405 and subsequent steps will be described below. Upon execution of the processing in step S1405, the printing processing of the first and second pages of the job that requires the printing position alignment operation of images on the front and back sides is complete. In this case, the CPU 205 controls the printer unit 203 to exhaust the sheet on which the image of the first page of the job has been printed on the first side and that of the second page of the job has been printed on the second side onto, e.g., the tray 324. After the CPU 205 controls the printer unit 203 to execute such operation, it controls to stop the printing operation of the job as the processing in step S1406.

In this example, the printing operation is stopped after the first sheet of the job is exhausted. However, the present invention is not limited to such specific example. For example, in a job that requires the printing position alignment operation of images on the front and back sides, the printing operations for an arbitrarily designated number of sheets is controlled to be executed. After that, the printing operation is stopped. The CPU 205 executes such control.

For example, during the printing operation of the job that requires the printing position alignment operation of images on the front and back sides, the CPU 205 allows the user to press the stop key 502 of the operation unit 204. In response to a stop instruction input by the user upon depression of the stop key 502, the printing operation of the job that requires the printing position alignment operation of images on the front and back sides is stopped.

In this manner, the double-sided printing operation of the job as an example of the image printing position alignment operation is stopped in response to the user's instruction input via the user interface unit provided by this embodiment. The CPU 205 can execute such control. In this way, after the printing operation for a desired number of sheets is executed, the printing operation can be stopped at a timing of operator's choice.

In step S1406, the printing operation of the job that requires the printing position alignment operation of images on the front and back sides is stopped. In response to this, the CPU 205 executes processing in step S1407. For example, the CPU 205 controls the display unit 401 of this printing apparatus as an example of the user interface unit to perform a predetermined display that allows the user himself or herself to make a setting associated with position alignment of images on the front and back sides of data to be double-sided printed of the job. As an example of this predetermined display, in this embodiment, a double-sided image printing position alignment detailed setting window shown in FIG. 15 is displayed on the display unit 401.

Figure 15:
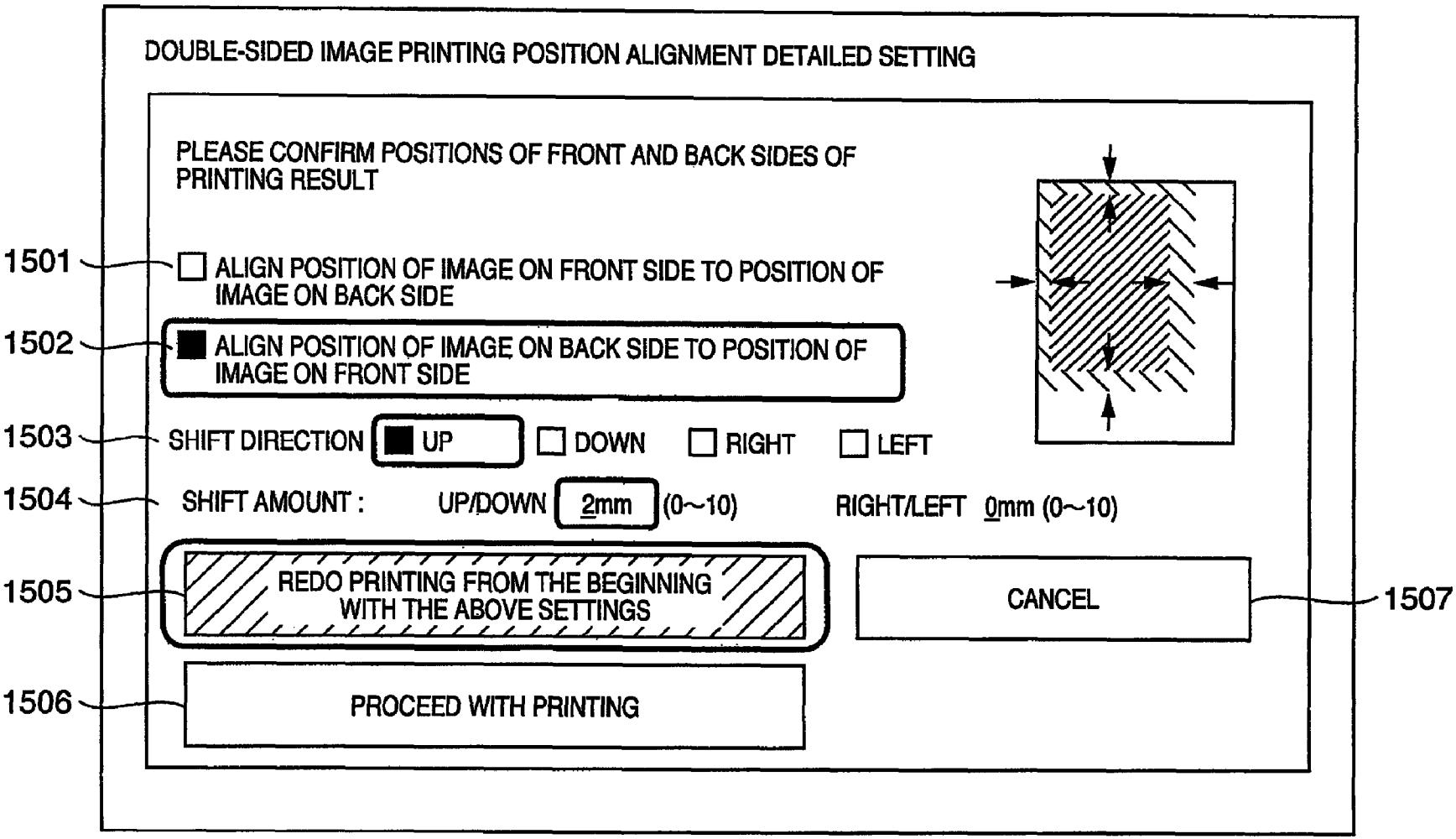
FIG. 15 is a view for explaining one example of the UI unit to be controlled by the embodiment of the present invention.

The window shown in FIG. 15 to be displayed by the CPU 205 on the display unit 401 in step S1407 includes display elements shown in FIG. 15. One example of such display elements is a display of guidance information such as "please confirm the positions of the front and back sides of the printing result" or the like for the double-sided print job that requires the printing position alignment operation of images on the front and back sides. In this example, the CPU 205 prompts the user to confirm the sheet which has undergone the double-sided printing processing of the first and second pages in steps S1404 and S1405 and is stacked on the tray 324, i.e., the printing result of the job itself.

Therefore, the CPU 205 informs the user of that guidance information. By informing the user of such guidance information, the user himself or herself visually confirms the printing result of the image of the first page of the job on the first side (front side) of the sheet, and that of the image of the second page on the second side (back side) of the sheet.

After that, the CPU 205 controls to accept various execution instructions associated with the position alignment operation of images on the front and back sides of the job to accept from the user via the predetermined display executed on the display unit 401. As an example of the predetermined display that allows various instructions from the user to be accepted, the CPU 205 controls the display unit 401 to display an operation window comprising various instruction keys shown in FIG. 15. A description associated with various instruction keys on the window of FIG. 15 will be given below.

For example, assume that the user presses a key 1501 (to be referred to as a front side selector key hereinafter in this example). In this case, the CPU 205 controls the printer unit 203 to execute the double-sided printing processing which adjusts the printing position of print data, which belongs to data of the job which is to be printed in the double-sided print mode and requires position alignment of images on the front and back sides, and corresponds to the page to be printed on the first side of the sheet, with respect to the first side of the sheet.

In this example, the printing position of the image on the first side of the sheet corresponding to the page to be printed on the first side (front side) of the sheet is adjusted to that of the image on the second side of the sheet corresponding to the page to be printed on the second side (back side). As the operation for this purpose, the CPU 205 controls this printing apparatus to execute image processing for shifting the printing position of the image to be printed on the first side of the sheet.

In other words, the printing processing on the second side is executed without shifting the printing position of the image to be printed on the second side of the sheet. For example, the printing processing on the second side of the sheet is executed under the same printing conditions (e.g., at the same printing position) as that executed in step S1404.

As a display key that allows the user to input an instruction for making this printing apparatus execute such operation, the CPU 205 displays the key 1501 on the display unit 401. A method of utilizing the key 1501 will be described below using FIG. 30.

Figure 30:
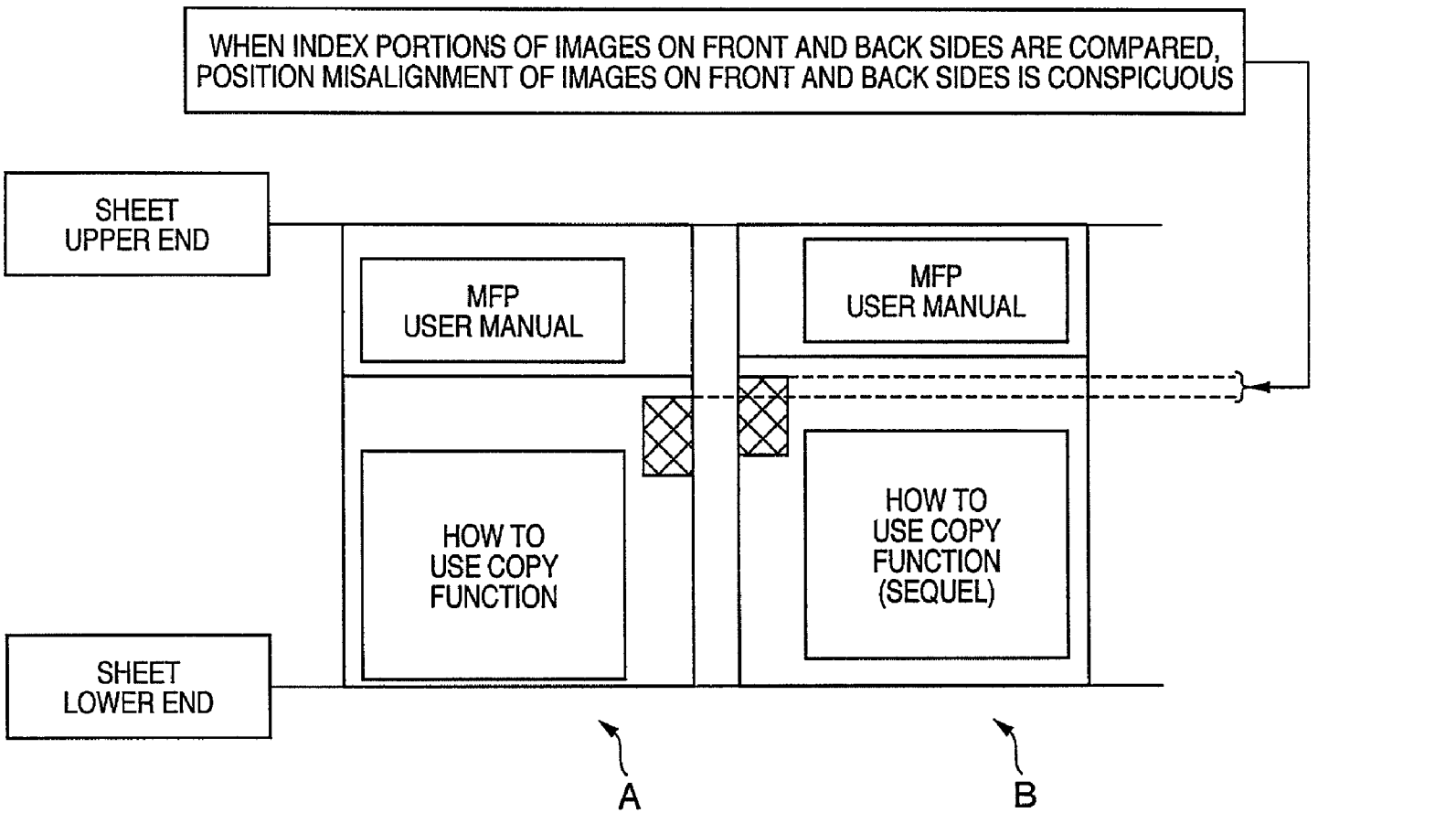
FIG. 30 is a view for explaining a control example according to the embodiment of the present invention.

For example, the CPU 205 executes steps S1404 and S1405 in FIG. 14 for the job to be double-sided printed which is shown in FIG. 12 and includes print data for 2N pages that require the position alignment operation of images on the front and back sides. In other words, the CPU 205 controls the printer unit 203 to print data of the first page of the job on the first side of the sheet, and to print data of the second page of that job on the second side of the sheet. FIG. 30 shows an example of the printing result which is output from the printer unit 203 by the processes in steps S1404 and S1405.

A of FIG. 30 indicates the printing result on the front side of one printing sheet. B of FIG. 30 indicates the printing result on the back side of the printing sheet. That is, the example of FIG. 30 corresponds to the printing result of the double-sided printing processing which is executed by the printer unit 203 and in which the printing position of the image of the first page of the job in FIG. 12 on the first side of the sheet is shifted downward from that of the image of the second page of that job on the second side of the sheet. In other words, the example of FIG. 30 corresponds to the printing result of the double-sided printing processing which is executed by the printer unit 203 and in which the printing position of the image on the second page of the job in FIG. 12 on the second side of the sheet is shifted upward from that of the image of the first page of the job on the first side of the sheet.

The example of FIG. 30 is obtained by printing data used as the manual of a product, as shown in FIG. 12, and corresponds to document data generated so that an index image is laid out on the sheet right end portion when the sheet is viewed from the erected state. When print data in which the image is laid out on the sheet end portion in this manner is printed in the double-sided printing mode, if the positions of the images are misaligned, the printing result in which the position misalignment of the images is continuous is obtained, as shown in FIG. 30.

Figure 32:
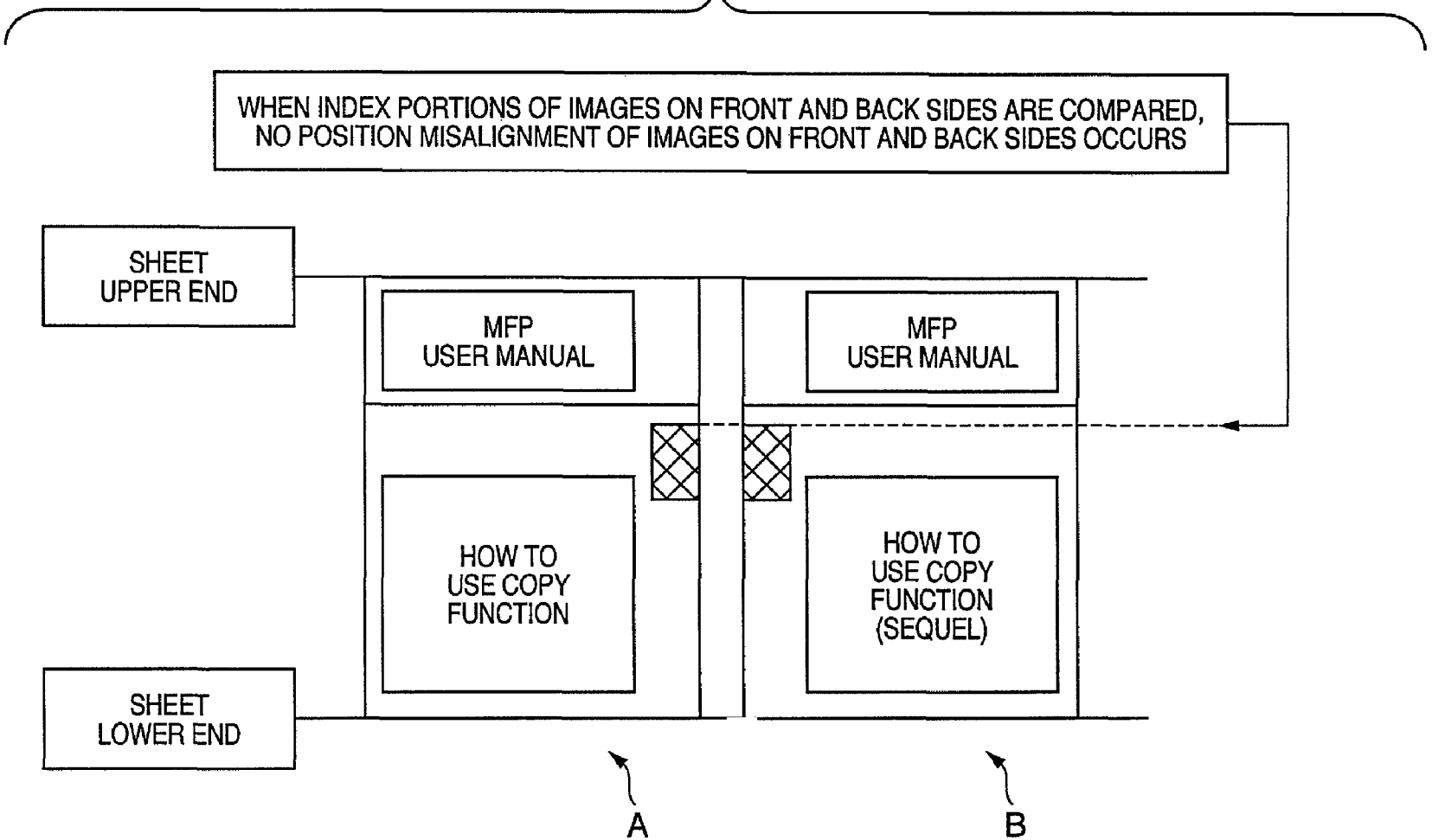
FIG. 32 is a view for explaining a control example according to the embodiment of the present invention.

In this embodiment, in steps S1406 and S1407 of FIG. 14, the control prompts the operator of the printing apparatus to confirm this printing result in practice. For example, the control prompts the operator to pick up the output sheet which has the printing result, as shown in, e.g., FIG. 30, from the tray 324. Then, the control prompts the operator to visually confirm the printing positional relationship of the images on the front and back sides. Assume that the operator who confirmed the printing result of FIG. 30 determines that the image on the first side (the image on the front side) of the sheet is shifted downward from the image on the second side (the image on the back side) of the sheet in the result. Also, assume that the operator wants upon observation of this result to execute the two-sided printing processing to align the printing position of the image on the first side (the image on the front side) of the sheet to that of the image on the second side (the image on the back side) of the sheet. In such situation, the user presses the key 1501 on the window of FIG. 15 at the timing of step S1407. Upon depression of the key 1501 by the user, the CPU 205 controls the printer unit 203 to execute the double-sided printing processing of the job shown in FIG. 12 so that the printing position of the page to be printed on the first side is aligned to that of the page to be printed on the second side. In this way, the double-sided printing result free from any position misalignment of the images on the front and back sides can be obtained, as shown in FIG. 32. The operator of this printing apparatus utilizes the key 1501 as an operation instruction key for obtaining the aforementioned effect.

On the other hand, assume that the user presses a key 1502 (to be referred to as a back side selector key in this example). In this case, the CPU 205 controls the printer unit 203 to execute the double-sided printing processing in which the printing position of print data, which belongs to data of the job to be double-sided printed that requires the position alignment of images on the front and back sides, and corresponds to the page to be printed on the second surface of the sheet, with respect to the second side of the sheet.

In this example, the printing position of the image corresponding to the page to be printed on the second side (back side) of the sheet on the second side of the sheet is aligned to that of the image corresponding to the page to be printed on the first side (front side) on the first side of the sheet. As an operation for this purpose, the CPU 205 controls this printing apparatus to execute image processing for shifting the printing position of the image to be printed on the second side of the sheet.

In this case, the CPU 205 controls to execute printing processing on the first side without shifting the printing position of the image of the page to be printed on the first side of the sheet on the first side. For example, upon executing the printing processing on the first side of the sheet, the CPU 205 controls the printer unit 203 to execute the printing processing on the first side of the sheet under the same printing conditions (e.g., at the same printing position) as that executed in step S1405.

As a display that allows the user to input an instruction that controls this printing apparatus to execute a series of operations mentioned above, the CPU 205 controls the display unit 401 to display the key 1502. A method of utilizing the key 1502 will be described using FIG. 31.

Figure 31:
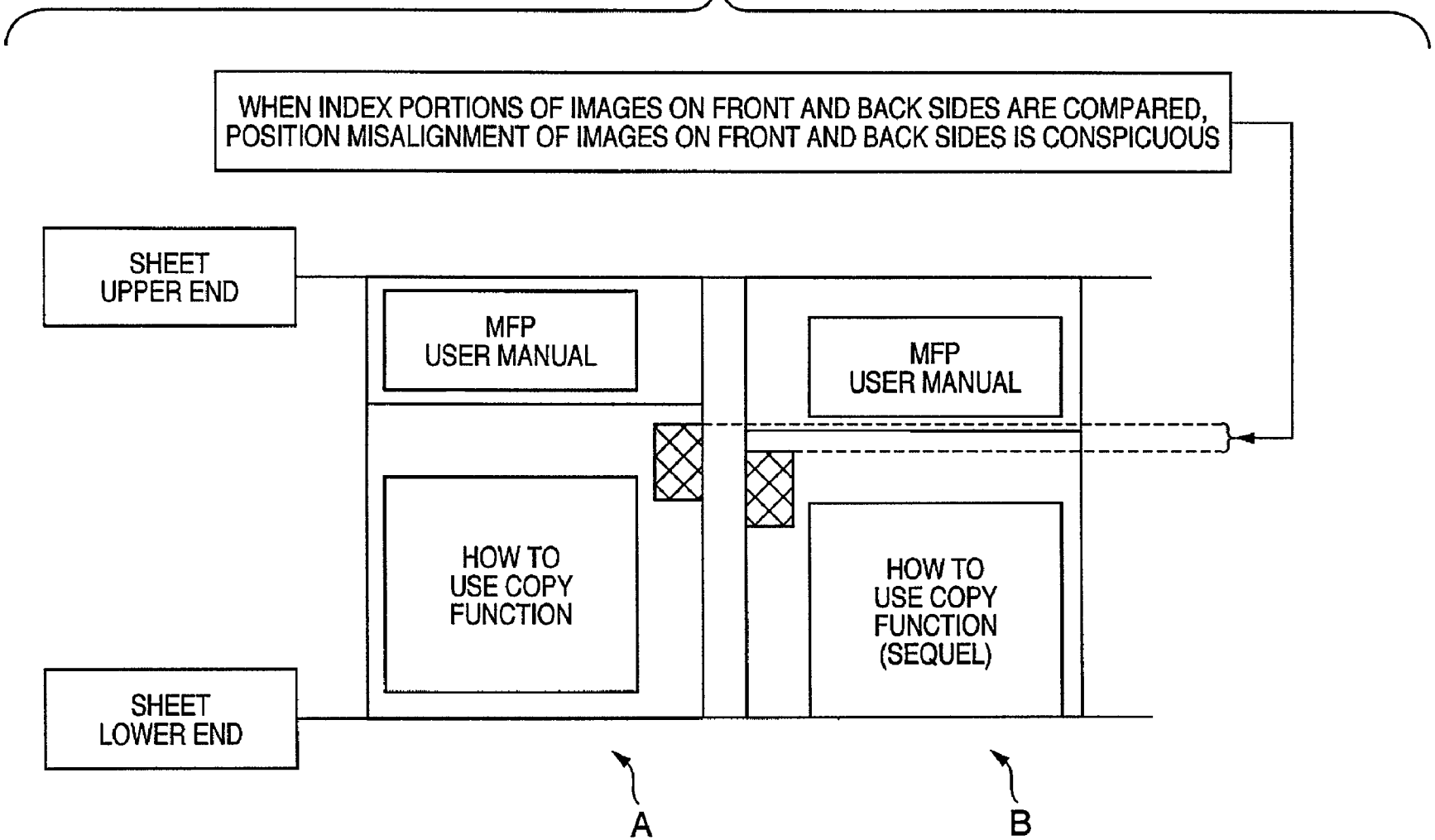
FIG. 31 is a view for explaining a control example according to the embodiment of the present invention.

For example, the CPU 205 executes steps S1404 and S1405 in FIG. 14 for the job to be double-sided printed which is shown in FIG. 12 and includes print data for 2N pages that require the position alignment operation of images on the front and back sides. In other words, the CPU 205 controls the printer unit 203 to print data of the first page of the job on the first side of the sheet, and to print data of the second page of that job on the second side of the sheet. FIG. 31 shows an example of the printing result which is output from the printer unit 203 by the processes in steps S1404 and S1405.

A of FIG. 31 indicates the printing result on the front side of one printing sheet. B of FIG. 31 indicates the printing result on the back side of the printing sheet. That is, the example of FIG. 31 corresponds to the printing result of the double-sided printing processing which is executed by the printer unit 203 and in which the printing position of the image of the second page of the job in FIG. 12 on the second side of the sheet is shifted downward from that of the image of the first page of that job on the first side of the sheet. In other words, the example of FIG. 31 corresponds to the printing result of the double-sided printing processing which is executed by the printer unit 203 and in which the printing position of the image on the first page of the job in FIG. 12 on the first side of the sheet is shifted upward from that of the image of the second page of the job on the second side of the sheet.

The example of FIG. 31 is also obtained by printing data used as the manual of a product, as shown in FIG. 12, and corresponds to document data generated so that an index image is laid out on the sheet right end portion when the sheet is viewed from the erected state. When print data in which the image is laid out on the sheet end portion in this manner is printed in the double-sided printing mode, if the positions of the images are misaligned, the printing result in which the position misalignment of the images are continuous is obtained, as shown in FIG. 31.

In this embodiment, in steps S1406 and S1407 of FIG. 14, the control prompts the operator of the printing apparatus to confirm this printing result in practice. For example, the control prompts the operator to pick up the output sheet which has the printing result, as shown in, e.g., FIG. 31, from the tray 324. Then, the control prompts the operator to visually confirm the printing positional relationship of the images on the front and back sides.

Assume that the operator who confirmed the printing result of FIG. 31 determines that the image on the second side (the image on the back side) of the sheet is shifted downward from the image on the first side (the image on the front side) of the sheet in the result. Also, assume that the operator wants upon observation of this result to execute the two-sided printing processing to align the printing position of the image on the second side (the image on the back side) of the sheet to that of the image on the first side (the image on the front side) of the sheet. To cope with such situation, this embodiment allows the user to press the key 1502 on the window of FIG. 15 at the timing of step S1407.

Assume that the user then presses the key 1502. In this case, the CPU 205 controls the printer unit 203 to execute the double-sided printing processing of the job shown in FIG. 12 so that the printing position of the page to be printed on the second side is aligned to that of the page to be printed on the first side. In this way, the double-sided printing result free from any position misalignment of the images on the front and back sides can be obtained, as shown in FIG. 32. The operator of this printing apparatus also utilizes the key 1502 as an operation instruction key for obtaining the aforementioned effect.

Note that the CPU 205 controls so that the instructions by the keys 1501 and 1502 have an exclusive relationship. For example, when the user presses one of these keys, the CPU 205 controls the display unit 401 to display the other key in a gray-out or hatched state. More specifically, the CPU 205 inhibits the user from selecting the other key.

In this way, the CPU 205 performs display control of the display unit 401, so that the user cannot select both the keys 1501 and 1502 at the same time. When a user instruction is input by the key 1501, the CPU 205 disables the user instruction from the key 1502. When a user instruction is input by the key 1502, the CPU 205 disables the user instruction from the key 1501.

The CPU 205 also allows to accept an instruction from keys 1503 (to be referred to as shift direction keys in this example) from the user in addition to those from the keys 1501 and 1502 as an instruction that can be accepted from the user via the window shown in FIG. 15. For example, depending on one of the keys 1501 and 1502 selected by the user, the CPU 205 specifies which of images on the first (front) and second (back) sides is to be shifted.

After that, the user is allowed to determine the shift direction of the image to be printed on the side whose printing position is to be shifted via the user interface unit upon printing. For example, the CPU 205 controls the display unit 401 to display shift direction keys 1503 as a display that allows the user himself or herself to select a desired one of a plurality of selection candidates corresponding to directions that allow image shifts.

In this example, the CPU 205 controls the display unit 401 to present four, i.e., up, down, right, and left selection candidates to the user, as indicated by the keys 1503 on the window of FIG. 15, and to allow the user to designate desired one of these candidates. Note that these four direction keys may be controlled to have an exclusive relationship. For example, when one of these direction keys is selected, the CPU 205 controls to disable user's instructions from other direction keys. Alternatively, in order to allow to shift an image in not only one of four, i.e., up, down, right, and left directions but also an oblique direction, these four direction keys are not controlled to have any exclusive relationship, but at least two direction keys may be controlled to be operated by the user.

For example, when printing processing that shifts an image in the upper right direction on the printing side of a sheet is to be executed, the user can select the up and right direction keys. When the user wants to shift an image in the lower left direction, he or she can select the left and down direction keys. In this way, a move instruction in the oblique direction by combining the up or down key and the right or left key may be controlled to be accepted, thus making the operability more satisfactory.

Furthermore, the CPU 205 controls to accept an instruction from fields 1504 (to be referred to as shift amount fields in this example) in addition to the instructions from the keys 1501 to 1503, as those which can be accepted from the user via the window of FIG. 15. For example, the CPU 205 specifies an image on which of the first (front) and second (back) sides is to be shifted depending on whether the user selects the key 1501 or 1502. In addition, the CPU 205 specifies the shift direction of the image on the specified side on the printing side on the basis of a user's instruction from one of the shift direction keys 1503.

Then, the control allows the user to determine the shift amount of the image to be shifted on the printing side of the sheet via the user interface unit. In other words, the user can set the shift amount of the image to be printed on the printing side designated by the user via one of the keys 1501 and 1502 of one of the first and second sides of the sheet in the shift direction designated by the user via one of the keys 1503. For example, the CPU 205 controls the display unit 401 to display shift amount setting fields 1504 that allow the user to input the shift amount. In this example, the CPU 205 controls the operation unit 204 to accept an input in increments of 1 mm from the user by the numeric keypad 506 as the shift amount.

Note that the shift amount setting fields 1504 include two fields, i.e., an up/down shift amount setting field and a right/left shift amount setting field. The up/down shift amount setting field allows the user to designate the up shift amount when he or she designates the up direction using the key 1503 or to designate the down shift amount when he or she designates the down direction using the key 1503. The right/left shift amount setting field allows the user to designate the left shift amount when he or she designates the left direction using the key 1503 or to designate the right shift amount when he or she designates the right direction using the key 1503.

Control examples of the operations to be executed by this printing apparatus under the control of the CPU 205 as the operation based on the user's instructions input via the keys 1501 to 1504 will be described below.

The first control example will be explained first using the printing result of FIG. 30. For example, the CPU 205 controls the printer unit 203 to execute double-sided printing processing that prints the first page of the job in FIG. 12 on the first side and prints the second page on the second side of the sheet via steps S1404 and S1405 in FIG. 14. As a result of this processing, assume that the double-sided printing result shown in FIG. 30 is obtained. Assume that in the example of FIG. 30, the printing position of the image on the first side, i.e., the front side of the sheet is shifted downward by 4 mm from that of the image on the second side, i.e., the back side of the sheet.

The CPU 205 controls the display unit 401 to display the window of FIG. 15 in step S1407 immediately after it controls the printer unit 203 to execute the double-sided printing processing. Assume that after the user confirms the double-sided printing result in which the image printed on the first side of the sheet is shifted downward from that printed on the second side of the sheet, as shown in FIG. 30, the user inputs the following instructions via the window shown in FIG. 15.

For example, assume that the user inputs an "align the position of an image on the front side to that of an image on the back side" instruction via the key 1501 of the keys 1501 and 1502. Also, assume that the user designates "up" as the shift direction via one of the keys 1503. Furthermore, assume that the user inputs "4 mm" as the shift amount in the up/down shift amount setting field of the shift amount setting fields 1504. That is, assume that the user inputs a series of instructions via the window shown in FIG. 15.

In this case, upon printing a page corresponding to the page (2N−1) to be printed on the first side of each sheet in the double-sided printing processing of that job, the CPU 205 controls the printer unit 203 to execute printing processing that locates the image at a position shifted upward by 4 mm from a prescribed value.

Note that the prescribed value mean a reference value which is set at this time and is associated with engine-system parameters inside the printer required to adjust the printing position of an image on a sheet. In other words, for example, the prescribed value means a printing processing condition parameter used when the printer unit 203 executed printing processing on the first side of the sheet in the processing in step S1405.

The CPU 205 controls the printer unit 203 to execute printing processing which undergoes adjustment of the printing position of the image upon printing of data of the job on the first side. In this example, all pages (first, third, . . . , m-th, . . . , (2n−1)-th pages) corresponding to odd pages of the job including a plurality of pages shown in FIG. 12 become objects to be controlled. In addition, the CPU 205 controls the printer unit 203 to execute the prescribed printing processing without any adjustment upon printing a page corresponding to the page (2N) to be printed on the second side of each sheet on the second side of that sheet.

In other words, the CPU 205 controls the printer unit 203 to execute printing processing on the second side without executing the printing processing that shifts an image upward by 4 mm from the prescribed value. That is, the CPU 205 controls to execute printing processing on the second side of the job under the same printing processing conditions as those of the processing executed in step S1404. More specifically, the CPU 205 controls the printing apparatus to execute printing processing of the job so as to always shift an image upward by 4 mm upon printing a page corresponding to the page (2N−1) of the job of FIG. 12 on the first side from that printed upon printing a page corresponding to the page (2N) on the second side of each sheet.

By executing the aforementioned control, the printing result which is free from any position misalignment of images on the front and back sides, as shown in FIG. 32, and can be adopted as an article in the POD environment, i.e., a print product, can be obtained based on the printing result shown in FIG. 30.

The second control example will be described below using the printing result shown in FIG. 31. For example, the CPU 205 controls the printer unit 203 to execute double-sided printing processing that prints the first page of the job in FIG. 12 on the first side and prints the second page on the second side of the sheet via steps S1404 and S1405 in FIG. 14. As a result of this processing, assume that the double-sided printing result shown in FIG. 31 is obtained. Assume that in the example of FIG. 31, as the double-sided printing result, the printing position of the image on the second side, i.e., the back side of the sheet is shifted downward by 2 mm from that of the image on the first side, i.e., the front side of the sheet.

The CPU 205 controls the display unit 401 to display the window of FIG. 15 in step S1407 immediately after it controls the printer unit 203 to execute the double-sided printing processing. Assume that after the user confirms the double-sided printing result in which the image printed on the second side of the sheet is shifted downward from that printed on the first side of the sheet, as shown in FIG. 31, the user inputs the following instructions via the window shown in FIG. 15.

For example, assume that the user inputs an "Align the position of an image on the back side to that of an image on the front side" instruction via the key 1502 of the keys 1501 and 1502. Also, assume that the user designates "up" as the shift direction via one of the keys 1503. Furthermore, assume that the user inputs "2 mm" as the shift amount in the up/down shift amount setting field of the shift amount setting fields 1504. That is, assume that the user inputs a series of instructions via the window shown in FIG. 15.

In this case, upon printing a page corresponding to the page (2N) to be printed on the second side of each sheet on the second side of the sheet in the double-sided printing processing of that job, the CPU 205 controls the printer unit 203 to execute printing processing that locates the image at a position shifted upward by 2 mm from the prescribed value. In other words, the CPU 205 controls the printer unit 203 to execute printing processing that shifts the image upward by 2 mm from the printing position of the image on the second side upon printing on the second side of the sheet in the processing in step S1404.

The CPU 205 controls the printer unit 203 to execute printing processing which undergoes such adjustment of the printing position of the image upon printing of data of the job on the second side. In this example, all pages (second, fourth, . . . , 2n-th pages) corresponding to even pages of the job including a plurality of pages shown in FIG. 12 become objects to be controlled. In addition, the CPU 205 controls the printer unit 203 to execute the prescribed printing processing without any adjustment upon printing a page corresponding to the page (2N−1) to be printed on the first side of each sheet on the first side of that sheet in the double-side printing processing of the job in FIG. 12.

In other words, the CPU 205 controls the printer unit 203 to execute printing processing on the first side without executing the printing processing that shifts an image upward by 2 mm from the prescribed value. That is, the CPU 205 controls to execute printing processing on the first side of the job under the same printing processing conditions as those of the processing executed in step S1405. More specifically, the CPU 205 controls the printing apparatus to execute printing processing of the image on the page (2N) so as to always shift an image upward by 2 mm upon printing a page corresponding to the page (2N) of the job of FIG. 12 on the second side of the sheet from that printed upon printing a page corresponding to the page (2N−1) of the job on the first side of each sheet.

In this way, the CPU 205 controls this printing apparatus to execute double-sided printing processing that requires image shift upon printing on the second side of the first and second sides for the job. The CPU 205 executes the aforementioned control. With this control, the printing result which is suppressed any position misalignment of images on the front and back sides, as shown in FIG. 32, and can adopted as an article in the POD environment, i.e., a print product, can be obtained based on the printing result shown in FIG. 31.

Upon executing either the first control example using FIG. 30 or the second control example using FIG. 31, print data of a job to be double-sided printed that requires position alignment of images on the front and back sides are stored in a memory unit of this system.

For example, the CPU 205 stores print data for all pages of a job to be double-sided printed that requires position alignment of images on the front and back sides in the HDD 209 of this printing apparatus. In addition, the CPU 205 controls the printing apparatus to execute the operations of the first or second control example using the print data of the job already stored in the HDD 209. In this example, the CPU 205 controls the printer unit 203 to execute double-sided printing processing that reflects printing position adjustment of an image using the print data of the job shown in FIG. 12, i.e., data for all pages of which have already been stored in the HDD 209 by the processing in step S1403 in FIG. 14.

As described above, the CPU 205 controls to execute double-sided printing processing of the first and second pages of the job to be double-sided printed that requires printing position adjustment of images on the front and back sides in steps S1404 and S1405. After the user confirms the printing result, the CPU 205 can accept various instructions associated with adjustment of the printing position in the double-sided printing processing of that job via the window shown in FIG. 15. Also, the CPU 205 controls the printer unit 203 to execute double-sided printing processing that undergoes image printing position adjustment according to the instructions from the user accepted via the window shown in FIG. 15 in the double-sided printing operation of the job.

In this way, in this example, after actual data of a job to be double-sided printed are printed on the two sides, the positions of the images on the front and back sides of the job can be adjusted. In this way, not only the problems assumed in the prior art can be merely solved, but also the effect of obtaining double-sided printing result with higher precision, and the like can be provided.

In this example, the CPU 205 controls to execute double-sided printing processing of data of the first and second pages of the job to be double-sided printed that requires printing position adjustment of images on the front and back sides, and then allows to accept instructions associated with position alignment of images on the front and back sides of the job from the user via the display of FIG. 15 on the display unit 401. Therefore, if position alignment of images on the front and back sides of the job is to be executed, it is more convenient that the double-sided printing processing of that job is redone from the beginning based on the adjustment instructions.

Hence, this embodiment controls to accept, via the user interface unit, an instruction from the user to execute the double-sided printing processing of the job again from the first page while the instructions associated with the printing position adjustment of images accepted from the user are reflected. For example, the CPU 205 controls the display unit 401 to make a display that allows to accept from the user an instruction to re-execute the double-sided printing processing of that job from the first page while reflecting various instructions input via the keys 1501 to 1504. This is a key 1505 (to be referred to as a redo setting key in this example).

For example, the CPU 205 controls this printing apparatus to execute the operations of the first control example described using FIG. 30 or the second control example described using FIG. 31 upon depression of the key 1505 on the window of FIG. 15 by the user. In addition, the CPU 205 controls to execute these operations in double-sided printing processing of the job (FIG. 12) to be double-sided printed that requires printing position alignment of images on the front and back sides.

Note that, in this example, the first and second pages of the job shown in FIG. 12 has already been undergone the double-sided printing processing in steps S1404 and S1405. However, this double-sided printing processing is specific one having a special meaning. That is, this double-sided printing processing is also executed to allow the user to visually confirm beforehand the positional relationship of images on the front and back sides in practice. In this example, as this specific double-sided printing processing, the CPU 205 controls the printer unit 203 to execute double-sided printing processing for two pages, i.e., the first and second pages of the job itself to be double-sided printed that requires position alignment processing of images on the front and back sides. In addition, the CPU 205 controls the printer unit 203 to execute the specific double-sided printing processing before the adjustment instructions are accepted from the user via the window in FIG. 15.

Therefore, in this example, upon depression of the key 1505 in FIG. 15, the CPU 205 controls the printer unit 203 to execute double-sided printing processing for all pages of the job in FIG. 12, which include the first and second pages of the job in FIG. 12 that have already been printed in steps S1404 and S1405. Also, when the CPU 205 causes the printer unit 203 to perform double-sided printing of all pages, the CPU 205 controls the printer unit 203 to execute double-sided printing processing of all pages that belong to the job while executing adjustment processing of the printing positions based on the user's instructions accepted via the keys 1501 to 1504 of FIG. 15.

That is to say using the first control example of FIG. 30, the CPU 205 controls the printer unit 203 to process the job in FIG. 12 in a series of processes to be described below.

Upon printing the image of the first page of the job in FIG. 12 on the first side of the first sheet, the CPU 205 controls to print the image of the first page on the first side of the first sheet, so as to shift the image upward by 4 mm from the position when it was printed on the first side in step S1405. Also, upon printing the image of the second page of the job in FIG. 12 on the second side of the first sheet, the CPU 205 controls to print the image of the second page on the second side of the first sheet, so as to print it at the same printing position as that upon printing on the second side in step S1404 without shifting the image. Upon printing the image of the third page of the job in FIG. 12 on the first side of the second sheet, the CPU 205 controls to print the image of the third page on the first side of the second sheet, so as to shift the image upward by 4 mm from the position when it was printed on the first side in step S1405. Also, upon printing the image of the fourth page of the job in FIG. 12 on the second side of the second sheet, the CPU 205 controls to print the image of the fourth page on the second side of the second sheet, so as to print it at the same printing position as that upon printing on the second side in step S1404 without shifting the image. Upon printing the image of the fifth page of the job in FIG. 12 on the first side of the third sheet, the CPU 205 controls to print the image of the fifth page on the first side of the third sheet, so as to shift the image upward by 4 mm from the position when it was printed on the first side in step S1405. Also, upon printing the image of the sixth page of the job in FIG. 12 on the second side of the third sheet, the CPU 205 controls to print the image of the sixth page on the second side of the third sheet, so as to print it at the same printing position as that upon printing on the second side in step S1404 without shifting the image.

In this fashion, upon formally executing double-sided processing of the job in FIG. 12 which results in the printing result in FIG. 30, image shift processing is executed in printing for odd pages, while it is inhibited in printing for even pages. That is, the CPU 205 controls to repeat the image shift processing for only the first side of the first and second sides of each sheet until printing of data of the last page of the job is completed.

The CPU 205 controls this printing apparatus to execute such series of operations as those of the first control example described using FIG. 30 in response to the user's instruction from the key 1505. That is, the CPU 205 controls this printing apparatus to execute printing processing that undergoes image shift processing upon printing data of the (2N−1)-th page (odd page) of the job to be double-sided printed on the first side of each sheet.

In this example, the CPU 205 controls the printer unit 203 to execute printing processing that locates an image at a position shifted upward by 4 mm from the printing position of the image printed on the first side of the sheet in step S1405 upon printing the job onto the first side of each sheet. Also, the CPU 205 controls this printing apparatus to execute printing processing that inhibits the image shift processing upon printing data of the (2N)-th page (even page) of the job to be double-sided printed on the second side of each sheet. In this example, the CPU 205 controls the printer unit 203 to execute printing processing that locates an image at the same printing position as that of the image printed on the second side of the sheet in step S1404 upon printing the job on the second side of each sheet.

That is to say using the second control example of FIG. 31, the CPU 205 controls the printer unit 203 to process the job in FIG. 12 in a series of processes to be described below.

Upon printing the image of the second page of the job in FIG. 12 on the second side of the first sheet, the CPU 205 controls to print the image of the second page on the second side of the first sheet, so as to shift the image upward by 2 mm from the position when it was printed on the second side in step S1404. Also, upon printing the image of the first page of the job in FIG. 12 on the first side of the first sheet, the CPU 205 controls to print the image of the first page on the first side of the first sheet, so as to print it at the same printing position as that upon printing on the first side in step S1405 without shifting the image. Upon printing the image of the fourth page of the job in FIG. 12 on the second side of the second sheet, the CPU 205 controls to print the image of the fourth page on the second side of the second sheet, so as to shift the image upward by 2 mm from the position when it was printed on the second side in step S1404. Also, upon printing the image of the third page of the job in FIG. 12 on the first side of the second sheet, the CPU 205 controls to print the image of the third page on the first side of the second sheet, so as to print it at the same printing position as that upon printing on the first side in step S1405 without shifting the image. Upon printing the image of the sixth page of the job in FIG. 12 on the second side of the third sheet, the CPU 205 controls to print the image of the sixth page on the second side of the third sheet, so as to shift the image upward by 2 mm from the position when it was printed on the second side in step S1404. Also, upon printing the image of the fifth page of the job in FIG. 12 on the first side of the third sheet, the CPU 205 controls to print the image of the fifth page on the first side of the third sheet, so as to print it at the same printing position as that upon printing on the first side in step S1405 without shifting the image.

In this fashion, upon formally executing double-sided processing of the job in FIG. 12 which results in the printing result in FIG. 31, image shift processing is inhibited in printing for odd pages, while it is executed in printing for even pages. That is, the CPU 205 controls to repeat the image shift processing for only the second side of the first and second sides of each sheet until printing of data of the last page of the job is completed.

The CPU 205 controls this printing apparatus to execute such series of operations as those of the second control example described using FIG. 31 in response to the user's instruction from the key 1505. That is, the CPU 205 controls this printing apparatus to execute printing processing that undergoes image shift processing upon printing data of the (2N)-th page (even page) of the job to be double-sided printed on the second side of each sheet. In this example, the CPU 205 controls the printer unit 203 to execute printing processing that locates an image at a position shifted upward by 2 mm from the printing position of the image printed on the second side of the sheet in step S1404 upon printing the job onto the second side of each sheet. Also, the CPU 205 controls this printing apparatus to execute printing processing that inhibits the image shift processing upon printing data of the (2N−1)-th page (odd page) of the job to be double-sided printed on the first side of each sheet. In this example, the CPU 205 controls the printer unit 203 to execute printing processing that locates an image at the same printing position as that of the image printed on the first side of the sheet in step S1405 upon printing the job on the first side of each sheet.

In addition, the aforementioned position misalignment phenomenon of images on the front and back sides upon double-sided printing in the printing apparatus depends on environmental changes that pertain to external or internal factors that influence the printer engine. However, such position misalignment phenomenon of images on the front and back sides does not change periodically at very short time intervals (e.g., every seconds, every minutes, or the like). For example, the phenomenon may change when a certain time interval elapses from the last use timing of the printer unit 203 (e.g., every day or the like). Even if it does not so, the phenomenon does not change during a period as short as one job including a certain number of pages is to be processed.

Hence, in this embodiment, as one example of the schemes that improve the productivity, the image shift amount to be used upon processing one job can use common parameters. In other words, this printing apparatus is controlled to execute double-sided printing processing of a job that requires the position alignment processing of images on the front and back sides using a common shift amount without changing the image shift amount every time an image for one page of one job is printed.

As another example of the schemes that improve productivity, the CPU 205 also executes the following control.

For example, assume the user determines as a result of confirmation in step S1407 of the double-sided printing result of the first and second pages of the double-sided printing job itself designated with the alignment processing of images on the front and back sides in the processes in steps S1404 and S1405 in FIG. 14 that no position misalignment phenomenon of images on the front and back sides occurs. In other words, assume that the user determines that the print product of a final product does not pose any problems if the double-sided printing processing is executed intact. In such case, it is advisable to adopt one sheet itself that has undergone the double-sided printing processing of the first and second pages in steps S1404 and S1405 as the print product of a final product in terms of not only the productivity but also cost.

This example can cope with such use case and user needs. For example, the CPU 205 controls this printing apparatus to execute the specific double-sided printing processing that allows the user to confirm the printing position result of images on the front and back sides, as described above. Then, if the user determines that no position alignment processing of images on the front and back sides is required, the CPU 205 controls this printing apparatus to execute double-sided printing processing, in which the position alignment processing of images on the front and back sides is inhibited, from the page immediately after that printed by the specific double-sided printing processing. In addition, the CPU 205 controls the display unit 401 to make a display that allows to accept from the user an instruction which makes this printing apparatus execute this operation after the printer unit 203 executes the specific double-sided printing processing. As an example of this display, the CPU 205 controls the display unit 401 to display a key 1506 (to be referred to as a print proceeding key in this example) on the display in FIG. 15. When the user inputs the instruction via this display, the CPU 205 controls the printer unit 203 to execute double-sided printing processing, in which the position alignment processing of images on the front and back sides is inhibited, from the page immediately after that printed by the specific double-sided printing processing. This practical example will be explained below.

For example, assume that the double-sided printing processing of the first and second pages of the job shown in FIG. 12 is executed for the first and second sides of one printing sheet in steps S1404 and S1405. As a result, assume that no position misalignment of images on the front and back sides shown in FIG. 30 or 31 occurs, and a proper double-sided printing result in which images of respective sides are located at appropriate positions is obtained, as shown in FIG. 32. In this case, the user determines in step S1407 that this printing result itself can be adopted as the print product of the final product. Then, the user presses the key 1506. In this case, the CPU 205 determines to proceed with the double-sided printing processing without any image shift processing according to the user's instructions via the key 1506, and controls the printer unit 203 to execute the double-sided printing processing in FIG. 12.

In this example, as the specific double-sided printing processing, the double-sided printing processing of the first and second pages of the job itself shown in FIG. 12 is executed on the first and second sides of one printing sheet. Therefore, the CPU 205 adopts the sheet required in the specific double-sided printing processing as one sheet of the job. The CPU 205 controls to print the third page of the job in FIG. 12 on the first side of a sheet to be used as the second sheet without any image shift processing. Also, the CPU 205 controls to print the fourth page of the job in FIG. 12 on the second side of that sheet without any image shift processing. Then, the CPU 205 controls to print the fifth page of the job in FIG. 12 on the first side of a sheet to be used as the third sheet without any image shift processing. Furthermore, the CPU 205 controls to print the sixth page of the job in FIG. 12 on the second side of that sheet without any image shift processing.

In this manner, the CPU 205 controls the printer unit 203 to execute double-sided printing processing of the job from the third page to the last page (2n−1) of the job in FIG. 12. That is, the CPU 205 controls this printing apparatus to execute printing processing, in which image shift processing is inhibited, upon printing data of the (2N)-th page (even page), which follows the page processed in step S1404 of the job to be double-sided printed, on the second side of each sheet.

In this example, the CPU 205 controls the printer unit 203 to execute printing processing that locates an image at the same printing position as that of the image printed on the second side of the sheet in step S1404 upon printing the job on the second side of each sheet. The CPU 205 controls this printing apparatus to execute printing processing in which the image shift processing is inhibited upon printing data of the (2N−1)-th page (odd page) which follows the page processed in step S1405 of the job to be double-sided printed. In this example, the CPU 205 controls the printer unit 203 to execute printing processing that locates an image at the same printing position as that of the image printed on the first side of the sheet in step S1405 upon printing the job on the first side of each sheet. The CPU 205 controls this printing apparatus to execute a series of operations when a user's instruction is input via the key 1506.

In this case as well, print data of the job to be double-sided printed that requires position alignment of images on the front and back sides, which have already been stored in the HDD 209 are used. In this example, the CPU 205 controls the printer unit 203 to execute double-sided printing processing, in which the image shift processing is inhibited, using the print data of the third to last pages of the job shown in FIG. 12, data for all pages of which have already been stored in the HDD 209 by the processing in step S1403 in FIG. 14. In this way, the schemes that consider various kinds of productivities are included.

Note that a scheme that considers a case wherein the user wants to cancel the double-sided printing processing of the job for some reason as a result of execution of the processes in steps S1404 and S1405 is also included. As such example, the CPU 205 controls the display unit 401 to display a cancel key 1507 on the window of FIG. 15. When the user instructs to cancel the job via the key 1507, the CPU 205 cancels that job and returns the state of the printing apparatus to a standby state. In this case, the CPU 205 controls to erase data of all pages of that job stored in the HDD 209 in step S1403 from the HDD 209. In this way, since a scheme that considers the apparatus resources and security is adopted, convenience can be improved.

Note that items to be commonly described for all embodiments will be added. As for the aforementioned image shift method, any method may be used. For example, as will be described later, read control of image data with respect to a memory unit that stores data of a job to be processed, layout control of an image onto an image memory, and the like may be adopted. Alternatively, a method of controlling the actual printing timing in the printer unit, or the sheet feed timing from the paper feed unit may be adopted.

In this way, any method may be adopted as the image shift method in present invention. In other words, the present invention includes all configurations and methods as long as a printing result including an image on the side to be image-shifted of the first and second sides of a sheet, which is shifted in the direction to be shifted by the amount to be shifted, can be obtained via the printer unit 203. The same applies to the printing order of printing processing on the first side of a sheet and that on the second side of the sheet. That is, the present invention includes even a configuration that executes double-sided printing processing on the first and second sides in any order as long as a printing result including an image on the side to be image-shifted of the first and second sides of a sheet, which is shifted in the direction to be shifted by the amount to be shifted, can be obtained via the printer unit 203. That is, the present invention includes all configurations as long as the printing result that suffers position misalignment of images on the front and back sides shown in FIG. 30 or 31 can be corrected to the printing result that suppresses the position misalignment of images on the front and back sides as shown in FIG. 32.

The description will revert to that of the flowchart of FIG. 14. The CPU 205 checks in step S1408 if the job to be double-sided printed for which the user requests position alignment of images on the front and back sides is to be canceled. In this example, this checking processing is done based on whether or not the user presses the cancel key 1507 on the double-sided image printing position alignment detailed setting window in FIG. 15 displayed on the display unit 401 in step S1407.

If it is determined in step S1408 that the job is not to be canceled, the flow advances to step S1409. The CPU 205 checks in step S1409 if the job to be double-sided printed is a job which is required to change the image printing position. In this example, this checking processing is done based on whether or not the user presses the redo setting key 1505 on the double-sided image printing position alignment detailed setting window in FIG. 15 displayed on the display unit 401 in step S1407.

If it is determined that the job to be double-sided printed is a job which is required to change the image printing position, the flow advances from step S1409 to step S1411. If the flow advances to step S1411, the CPU 205 controls the printer unit 203 to execute double-sided printing processing including the image shift processing in the job to be double-sided printed that requires position alignment of images on the front and back sides. A practical example of the double-sided printing sequence when the flow advances to step S1411 side will be explained below.

For example, the CPU 205 controls to select an image to be printed on the specific side of the first side (front side in this example) and second side (back side in this example) of a sheet used in the job to be double-sided printed that requires position alignment of images on the front and back sides as an image to be shifted (or also moved). As this specific side, in this example, a side corresponding to the key pressed by the user of the keys 1501 and 1502 on the window in FIG. 15 displayed on the display unit 401 is adopted. For example, if the user selects the key 1501, the CPU 205 does not select an image of each page to be printed on the second side (back side in this example) of a sheet as an image to be shifted, and selects an image of each page to be printed on the first side (front side in this example) of the sheet as the image to be shifted. On the other hand, if the user selects the key 1502, the CPU 205 does not select an image of each page to be printed on the first side (front side in this example) of a sheet as an image to be shifted, and selects an image of each page to be printed on the second side (back side in this example) of the sheet as the image to be shifted.

The CPU 205 controls to shift an image of each page to be printed on the specific side of the job to be double-sided printed that requires position alignment of images on the front and back sides in a specific direction. As this specific direction, this example adopts a direction based on the user's setting executed via the shift direction setting keys 1503 on the window in FIG. 15 displayed on the display unit 401.

For example, when the user selects "up" using one of the setting keys 1503, the CPU 205 controls to print an image of each page to be printed on the side corresponding to the key of user's choice of the keys 1501 and 1502 at a printing position corresponding to a position shifted upward on that side. For example, when the user selects "down" using one of the setting keys 1503, the CPU 205 controls to print an image of each page to be printed on the side corresponding to the key of user's choice of the keys 1501 and 1502 at a printing position corresponding to a position shifted downward on that side. For example, when the user selects "left" using one of the setting keys 1503, the CPU 205 controls to print an image of each page to be printed on the side corresponding to the key of user's choice of the keys 1501 and 1502 at a printing position corresponding to a position shifted leftward on that side. For example, when the user selects "right" using one of the setting keys 1503, the CPU 205 controls to print an image of each page to be printed on the side corresponding to the key of user's choice of the keys 1501 and 1502 at a printing position corresponding to a position shifted rightward on that side.

In this example, the shift direction of user's choice can be selected from these shift directions as four selection candidates. In this example, oblique directions can also be selected as shift directions. For example, assume that the user selects two items "up" and "left" using the corresponding setting keys 1503. In this case, the CPU 205 controls to print an image of each page to be printed on the side corresponding to the key of user's choice of the keys 1501 and 1502 at a printing position corresponding to a position shifted in the upper left direction on that side. Also, for example, assume that the user selects two items "up" and "right" using the corresponding setting keys 1503. In this case, the CPU 205 controls to print an image of each page to be printed on the side corresponding to the key of user's choice of the keys 1501 and 1502 at a printing position corresponding to a position shifted in the upper right direction on that side. Furthermore, for example, assume that the user selects two items "down" and "left" using the corresponding setting keys 1503. In this case, the CPU 205 controls to print an image of each page to be printed on the side corresponding to the key of user's choice of the keys 1501 and 1502 at a printing position corresponding to a position shifted in the lower left direction on that side. In addition, for example, assume that the user selects two items "down" and "right" using the corresponding setting keys 1503. In this case, the CPU 205 controls to print an image of each page to be printed on the side corresponding to the key of user's choice of the keys 1501 and 1502 at a printing position corresponding to a position shifted in the lower right direction on that side.

Since this example adopts a specification which considers further improvement of user's convenience, a plurality of candidates of shift directions are prepared in this way. However, if at least a function that allows position alignment of images on the front and back sides is provided, this configuration need not always be adopted as a mandatory element.

The CPU 205 controls to shift an image of each page to be printed on the specific side in the job to be double-sided printed that requires position alignment of images on the front and back sides in the specific direction by a specific shift amount. As this specific shift amount, this example adopts a shift amount based on the user's setting executed via the shift amount setting fields 1504 on the window in FIG. 15 displayed on the display unit 401. For example, assume that the user selects "up" via one of the setting keys 1503 and then sets "2 mm" via the up/down shift amount setting field of the setting fields 1504. In this case, the CPU 205 controls to print an image of each page to be printed on the side corresponding to the key of user's choice of the keys 1501 and 1502 at a printing position corresponding to a position shifted upward by "2 mm" on that side. For example, assume that the user selects "down" via one of the setting keys 1503 and then sets "3 mm" via the up/down shift amount setting field of the setting fields 1504. In this case, the CPU 205 controls to print an image of each page to be printed on the side corresponding to the key of user's choice of the keys 1501 and 1502 at a printing position corresponding to a position shifted downward by "3 mm" on that side. For example, assume that the user selects "left" via one of the setting keys 1503 and then sets "4 mm" via the right/left shift amount setting field of the setting fields 1504. In this case, the CPU 205 controls to print an image of each page to be printed on the side corresponding to the key of user's choice of the keys 1501 and 1502 at a printing position corresponding to a position shifted leftward by "4 mm" on that side. For example, assume that the user selects "right" via one of the setting keys 1503 and then sets "5 mm" via the right/left shift amount setting field of the setting fields 1504. In this case, the CPU 205 controls to print an image of each page to be printed on the side corresponding to the key of user's choice of the keys 1501 and 1502 at a printing position corresponding to a position shifted rightward by "5 mm" on that side.

In this example, assume that the user selects "up" or "down" via one of the setting keys 1503. In this case, the CPU 205 allows to accept the shift amount from the user via the up/down shift amount setting field of the setting fields 1504, but disables a user's instruction from the right/left shift amount setting field of the setting fields 1504. For example, in this case, the CPU 205 ignores the right/left shift amount, i.e., sets it to be "0 mm". On the other hand, in this example, assume that the user selects "right" or "left" via one of the setting keys 1503. In this case, the CPU 205 allows to accept the shift amount from the user via the right/left shift amount setting field of the setting fields 1504, but disables a user's instruction from the up/down shift amount setting field of the setting fields 1504. For example, in this case, the CPU 205 ignores the up/down shift amount, i.e., sets it to be "0 mm". The CPU 205 controls the setting value of the shift amount that can be accepted from the user to fall within a limit value range. In this example, the CPU 205 limits the shift amount from the user to fall within a range "from 0 mm (inclusive) to 10 mm (inclusive)" in either the up/down or right/left direction. Note that the CPU 205 allows to accept a numerical value input of the shift amount from the user via the numeric keypad 506, and controls the display unit 401 to reflect the setting value in the corresponding setting field 1504.

As described above, the CPU 205 controls to accept various instructions associated with position alignment of images on the front and back sides in the job from the user via the display made on the display unit 401 for the job to be double-sided printed that requires position alignment of images on the front and back sides. Note that in the example of FIG. 15, the user has made a setting to shift an image to be printed on the second side (back side in this example) of the first side (front side in this example) and second side of each sheet by selecting the key 1502 on the window of FIG. 15. Also, in the example of FIG. 15, the user has made a setting to shift the image to be printed on that side upward by selecting the corresponding one of the setting keys 1503 on the window of FIG. 15. Furthermore, in the example of FIG. 15, the user has set "2 mm" as the shift amount of the image to be shifted in the selected direction on the selected side in the corresponding setting field 1504 on the window of FIG. 15.

In this way, the CPU 205 controls the display unit 401 to make a display that can accept user's instructions associated with position alignment of images on the front and back sides, as shown in, e.g., FIG. 15, after it controls the printer unit 203 to execute the aforementioned specific double-sided printing processing. Also, the CPU 205 controls this printing apparatus to execute position alignment processing of images according to the instructions set by the user via the display in the double-sided printing processing of the job to be double-sided printed as a job to be processed. For example, in this example, the CPU 205 controls various related units of this printing apparatus such as the HDD 209, RAM 208, printer unit 203, and the like, which are to be used upon executing the position alignment processing of images on the front and back sides, so as to control the printing apparatus to execute such processing.

A practical example of the base point of image shift used upon executing the image shift processing (image position alignment processing) in this example will be explained below. For example, when the printing position of an image is to be shifted upward by 2 mm, the CPU 205 controls to print the image at a position shifted upward by 2 mm from a reference printing position. This reference printing position is set with reference to the coordinate axes used in image printing processing on the front side in step S1405 which was executed immediately before this processing. On the other hand, when an image on the back side is to be shifted, the reference printing position is set with reference to the coordinate axes used in image printing processing on the back side in step S1404 which was executed immediately before this processing. For example, assume that the CPU 205 controls to print an image for one A4-size page on the second side to have the following layout position in the processing of step S1404 executed first. In other words, the layout position indicates the printing position of the data on a sheet when that data was printed before the image shift processing.

Assume that the printing position of upper left corner data of the image data for one page is (XA1=X0, YA1=Y0) if it is expressed by a printing position in the horizontal axis direction (which agrees with the X-axis direction and is parallel to the sheet convey direction) and a printing position in the vertical axis direction (which agrees with the Y-axis direction and is perpendicular to the sheet convey direction). Also, assume that the printing position of upper right corner data of the image data for one page is (XA2=X0+210.0 mm, YA2=Y0) if it is expressed by the printing positions in the horizontal and vertical axis directions. Furthermore, assume that the printing position of lower left corner data of the image data for one page is (XA3=X0, YA3=Y0+297.0 mm) if it is expressed by the printing positions in the horizontal and vertical axis directions. In addition, assume that the printing position of lower right corner data of the image data for one page is (XA4=X0+210.0 mm, YA4=Y0+297.0 mm) if it is expressed by the printing positions in the horizontal and vertical axis directions.

When the printer unit 203 is controlled to print such data for one A-size page by shifting it upward by 2 mm, the CPU 205 controls the printing positions of that data to have the following printing positions on the second side of each sheet.

Assume that the printing position of the upper left corner data of the data for one A4-size page is (XB1=XA1, YB1=position 2.0 mm immediately above the position of YA1) if it is expressed by the printing positions in the horizontal and vertical axis directions. Also, assume that the printing position of the upper right corner data of that data is (XB2=XA2, YB2=position 2.0 mm immediately above the position of YA2) if it is expressed by the printing positions in the horizontal and vertical axis directions. Furthermore, assume that the printing position of the lower left corner data of that data is (XB3=XA3, YB3=position 2.0 mm immediately above the position of YA3) if it is expressed by the printing positions in the horizontal and vertical axis directions. In addition, assume that the printing position of the lower right corner data of that data is (XB4=XA4, YB4=position 2.0 mm immediately above the position of YA4) if it is expressed by the printing positions in the horizontal and vertical axis directions.

The CPU 205 controls to print the data for one page on the second side to have such printing positional relationship. In practice, the image-shifted image data is generated by executing image layout processing on an image memory such as a RAM or the like, as will be described later. For example, when the image data for one A-size page is to be mapped from the HDD 209 onto an image memory such as the RAM 208 or the like, the write or read addresses of the data are controlled to have the aforementioned printing positional relationship. In this way, image data that has undergone the image shift processing is generated. By forming an image based on this image data that has undergone the image shift processing on a sheet, the printing result shown in FIG. 32 can be obtained.

As the image shift processing, image layout processing on the image memory is executed. Then, an image for one page based on the generated image data is printed on the print side of a sheet. Note that this example is one example of a data generation method for generating double-sided printing result images obtained by shifting an image on the specific side of the first and second sides of the double-sided printed sheet in the specific direction by the specific shift amount. That is, the double-sided printing result in which an image on the specific one of the front and back sides of a sheet is shifted in the specific direction by the specific shift amount may be generated by any other data generation methods as long as they fall within the gist of the present invention. That is to say using a practical example, any other data generation methods can be used as long as they can obtain the double-sided printing result shown in FIG. 32 from data of the job to be double-sided printed which results in the printing result shown in FIG. 30 or 31.

This example includes many schemes for improving user's convenience as much as possible. One example of such schemes is the operation flow upon advancing to the processing on the step S1411 side.

For example, if YES in step S1409, the CPU 205 controls to accept user's instructions associated with position alignment of images on the front and back sides for the job to be double-sided printed that requires position alignment of images on the front and back sides, as exemplified in the control example using the window of FIG. 15. In response to execution of the position alignment settings of images on the front and back sides by the user, the CPU 205 registers the instruction contents from the user in an appropriate memory such as the RAM 208, HDD 209, or the like. Note that the CPU 205 registers the user setting information associated with position alignment of images on the front and back sides in association with print data of the job to be double-sided printed as the job to be processed, which has already been stored in the HDD 209. The CPU 205 executes such processing in step S1411. Also, the CPU 205 executes the processing in step S1411 in response to depression of the key 1505 of the window of FIG. 15 by the user. Furthermore, the CPU 205 controls to return the flow to the processing in step S1404 again via that in step S1411 upon executing the processing in step S1411.

In this way, in this example, the processes in steps S1404 and S1405 are executed again by returning the flow from step S1411 to step S1404. In other words, in this example, the double-sided printing processing of data of the first and second pages of the job to be double-sided printed that requires position alignment of images on the front and back sides is executed again in steps S1404 and S1405 via the processing in step S1411. In this case, the CPU 205 controls this printing apparatus to execute position alignment processing according to the user's instructions associated with position alignment of images on the front and back sides, which are set in step S1411, in the double-sided printing processing. That is, the CPU 205 controls to execute the image shift processing based on the user's request associated with position alignment of images on the front and back sides, which is accepted via the window of FIG. 15 on the display unit 401 in the double-sided printing processing of the first and second pages of the job. For example, the user's request set via the window of FIG. 15 is as follows.

The user designates "second side (back side)" via the key 1502 on the window of FIG. 15 as the specific side to be shifted of the first and second sides as the front and back sides of a sheet on which data of the job is to be printed (to be referred to as instruction 1 hereinafter). The user designates "up" via one of the keys 1503 on the window of FIG. 15 as the specific shift direction of the image to be printed on the second side corresponding to the specific side on which the image is to be shifted (to be referred to as instruction 2 hereinafter). Also, the user designates "2 mm" via one of the fields 1504 on the window of FIG. 15 as the specific image shift amount required to shift the image on the second side corresponding to the specific side and in "up" corresponding to the specific shift direction (to be referred to as instruction 3 hereinafter).

After the user sets such instructions 1 to 3, the user instructs to restart printing of the job via the key 1505 on the window of FIG. 15. After the above instructions are accepted from the user, the CPU 205 controls this apparatus to process the double-sided printing job to be processed that requires the position alignment operation of images on the front and back sides as follows.

For example, the CPU 205 controls to feed one sheet required in that job from the paper feed unit of this printing apparatus. The CPU 205 controls to print the print data of the first and second pages of the job, the print data for all pages of which have already been stored in the HDD 209 at the stage of step S1403 previously, onto the first and second sides of the sheet fed from the paper feed unit, respectively. Upon controlling the printer unit 203 to execute printing on the two sides of the sheet, the CPU 205 inhibits execution of the image shift processing of the print data of the first page upon printing the print data of the first page on the first side of the sheet. Also, the CPU 205 controls the printer unit 203 to execute printing processing of the image of the first page of the job on the first side of the sheet without the shift processing of the image of the first page. However, upon printing the print data of the second page of the job on the second side of the sheet, the CPU 205 permits execution of the image shift processing of the print data of the second page.

That is, the CPU 205 controls the printer unit 203 to print the image of the second page that has undergone the image shift processing on the second side of the sheet after the shift processing of the image of the second page is executed. This is because the CPU 205 accepts from the user instruction 1, which indicates that the specific print side, to which the user requests to apply the image shift processing, of the first and second sides of the sheet is not the first side but the second side, via the window of FIG. 15. Also, the CPU 205 determines to shift the image upward as the shift direction of the image of the second page of the job, which is to undergo the image shift processing. This is because the CPU 205 determines this direction based on the user's request of instruction 2. In addition, the CPU 205 determines that the image shift amount is "2 mm". This is because the CPU 205 determines this shift amount based on the user's request of instruction 3.

In other words, the CPU 205 controls to execute printing processing so that the image of the second page falls within the image printing region corresponding to a position entirely shifted upward by 2 mm from the image printing region in the printing processing of the image of the second page on the second side of the sheet previously executed in step S1404. A practical method of this image shift processing may use either the method of controlling the memory read timing or the method of controlling the printing timing, as described above.

Upon completion of the aforementioned double-sided printing processing of the first and second pages of the job onto the front and back sides of one sheet, which includes the image shift processing based on instructions 1 to 3 requested by the user via the window of FIG. 15, the CPU 205 controls the flow to advance to step S1406 again. Also, the CPU 205 controls the UI unit to make the window of FIG. 15 again in the processing in step S1407. Furthermore, the CPU 205 controls to accept the user's request associated with position alignment of images on the front and back sides from the user via the window of FIG. 15 again.

Upon reception of another user's request associated with position alignment of images on the front and back sides via the window of FIG. 15, the CPU 205 controls the flow to return to step S1404 again. Also, the CPU 205 controls the printer unit 203 to execute the image shift processing according to the user's re-request associated with position alignment of images on the front and back sides in the double-sided printing processing of the first and second pages of the job. In other words, a series of control processes are designed to be executed repetitively as many times as the user wants until he or she is fully satisfied with the double-sided printing result that has undergone the position alignment processing of images on the front and back sides. Assume that the user's request associated with the image shift processing is accepted once from the user via the UI unit through S1404→S1405→S1407→YES in S1409→S1411. In response to this operation, the CPU 205 may control to automatically execute double-sided printing processing including image shift processing according to the user's request accepted via the window of FIG. 15 in step S1407 for all pages, i.e., the first to last pages of the job. In this manner, in the processing of one job, the image position alignment operation associated with the image shift processing may be executed once. With this control, productivity may be improved.

Assume that the double-sided printing processing of the first and second pages of the job is executed on the basis of the user's request associated with the image position alignment processing accepted via the window of FIG. 15. Assume that the user visually confirms this double-sided printing result, and determines that the image position alignment processing need not be particularly executed.

In other words, with the aforementioned series of control processes, the double-sided printing processing including the position alignment processing of images on the front and back sides can eliminate the position misalignment phenomenon of images on the front and back sides (to be referred to as case 1 hereinafter). Alternatively, assume that the double-sided printing processing of the first and second pages of the job is executed for the first time via the processing of the flowchart of FIG. 14 after the power supply of the printing apparatus is turned on today. Also, assume that the first double-sided printing result of today is that the user wants. In other words, no position misalignment phenomenon of images on the front and back sides occurs even when the aforementioned image position alignment processing is not executed (to be referred to as case 2 hereinafter).

In either of these cases, the CPU 205 controls to accept a "proceed with printing" instruction from the user via the key 1506 on the window of FIG. 15 displayed on the UI unit as processing for the job to be double-sided printed. However, the CPU 205 controls to execute different double-sided printing sequences in response to the user's instructions input via the key 1506 in cases 1 and 2.

This is because, in the situation of case 1, the printer unit 203 is controlled to execute the double-sided printing processing including the image shift processing based on the user's instructions associated with the image shift processing requested by the user via the window of FIG. 15. That is, the image position misalignment problem can be solved as a result of execution of this sequence. In other words, the position misalignment problem of images on the front and back sides remains unsolved unless this sequence is executed. On the other hand, in the situation of case 2, no user's request associated with the image shift processing is made via the window of FIG. 15. In other words, in this case, the printer unit 203 is controlled to execute double-sided printing processing including no image shift processing. That is, in this situation, no image position misalignment problem is posed without executing the control sequence for position alignment of images on the front and back sides.

Therefore, when the flow advances to the processing in step S1411 after the user's instruction is input via the key 1506 in the situation of case 1, the CPU 205 controls the double-sided printing job to be processed as follows.

For example, the CPU 205 controls the printer unit 203 to execute double-sided printing processing including the same image shift processing as the image shift processing as the position alignment operation of images on the front and back sides, which was executed immediately before the flow advances to the processing in step S1411 for print data of the third to last pages of the job. In other words, the CPU 205 controls to execute the double-sided printing processing of data of the third to last pages of the job under the same printing conditions as the printing processing condition parameters associated with the image printing region upon printing the print data for two pages, i.e., the first and second pages of the job on the front and back sides of one printing sheet. In addition, this image shift processing is repetitively executed by the printer unit 203 for each printing sheet (i.e., in units of print data for two pages as a pair to be printed on the front and back sides of one sheet).

This practical example will be described below. For example, this situation corresponds to a case wherein instructions 1 to 3 have already been accepted from the user via the window of FIG. 15. Also, this situation corresponds to a case wherein the user's request accepted via the window of FIG. 15 is that based on instructions 1 to 3. In case of this user's request, the CPU 205 controls the printer unit 203 to execute printing processing of an image of the first page under the printing condition "without image shift" upon printing the image of the first page of the job on the first side of the first sheet in step S1405 immediately after the processing in step S1411. In addition, the CPU 205 controls the printer unit 203 to execute print processing of an image of the second page under the printing conditions "shift the image upward by 2 mm" upon printing the image of the second page of the job on the second side of the first sheet in step S1404 immediately after the processing in step S1411. After that, this situation corresponds to a case wherein the CPU 205 accepts the user's request via the key 1506.

In such situation, the CPU 205 operates as follows in response to depression of the key 1506. The CPU 205 controls the printer unit 203 to execute print processing of an image of the third page under the printing condition "without image shift" upon printing the image of the third page of the job on the first side of the second sheet. The CPU 205 controls the printer unit 203 to execute print processing of an image of the fourth page under the printing condition "shift the image upward by 2 mm" upon printing the image of the fourth page of the job on the second side of the second sheet. In this case, the image of the first page of the first and second pages is not shifted, and that of the second page is shifted in this job.

In other words, data of the (even-number)-th page ((2n)-th page) corresponding to a page to be printed on the second side of the first and second sides of a sheet corresponds to a page on which an image that has undergone the image shift processing is to be printed. Also, data of the (odd-number)-th page ((2n−1)-th page) corresponding to a page to be printed on the first side of the first and second sides of a sheet corresponds to a page on which an image is to be printed without image shift processing. According to this rule, the CPU 205 executes double-sided processing of the third page and subsequent pages of this job. That is, the CPU 205 controls to print images of pages corresponding to the first, third, fifth, . . . , (2n−1)-th pages of the job on the first sides of the first sheet, second sheet, third sheet, . . . , last sheet on which the last page is to be printed while inhibiting the image shift processing. The CPU 205 controls to print images of pages corresponding to the second, fourth, sixth, . . . , (2n)-th page on the second sides of the first sheet, second sheet, third sheet, . . . , last sheet on which the last page is to be printed after the image shift processing is executed. Also, in this image shift processing, the CPU 205 controls the printer unit 203 to print images of pages corresponding to the print data of the (even-number)-th pages under the same printing condition "shift the image upward by 2 mm" as that of the shift processing for the second page. In this manner, in the situation of case 1, the CPU 205 controls to execute the double-sided printing processing that reflects the aforementioned position alignment processing of images on the front and back sides in step S1410.

On the other hand, in the situation of case 2, the user requests the position alignment operation of images on the front and back sides via the key 901 for this job. However, in this situation, the CPU 205 controls the printer unit 203 to execute the double-sided printing processing of the first and second pages of that job in steps S1404 and S1405, and the user determines no position misalignment of images on the front and back sides by visually observing the double-sided printing result at the stage of step S1406. That is, in this case, the image of the first page of the first and second pages of the job is not shifted, and that of the second page is not shifted, either.

In other words, data of the (even-number)-th page ((2n)-th page) corresponding to a page to be printed on the second side of the first and second sides of a sheet corresponds to a page on which an image is to be printed without image shift processing. Also, data of the (odd-number)-th page ((2n−1)-th page) corresponding to a page to be printed on the first side of the first and second sides of a sheet corresponds to a page on which an image is to be printed without image shift processing. According to this rule, the CPU 205 executes double-sided processing of the third page and subsequent pages of this job. That is, the CPU 205 controls to print images of pages corresponding to the first, third, fifth, . . . , (2n−1)-th pages of the job on the first sides of the first sheet, second sheet, third sheet, . . . , last sheet on which the last page is to be printed while inhibiting the image shift processing. The CPU 205 controls to print images of pages corresponding to the second, fourth, sixth, . . . , (2n)-th page on the second sides of the first sheet, second sheet, third sheet, . . . , last sheet on which the last page is to be printed while inhibiting the image shift processing. In this manner, in the situation of case 2, the CPU 205 controls to execute the double-sided printing processing that does not reflect the aforementioned position alignment processing of images on the front and back sides in step S1410.

As has been explained in the above control flow sequence, when the flow advances to the processing in step S1411 in FIG. 14, the CPU 205 controls the flow to return to the processing in step S1404 again. Also, the CPU 205 controls to redo processing from the printing operation of the second page of the job that requires position alignment processing of images on the front and back sides designated via the key 901 on the window of FIG. 9.

In this way, the CPU 205 controls to repetitively execute a series of processes in step S1404→S1405→S1406→S1407→YES in S1409→S1411 until it is determined in step S1409 that the image printing position is not changed. That is, the CPU 205 controls to repetitively execute these processes until the user visually confirms the double-sided printing result and the image printing positions on the front and back sides match (the user is fully satisfied with the result). However, upon re-executing the loop processing (i.e., upon re-executing step S1404 in one job), as described above, the CPU 205 makes this apparatus execute the control corresponding to the user's request associated with position alignment of images on the front and back sides, which is accepted via the window of FIG. 15 immediately before that processing in step S1404.

Figure 16:
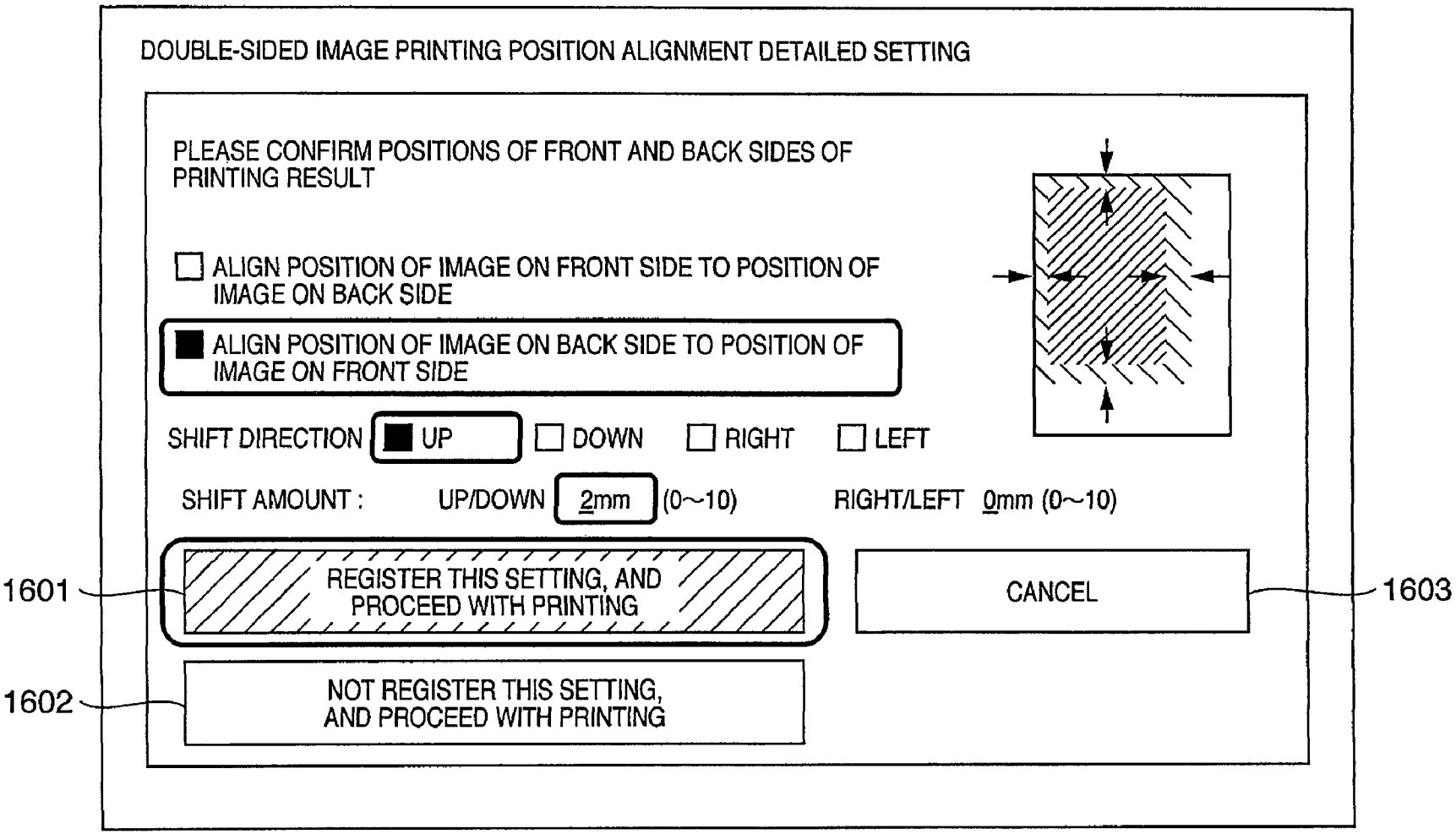
FIG. 16 is a view for explaining one example of the UI unit to be controlled by the embodiment of the present invention.

On the other hand, if it is determined in step S1409 that the image printing position is not changed, the flow advances to processing in step S1410. In this example, the CPU 205 executes the checking processing in step S1409 based on whether or not the user presses the printing proceeding key 1506 on the display (double-sided image printing position alignment detailed setting window) of FIG. 15 displayed on the UI unit in step S1407. If a user's instruction is input via the key 1506, the CPU 205 controls this printing apparatus to execute the double-sided printing sequence described in case 1 or 2 above. Note that this example comprises a scheme for further improving convenience. As an example of such scheme, before the flow advances to the processing in step S1410 to execute the double-sided printing sequence, the CPU 205 controls the UI unit to make a display, as shown in FIG. 16. FIG. 16 shows a double-sided image printing position alignment detailed setting registration window which is displayed on the UI unit under the control of the CPU 205 upon executing the processing in step S1410.

A "register this setting, and proceed with printing" key 1601 on the window of FIG. 16 is a display key used to accept from the user an instruction to proceed with the double-sided printing operation of the job to be processed based on the settings accepted from the user via the window of FIG. 15 and to register the settings in a memory.

In this example, upon depression of the key 1601, the CPU 205 controls to execute the image shift processing based on the processing conditions associated with image position alignment in the double-sided printing processing, which are accepted from the user via the keys 1501 to 1504 in FIG. 15. More specifically, as in the aforementioned control example, the CPU 205 controls to execute a series of double-sided printing operations including the image shift processing based on the settings accepted via the keys 1501 to 1504 in print processing of the job (that in FIG. 12 in this example) whose printing operation is currently stopped in step S1406. In addition, upon depression of the key 1601, the CPU 205 not only controls the printer unit 203 to execute the aforementioned operations, but also controls the HDD 209 to register the processing conditions associated with position alignment of images on the front and back sides in the double-sided printing processing, which are accepted from the user via the keys 1501 to 1504.

In other words, the key 1601 in FIG. 16 is also a display key used to accept from the user an instruction to register the double-sided printing conditions parameters that reflect the image position alignment result acquired via the processing flow immediately before the flow advances to the processing in step S1410 in FIG. 14. For example, when the user presses the key 1601, the CPU 205 controls the HDD 209 to register double-sided printing condition parameters that reflect the image position alignment result acquired via the processing flow immediately before the flow advances to the processing in step S1410 in FIG. 14.

The CPU 205 controls to use this data upon executing the double-sided printing processing of that job in accordance with the processing condition parameters associated with position alignment of images on the front and back sides. Also, even after completion of the processing of this job, the CPU 205 controls to repetitively re-use the parameters even in processing of other jobs to be double-sided printed after this job. In other words, the CPU 205 controls to commonly use the processing condition parameters in a plurality of jobs to be double-sided printed, which are processed during a certain period of, e.g., 1 hour, half a day, or the like. This is because the position misalignment phenomenon of images on the front and back sides is caused by external factors such as humidity, room temperature, and the like, which directly influence the interior of the printer, and it may change/occur at relatively long time intervals such as every other day or the like, as is assumed in the prior art.

In other words, the position misalignment phenomenon of images on the front and back sides recognized by this embodiment is unlikely to change in a situation in which a plurality of jobs are continuously processed during a certain intensive period. Therefore, in this example, the CPU 205 takes the above phenomenon into consideration and controls to allow a nonvolatile memory to hold the printing condition parameters accepted from the user via the window of FIG. 15 and allow the plurality of double-sided printing jobs to use these parameters again so as to correct the position misalignment of images on the front and back sides, as described above. With this control, the load on the user settings associated with position alignment of images is reduced as much as possible. More specifically, convenience and productivity are improved as much as possible.

A "not register this setting, and proceed with printing" key 1602 on the window of FIG. 16 is a display key used to accept from the user an instruction to proceed with the double-sided printing operation of the job to be currently processed on the basis of the settings accepted from the user via the window of FIG. 15 but not to register the settings in the memory. In this example, upon depression of the key 1602, the CPU 205 executes image shift processing based on the processing conditions associated with image position alignment in the double-sided printing processing, which are accepted from the user via the keys 1501 to 1504 of FIG. 15.

More specifically, as in the aforementioned control example, the CPU 205 controls to execute a series of double-sided printing operations including the image shift processing based on the settings accepted via the keys 1501 to 1504 in print processing of the job (that in FIG. 12 in this example) whose printing operation is currently stopped in step S1406. However, upon depression of the key 1602, the CPU 205 determines that a double-sided printing job to be processed based on the user's settings accepted via the window of FIG. 15 is only this job. In addition, the CPU 205 controls to accept new processing conditions associated with position alignment of images via the window of FIG. 15 for other subsequent double-sided printing jobs.

In other words, upon depression of the key 1602 of FIG. 16, the CPU 205 inhibits the processing conditions associated with position alignment of images on the front and back sides in the double-sided printing processing accepted from the user via the immediately previously displayed keys 1501 to 1504 of FIG. 15 from being registered in the HDD 209.

A cancel key 1603 on the window in FIG. 16 is a display key to accept from the user an instruction to cancel the above procedure. Upon depression of this key 1603, the CPU 205 cancels the processing of this job. As one example of this operation, the CPU 205 controls to erase all pages of the print data of that job (the job in FIG. 12 in this example) stored in the HDD 209 in step S1403.

As described above, when the user presses the key 1601 on the window of FIG. 16 displayed on the UI unit, the CPU 205 controls to register, in a memory, setting values associated with position adjustment of images on the front and back sides in the double-sided printing processing, which have already been accepted from the user via the window of FIG. 15. As a configuration premised on this configuration, this embodiment comprises the following configuration. For example, when a plurality of double-sided printing jobs are to be continuously processed during a period in which no position misalignment phenomenon of images on the front and back sides occurs, the CPU 205 controls to display the setting values registered in this memory as default values upon displaying the window of FIG. 15. Also, the CPU 205 controls to process these plurality of double-sided printing jobs on the basis of the setting values reflected on the window of FIG. 15 as the default values.

In this way, even when a plurality of double-sided printing jobs that require position alignment of images on the front and back sides are intensively present, they can be continuously processed while aligning the positions of images on the front and back sides. With this configuration, the user need not remember the position-adjusted values, thus simplifying the operations.

The configuration of the aforementioned printing system will be confirmed. In this configuration, as described above, the CPU 205 controls the printer unit 203 to actually execute double-sided printing processing of data of a job to be double-sided printed to which the user requests to apply the position alignment operation of images on the front and back sides via the key 901 on the window of FIG. 9 in steps S1404 and S1405 in FIG. 14. The CPU 205 prompts the user to visually confirm a print product corresponding to this double-sided printing result in practice. After that, the CPU 205 controls the UI unit to display the window of FIG. 15 as a display that can accept processing conditions associated with image position alignment based on the double-sided printing result from the user himself or herself. The CPU 205 accepts the processing conditions associated with image position alignment based on the double-sided printing result of the job from the user via the window of FIG. 15 displayed on the UI unit. When the processing conditions are accepted from the user via the window in FIG. 15, the CPU 205 controls this printing apparatus to execute image shift processing based on the processing conditions accepted from the user via the window of FIG. 15. In other words, the CPU 205 controls the printer unit 203 to execute double-sided printing processing of data of the job to be double-sided printed to which the user requests to apply position alignment of images on the front and back sides in the double-sided printing sequence including the image shift processing based on the processing conditions accepted from the user.

As described above, in this example, as information which can be used upon processing a double-sided printing job to be currently processed, the processing conditions (to be also referred to as position alignment information hereinafter) associated with position alignment of images on the front and back sides in the double-sided printing processing, which are accepted from the user via the window of FIG. 15 are utilized (to be referred to as a first utilization method hereinafter).

In this example, utilization methods of the position alignment information are available in addition to the first utilization method. As one example of such methods, the CPU 205 controls the UI unit to display the window of FIG. 16 as a display that can accept from the user an instruction to register the position alignment information set by the user via the window of FIG. 15 in the memory unit.

In this example, when the user presses the key 1601 on the window of FIG. 16, the CPU 205 controls to register the position alignment information in the double-sided printing processing set by the user via the window of FIG. 15 in the HDD 209. Also, the CPU 205 controls to utilize the position alignment information registered in the HDD 209 upon processing other double-sided printing jobs which follow the job to be currently processed (the print job including a total of 2n pages shown in FIG. 12 in this example). As one example of such control, the CPU 205 controls the printer unit 203 to execute a series of double-sided printing operations including the image shift processing based on the position alignment information registered in the HDD 209 in double-sided printing processing of other jobs to be double-sided printed that follow the job.

As described above, in this example, as information which can be utilized upon processing other jobs to be double-sided printed different from the double-sided printing job to be currently processed, the position alignment information in the double-sided printing processing set by the user via the window of FIG. 15 is utilized (to be referred to as a second utilization method hereinafter).

As described above, in this example, as the utilization method of the position alignment information of images on the front and back sides in the double-sided printing processing, which is accepted from the user via the window of FIG. 15, there are at least two utilization methods, i.e., the first and second utilization methods described above. In this example, upon depression of the key 1601 via the window of FIG. 16, this apparatus is controlled to execute both the first and second utilization methods. On the other hand, upon depression of the key 1602 in FIG. 16, this apparatus is controlled not to execute the second utilization method but to execute first utilization method.

In this example, as a specification that considers user's convenience, the CPU 205 controls the UI unit to display the window of FIG. 16 in response to depression of the key 1506 on the window of FIG. 15 by the user, which is displayed on the UI unit. Also, the CPU 205 selectively accepts from the user the two instructions via the keys 1601 and 1602 on the window of FIG. 16. Then, the CPU 205 controls this printing apparatus to execute the operation according to the accepted instruction. As one example of this control, as described above, upon depression of the key 1601, the CPU 205 controls to execute a series of double-sided printing operations including the image shift processing based on the information accepted via the user via the window of FIG. 15 in the job which corresponds to the job to be currently processed and whose printing operation is stopped in step S1406. Also, the CPU 205 registers the information in the HDD 209, and controls to execute a series of double-sided printing operations including the image shift processing based on the information registered in the HDD 209 in other double-sided printing jobs other than that job.

On the other hand, upon depression of the key 1602, the CPU 205 controls to execute a series of double-sided printing operations including the image shift processing based on the information accepted from the user via the window of FIG. 15 in the job which corresponds to the job to be currently processed and whose printing operation is stopped in step S1406. Note that this information is not utilized in subsequent double-sided printing jobs. In other words, the information is inhibited from being registered in the HDD 209. In this way, this system adopts the scheme that considers user's convenience. However, in order to simplify the configuration, the following configuration may be adopted.

For example, when the user presses the key 1506 on the window of FIG. 15 as well, the CPU 205 inhibits the UI unit from displaying the window of FIG. 16. In other words, the CPU 205 inhibits an instruction from the key 1601 or 1602 via the window of FIG. 16 from being accepted from the user. In response to depression of the key 1506, the CPU 205 controls to operate as follows. For example, the CPU 205 controls to execute a series of double-sided printing operations including the image shift processing based on the information accepted from the user via the window of FIG. 15 in the job which corresponds to the job to be currently processed and whose printing operation is stopped in step S1406.

In this way, upon depression of the key 1506, the CPU 205 may control the flow to advance to the processing in step S1410 without displaying the window of FIG. 16 by the UI unit. In this way, every modifications and applications may be made without departing from the scope of the invention as long as the problems assumed in the prior art can be solved.

The description will revert to FIG. 14. The CPU 205 controls the flow to advance to the processing in step S1410 in response to depression of either the key 1601 or 1602 by the user via the window of FIG. 16 displayed on the UI unit. When the key 1603 is pressed, the CPU 205 cancels the processing of the job, and ends the processing as described above.

In step S1410, the CPU 205 controls the printer unit 203 to execute the printing operation of the job to be currently processed in accordance with the settings of double-sided image printing position alignment accepted from the user via the keys 1501 to 1504 on the window of FIG. 15 displayed by the UI unit in step S1409. Note that the job to be currently processed is that in FIG. 12, whose printing operation is stopped in step S1406 after the double-sided printing processing for two pages, i.e., the first and second pages, is executed in the processes of steps S1404 and S1405 immediately before the processing in step S1409.

Note that this job to which the user requests to apply image position alignment via the key 901 has gone through one of the following processing flows before it reaches the processing in step S1410.

Referring to FIG. 14, one example of such flows is the processing flow: (start)→(YES) in S1401→(YES) in S1402→S1403→S1404→S1405→S1406→S1407→(NO) in S1408→(NO) in S1409→S1410. This processing flow can be executed when no position misalignment phenomenon occurs between images printed on the front and back sides of one printing sheet as a result of actual double-sided printing processing of the first and second pages of the job on one printing sheet. In other words, the processing flow can be executed when the printer unit 203 can output the double-sided printing result of user's choice without controlling the printing apparatus to execute the above position alignment operation in the current state of the printing apparatus.

Referring to FIG. 14, one example other than the aforementioned processing flow is the processing flow: (start)→(YES) in S1401→(YES) in S1402→S1403→S1404→S1405→S1406→S1407→(NO) in S1408→(YES) in S1409. In this flow, step S1411 is executed after (YES) in step S1409. In addition, in this processing flow, steps S1404, S1405, S1406, and S1407 are executed again after the processing in step S1411. Also, in this processing flow, the flow advances to step S1410 via (NO) in S1408→(NO) in S1409 after this series of processes.

This processing flow can be executed when the position misalignment phenomenon has occurred between images printed on the front and back sides of one printing sheet as a result of actual double-sided printing processing of the first and second pages of the job on one printing sheet. In other words, this processing flow can be executed when this printing apparatus must be controlled to execute the above position alignment operation upon outputting the double-sided printing result of user's choice by the printer unit 203 in the current state of the printing apparatus.

As can be seen from comparison between these two processing flows, a message indicating that the position alignment result of images on the front and back sides poses no problem in association with the double-sided printing result in steps S1404 and S1405 is accepted from the user via the UI unit independently of the processing flow to be executed. As one example of this control, in this example, the CPU 205 determines NO in step S1409 and controls the flow advances to step S1410 under the condition that the user has made a key input of either the key 1601 or 1602 on the window of FIG. 16.

More specifically, at least the double-sided printing processing of the first and second pages of the job has already been executed before the flow advances to the processing in step S1410 via either of these processing flows. In addition, this double-sided printing result of the first and second pages is the one of user's choice. In other words, this printing result is free from any position misalignment problem of images on the front and back sides.

Therefore, the pages to be printed in the printing processing in step S1410 are print data from the third page to the last page of the job. That is, in the example of the job in FIG. 12, the double-sided printing processing for the number of pages obtained by subtracting data for two pages, i.e., the first and second pages from the total number of pages (the total number of pages (2n) of the job in FIG. 12—two pages (first and second pages)=2n−1) is executed. When step S1410 is executed via the former processing flow, the double-sided printing processing is executed without executing the aforementioned image shift operation. However, when step S1410 is executed via the latter processing flow, the double-sided printing operation including image shift processing based on the position alignment information which is acquired at the timing of step S1411 immediately before step S1410 and accepted from the user via the window of FIG. 15 is executed. Note that a practical example of a series of double-sided printing operations including the shift operation has already been explained in detail in the control example using the display of FIG. 15, and a description thereof will be omitted.

As described above, in this example, the CPU 205 controls the HDD 209 and printer unit 203 to proceed with the printing operation of the remaining pages after the third page up to image data of the last page in step S1410.

The CPU 205 checks in step S1412 if print-queued jobs to be printed other than the job processed in step S1410 are stored in the HDD 209. If print-queued jobs kept stored in the HDD 209, the CPU 205 controls the flow to return from step S1412 to step S1401. If the next job is a double-sided printing job, the CPU 205 executes the same processing flow as above in the processing of FIG. 14. On the other hand, if it is determined in step S1412 that no job remains, the CPU 205 ends the processing of FIG. 14.

<Coordinate Position of Image Data on Memory>

One practical example of how to execute the image shift processing in the double-sided printing job to which the user requests to apply position alignment of images on the front and back sides will be described below using FIG. 17. As one method of executing this image shift processing, the CPU 205 executes image layout control using an image memory.

Figure 17:
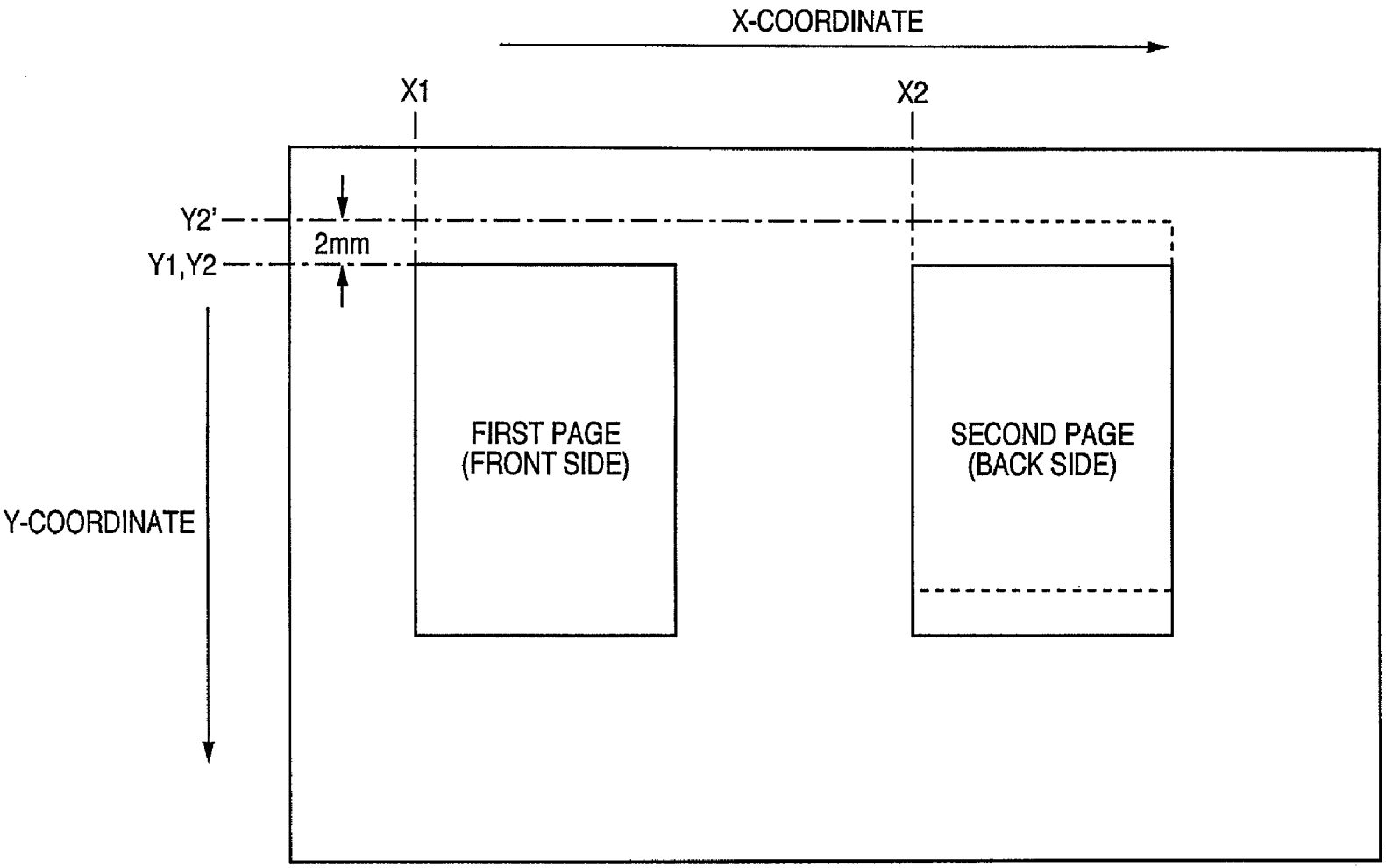
FIG. 17 is a view for explaining one example of the data processing method of a print job to be controlled by the embodiment of the present invention.

FIG. 17 shows the coordinate positions (addresses) on the RAM 208 in FIG. 2, which can store image data for at least two pages. In this example, in both the aforementioned embodiment and embodiments to be described later, the CPU 205 stores all pages of print data of a job to be processed in the HDD 209. When the image shift processing is executed as the position alignment operation of images on the front and back sides, the CPU 205 uses the RAM 208. For example, the CPU 205 controls to read out image data of the first and second pages of those of the job stored in the HDD 209 in step S1403 in FIG. 14 from the HDD 209, and to write them in an address area of the RAM 208 assigned for image printing position alignment.

Referring to FIG. 17, an X-coordinate indicates the address in a lateral direction (right/left) of the coordinate position (address) on the RAM 208, and a Y-coordinate indicates the address in a longitudinal direction (upper/lower) of the coordinate position (address) on the RAM 208. Note that the lateral direction is a direction corresponding to a horizontal direction with respect to the sheet convey direction of a printing sheet corresponding to a printing medium inside the printer, as described above. On the other hand, the longitudinal direction is a direction corresponding to a direction (vertical direction) perpendicular to the sheet convey direction.

As the X-coordinates, X1 and X2 indicate the initial start addresses in the lateral direction of the first and second pages, respectively, and as the Y-coordinates, Y1 and Y2 indicate the initial start addresses in the longitudinal direction of the first and second pages, respectively. In FIG. 17, Y1 and Y2 indicate an identical address, but they may be different addresses. Note that each initial start address corresponds to the start address in the double-sided printing operations of the first and second pages executed by the printer unit 203 before the position alignment processing of images on the front and back sides (image shift processing) is executed.

A description will be given using the example of FIG. 14. These initial start addresses correspond to the storage addresses when the CPU 205 stores image data of the first and second pages in the RAM 208 in the double-sided printing processing of the first and second pages executed by the printer unit 203 in steps S1404 and S1405 before the U1 unit displays the window in FIG. 15. In this example, the CPU 205 controls to execute the image shift processing of print data to be processed with reference to the storage addresses upon storing image data in the RAM 208 in the printing operation executed by the printer unit 203 immediately before the image shift processing.

For example, assume that at the processing timing in step S1411 of FIG. 14, the processing conditions associated with image position alignment accepted from the user via the window of FIG. 15 displayed on the UI unit under the control of the CPU 205 include setting conditions, as shown in FIG. 15. That is, assume that the CPU 205 accepts the settings that shift an image on the second side (back side) of the first side (front side) and second side (back side) of a sheet upward by 2 mm from the user via the window of FIG. 15.

The CPU 205 executes the image layout control corresponding to the image shift processing according to these settings using the RAM 208. For example, the CPU 205 moves the image of the second page to be printed on the second side (back side) of the sheet to a position shifted forward by an address count converted from 2 mm on the memory addresses which are indicated by the dotted line in FIG. 17 and start from Y2'.

In other words, when the user makes the position alignment settings, the RAM write start address of the image of the second page is set to be (X2, Y2'). Using this address as a base point, the rendering processing for one page of data of the second page is executed on the RAM 208. Upon completion of layout of the image for one page of the image data of the second page, an image based on the one-page image data rendered on the memory is formed on the second side of the sheet. The aforementioned memory control and image layout control are executed as the image shift processing. In this manner, the image of the second page after the shift processing is printed at a printing position entirely shifted upward by 2 mm from that on the second side of the image of the second page printed on the second side of the sheet before the image shift processing.

To give a practical example using FIGS. 31 and 32, the CPU 205 controls this apparatus as follows. The CPU 205 controls the printer unit 203 to output the double-sided printing result shown in FIG. 31 in steps S1404 and S1405 in FIG. 14. This processing is executed before image shift processing.

In the double-sided printing result in FIG. 31, the image on the second side of the sheet is shifted downward by 2 mm from the image on the first side. Such double-sided printing result is visually confirmed by the user in practice at the timing of step S1406. In this case, the CPU 205 controls the UI unit to display the window of FIG. 15. After that, the CPU 205 accepts the processing conditions shown in FIG. 15 as the user's settings associated with position alignment of images on the front and back sides from the user via the window of FIG. 15. The CPU 205 controls this apparatus to execute the image shift processing according to the user's settings accepted via the window of FIG. 15.

In this example, as described above, the storage address control of image data on the RAM 208 and image layout control using the RAM 208 are executed. In this example, the CPU 205 processes images of pages corresponding to even pages each of which is to be printed on the second side of a sheet as an image to be shifted on the RAM 208 like the image of the second page.

However, the CPU 205 renders images of pages corresponding to odd pages, each of which is to be printed on the first side of a sheet, on the RAM 208 without processing them as the image to be shifted. That is, the CPU 205 renders data of the image of the first page on the RAM 208 without shifting to have the same address position as that in the processing in step S1405 as a base point. After that, the image of the second page that has been rendered on the RAM 208 is printed on the second side of the sheet. Upon completion of rendering of the image of the first page onto the RAM 208, the image of the first page rendered on the RAM 208 is printed on the first side.

In this manner, as a print product which eliminates any positional misalignment of images on the front and back sides of the print product which has suffered such misalignment, as shown in FIG. 31, the double-sided printing result free from any positional misalignment of images on the front and back sides, as shown in FIG. 32, can be generated. In other words, in the print product as the printing result shown in FIG. 31, the image of the second page is printed at a printing position on the second side (back side) shifted downward by 2 mm from that on the first side (front side) of the image of the first page. In this way, a print product of the double-sided printing result that has undergone position alignment of images on the front and back sides can be generated, as shown in FIG. 32. That is, the CPU 205 lays out images on the front and second sides of the sheet, so that the printing position on the first side of the image on the first page on the first side is the same as that in FIG. 31, and the printing position on the second side of the image of the second page on the second side is set to be a position entirely shifted upward by 2 mm compared to FIG. 31.

After that, the CPU 205 controls to write image data of the fourth, sixth, . . . , (2n)-th pages corresponding to the back sides of image data of the third page and subsequent pages, which are read out from the HDD 209 at the addresses starting from the coordinate Y2' until the shift position is changed again in step S1411. In other words, the CPU 205 controls to execute the same image layout processing as that for the second page on the RAM 208 to have all image data corresponding to the (even-number)-th pages of those included in the job as image data which are to undergo the image shift processing. The CPU 205 controls to execute the same image layout processing as that for the first page on the RAM 208 to have all image data corresponding to the (even-number)-th pages of those included in the job as image data which are not to undergo the image shift processing.

The aforementioned control example is executed upon execution of the double-sided printing operations which print the image to be printed on the first side of the first and second sides of each sheet used to print the double-sided printing job without being shifted, and print the image to be printed on the second side after it is shifted. The CPU 205 controls this printing apparatus to execute a series of double-sided printing operations when it accepts from the user the execution request of position adjustment of images on the front and back sides of each sheet via the UI unit, and when it accepts from the user the execution request of shift of an image to be printed on the second side of each sheet via the UI unit.

As one example of this control, the CPU 205 accepts from the user the execution request of position adjustment via the key 901 on the window of FIG. 9 displayed by the UI unit, and also the execution request of shift of an image to be printed on the second side of each sheet via the key 1502 on the window of FIG. 15 displayed by the UI unit. In response to these user's requests, the CPU 205 controls this printing apparatus to execute the series of double-sided printing operations.

The series of double-sided printing operations including the shift processing of an image to be printed on the second side of a sheet in the double-sided printing job will be defined as double-sided printing operations of a first type.

In the present invention, the CPU 205 controls this printing apparatus to execute not only the double-sided printing operations of the first type using this image shift processing, but also double-sided printing operations including image shift processing of another type.

As one example of this control, the CPU 205 controls this printing apparatus to execute double-sided printing operations which print an image to be printed on the second side of the first and second sides of each sheet used in the double-sided printing job without being shifted, and print an image to be printed on the first side after it is shifted. A series of double-sided printing operations including shift processing of an image to be printed on the first side of each sheet in the double-sided printing job will be defined as double-sided printing operations of a second type.

The CPU 205 controls this printing apparatus to execute such series of double-sided printing operations when it accepts from the user the execution request of position adjustment via the UI unit, and when it accepts from the user the execution request of shift of an image to be printed on the first side of each sheet via the UI unit. In this example, the CPU 205 accepts from the user the execution request of position adjustment via the key 901 on the window of FIG. 9 displayed by the UI unit, and also the execution request of shift of an image to be printed on the first side of each sheet via the key 1501 on the window of FIG. 15 displayed by the UI unit. In response to these user's requests, the CPU 205 controls this printing apparatus to execute the series of double-sided printing operations of the second type.

In the double-sided printing operations of the second type including this image shift processing, for example, the CPU 205 controls to execute the following image layout control using the RAM 208 as the image shift processing.

For example, assume that the CPU 205 accepts the aforementioned execution request from the user via the key 901 on the window of FIG. 9 displayed by the UI unit, and then accepts from the user an instruction to shift the image printing position of the front side (first side) via the key 1501 on the window of FIG. 15. In this case, the CPU 205 executes address control to shift the start address of the first page indicated by the address coordinates (X1, Y1) on the RAM 208 in FIG. 17.

More specifically, the address corresponding to a coordinate position which is shifted from (X1, Y1) by a shift amount set by the user via the corresponding setting field on the window of FIG. 15 in a direction designated by the user via one of the keys 1503 on the window of FIG. 15 is set as the write start address of the image data of the first page. The CPU 205 executes such memory control for the RAM 208. In this case, only image data of the first and second pages are stored in the RAM 208 for the sake of descriptive convenience. However, if a position alignment area for three or more pages can be assured on the RAM 208, the CPU 205 may store image data of three or more pages, and may control to shift image data corresponding to the front or back side together in synchronism with each other. Upon controlling the printer unit 203 to execute printing in practice, printing is done for each page on each side of a sheet. Therefore, the configuration that simultaneously writes images for two pages on the RAM 208 is not an indispensable requisite. In other words, the image shift processing of this embodiment can be executed even when a memory that can store image data for one page is used. In this way, the memory configuration and the image shift processing method are not particularly limited. That is, the embodiment of the present invention includes every configurations as long as they can output data of the double-sided printing job which results in the double-sided printing result shown in FIG. 30 or 31 as that shown in FIG. 32.

As described above, according to the first embodiment, upon making the printing apparatus execute double-sided printing processing, the CPU 205 allows the user to press the key 901 in advance via the window of FIG. 9 displayed on the UI unit of the printing apparatus itself for a double-sided printing job to be processed.

Upon reception of the position adjustment request of images on the front and back sides from the user via the key 901, the CPU 205 controls the printing apparatus to start the double-sided printing processing of data of the job itself as the position alignment operation of images on the front and back sides of the job. After the double-sided printing operation is started, the CPU 205 controls to automatically stop the printing operation upon completion of printing for a desired number of pages. The CPU 205 prompts the user to visually confirm the double-sided printing result of a print product output by this printing operation. In this case, the CPU 205 controls the UI unit of the printing apparatus itself to display the double-sided image printing position alignment detailed setting window shown in FIG. 15. When the double-sided printing result output by the above printing operation suffers position misalignment, the CPU 205 can accept settings required to correct this position misalignment from the user himself or herself via this setting window. The CPU 205 then controls the printing apparatus to execute the double-sided printing operation for the job including the image shift processing according to the settings accepted from the user.

With the above configuration, even when the problems assumed in the prior art have occurred, they can be solved. For example, any time loss (e.g., the operator may realize occurrence of position misalignment of images in the double-sided printing result of the print product output by the printing apparatus after an elapse of a certain time period) can be eliminated. Also, the need for a series of work processes of the operator, in which he or she searches order-received data in large quantities for data corresponding to original master data of that print product due to occurrence of such phenomenon and reconfigures such data from the beginning using a PC or the like can be obviated. Especially, for example, when a print request of a double-sided printing job is received from the operator via the UI unit of the printing apparatus, the operator can easily change (especially, he or she can finely adjust) the printing position of an image to be printed on the front side (first side) or back side (second side) of a printing medium in that job via the UI unit.

In other words, there can be built a flexible and convenient printing environment which is suited to the POD environment that can assume a case wherein the contents shown in FIG. 12 are printed as an article and are delivered to customers, and which considers operability, productivity, and convenience.

Second Embodiment

The first embodiment has mainly explained the control example when data of a job to be processed is accepted from the scanner unit 201 of the printing apparatus itself, and is printed by the printer unit 203. That is, the first embodiment has mainly explained the control example when the printing execution request of a job to be processed, and a printing position alignment request of images in double-sided printing processing are accepted from the operator via the operation unit 204 of the printing apparatus itself as an example of the UI unit provided by this printing system.

However, the present invention is not particularly limited to such specific embodiment. For example, the printing apparatus may accept data of a job to be printed from an external apparatus such as the PC 103, 104, or the like in FIG. 1, which can make data communications with this printing apparatus. For example, a configuration which can accept a position alignment execution request of images on the front and back sides in a double-sided printing job from the operator of the PC 104 via a printer driver of the PC 104 in FIG. 1 in which a computer program for making this printing apparatus execute printing processing has already been downloaded will be described below. The printing system of this embodiment is configured to execute the control to be exemplified below using either computer of the client PC 104 and prepress server 103. That is, both the PCs 103 and 104 have equivalent functions and configurations. The following description will be given using the PC 104 as a representative. In other words, all the following descriptions corresponding to the client PC 104 can be replaced to those of the prepress server 103.

<Setting Window of Printer Driver>

A printer driver is used as one means for controlling a device (print device) having a printing function such as the MFP 105, 106, or the like to output proof data or a final product from a printing application on the prepress server 103 or client PC 104.

Figure 18:
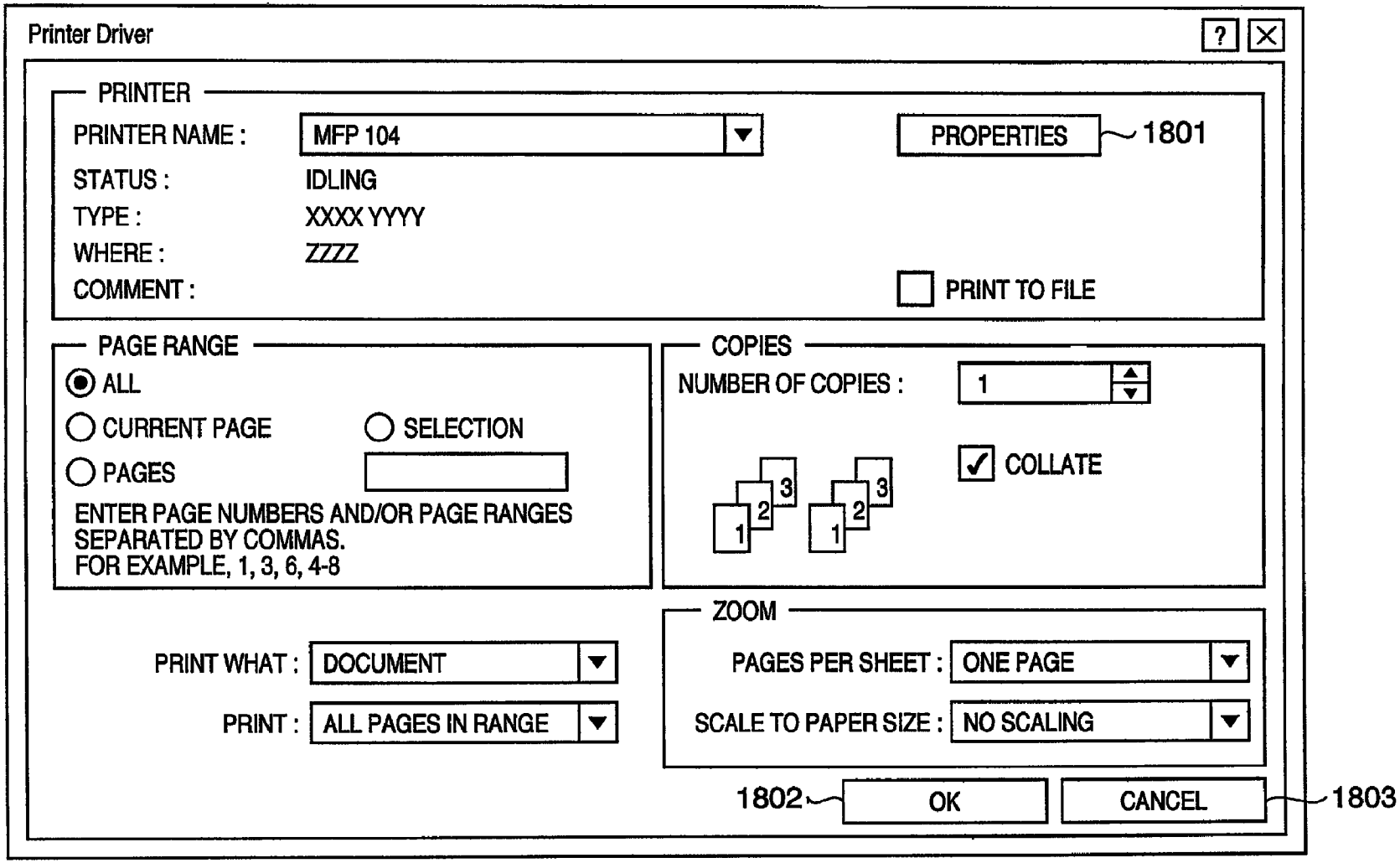
FIG. 18 is a view for explaining one example of the UI unit to be controlled by the embodiment of the present invention.

A controller (CPU) of the PC 104 controls a display unit of the PC 104 as another example of the UI unit provided by this printing system to display a printing setting window of this printing apparatus (the MFP 105, 106, or the like in FIG. 1). For example, the controller controls to display a printer driver setting window for the printing apparatus of this system, as shown in FIG. 18. The controller of the PC 104 controls the display unit of the PC 104 to display that window in response to a printer driver launch instruction of this printing apparatus by the user of the PC 104, which is input via the UI unit corresponding to an operation instruction unit such as a mouse/keyboard or the like of the PC 104. For example, the controller controls the display unit of the PC to display the printer driver setting window in response to selection of a printing menu of general application software already installed in the PC by the operator upon controlling the printing apparatus to print data to be processed.

The controller of the PC 104 executes the following display control in response to an event to specify a printing apparatus as a selection candidate by the key operation of the operator of the PC 104 via a "Printer name" pull-down list box on the window of FIG. 18, which is displayed on the display unit of the PC 104. For example, the controller controls to display the status of that printing apparatus in a "Status" field on the window of FIG. 18. Also, the controller controls to display the type of the printing apparatus (e.g., the model name of that printing apparatus) in a "Type" field on the window of FIG. 18. Furthermore, the controller controls to display installation location information of that printing apparatus in a "Where" field on the window of FIG. 18. Moreover, the controller controls to display comment information from an administrator of that printing apparatus in a "Comment" field on the window of FIG. 18. When a "Print to file" check box on the window of FIG. 18 is checked by the key operation of the operator of the PC 104, the controller of the PC 104 controls to output data which is currently selected by the operator of the PC 104 as a file without printing it by the printing apparatus. In this case, the controller prompts the operator of the PC 104 to specify a data storage location as a storage destination including a memory of the PC 104.

The controller of the PC 104 can accept from the operator of the PC 104 a setting of a desired page range from four options of the page range via radio buttons "All", "Current page", "Selection", and "Pages" which belong to a setting item "Page range" on the window of FIG. 18. When the operator selects "pages", the controller can accept the page numbers of pages to be printed of data to be printed including a plurality of pages, which are designated by the key operation of the operator of the PC 104 via an edit box located near the right side of that item.

The controller of the PC 104 can accept from the operator of the PC 104 a property of a document to be printed via a pull-down list box of a setting item "Print what" on the window of FIG. 18. Also, the controller can accept from the operator of the PC 104 a setting required to specify whether to print all pages of data to be printed including a plurality of pages or to print only odd or even pages of that data via a pull-down list box of a setting item "Print" on the window of FIG. 18.

The controller of the PC 104 accepts from the operator of the PC 104 the number of copies to be printed of data to be printed via a setting item "Copies" on the window of FIG. 18. Upon controlling the printing apparatus to execute printing for a plurality of copies, if printing is done in units of copies to be printed in place of pages, the controller accepts such instruction via a setting item "Collate" on the window of FIG. 18.

The controller of the PC 104 accepts from the user a setting of Nup printing (a function of laying out and printing data of a plurality of pages designated by the user on a single side of one sheet) via a setting item "Zoom" on the window of FIG. 18. Also, the controller accepts from the user a setting of an output paper size required in a print job via a setting item "Scale to paper size" on the window of FIG. 18.

When the user of the PC 104 clicks a "Properties" key 1801 on the window of FIG. 18, the controller of the PC 104 controls the display unit of the PC 104 to display a setting window that allows the user to set further detailed printing processing conditions.

Assume that the operator of the PC 104 has completed the settings of a series of printing processing conditions for this printing apparatus, and presses an "OK" key 1802 on the window of FIG. 18. In response to the key operation, the controller of the PC 104 sends print data of the job to be printed and the series of printing condition data from the PC 104 to the printing apparatus. In other words, the controller of the PC 104 controls this printing apparatus to execute printing processing of the print data in accordance with the printing processing conditions. Upon depression of a "Cancel" key 1803 on the window of FIG. 18, the controller ends the processing of the job, and closes the printer driver window.

Figure 19:
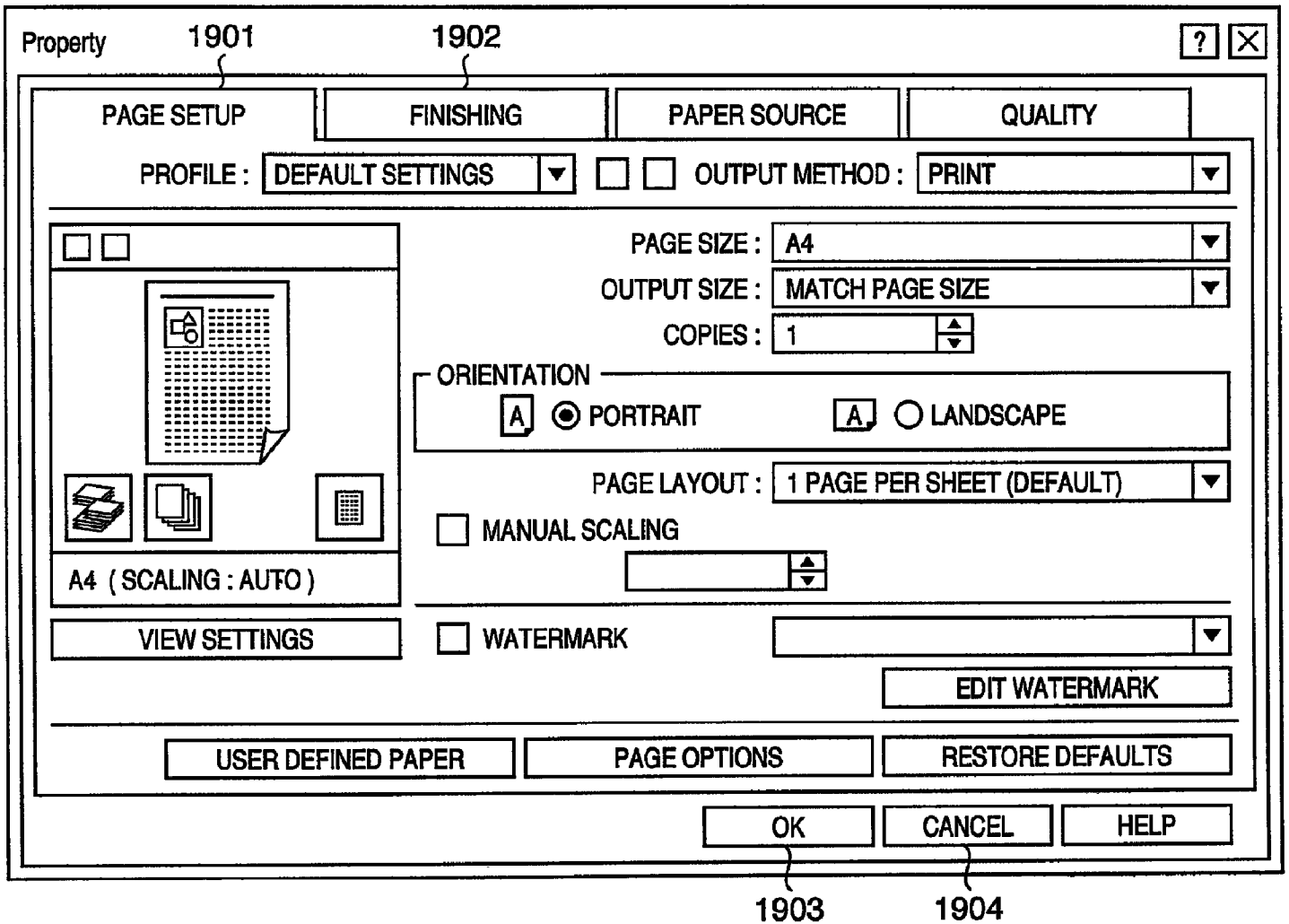
FIG. 19 is a view for explaining one example of the UI unit to be controlled by the embodiment of the present invention.

FIG. 19 shows an example of a property setting window configuration associated with page setting processing, which belongs to one of detailed printing processing condition settings of the printer driver.

When the operator of the PC 104 presses the "Properties" key 1801 on the window of FIG. 18 displayed on the display unit of the PC 104, the controller of the PC 104 controls to display a window shown in FIG. 19 on the display unit of the PC 104. This window is displayed as a default window of a plurality of detailed setting windows used to make the following advanced settings.

The controller of the PC 104 can accept various printing processing conditions to be executed in printing processing of the job to be printed via the window of FIG. 19 by the key operations from the operator of the PC 104. For example, the controller can accept, from the user, settings of various processing conditions such as a document size ("Page size")/paper size ("Output size")/page layout ("Page layout") (Nup printing function)/stamp ("Watermark")/printing scale ("Scaling")/number of copies ("Copies")/printing orientation ("Orientation"), and the like via the window of FIG. 19 to attain printing processing of data of the job to be printed.

Figure 20:
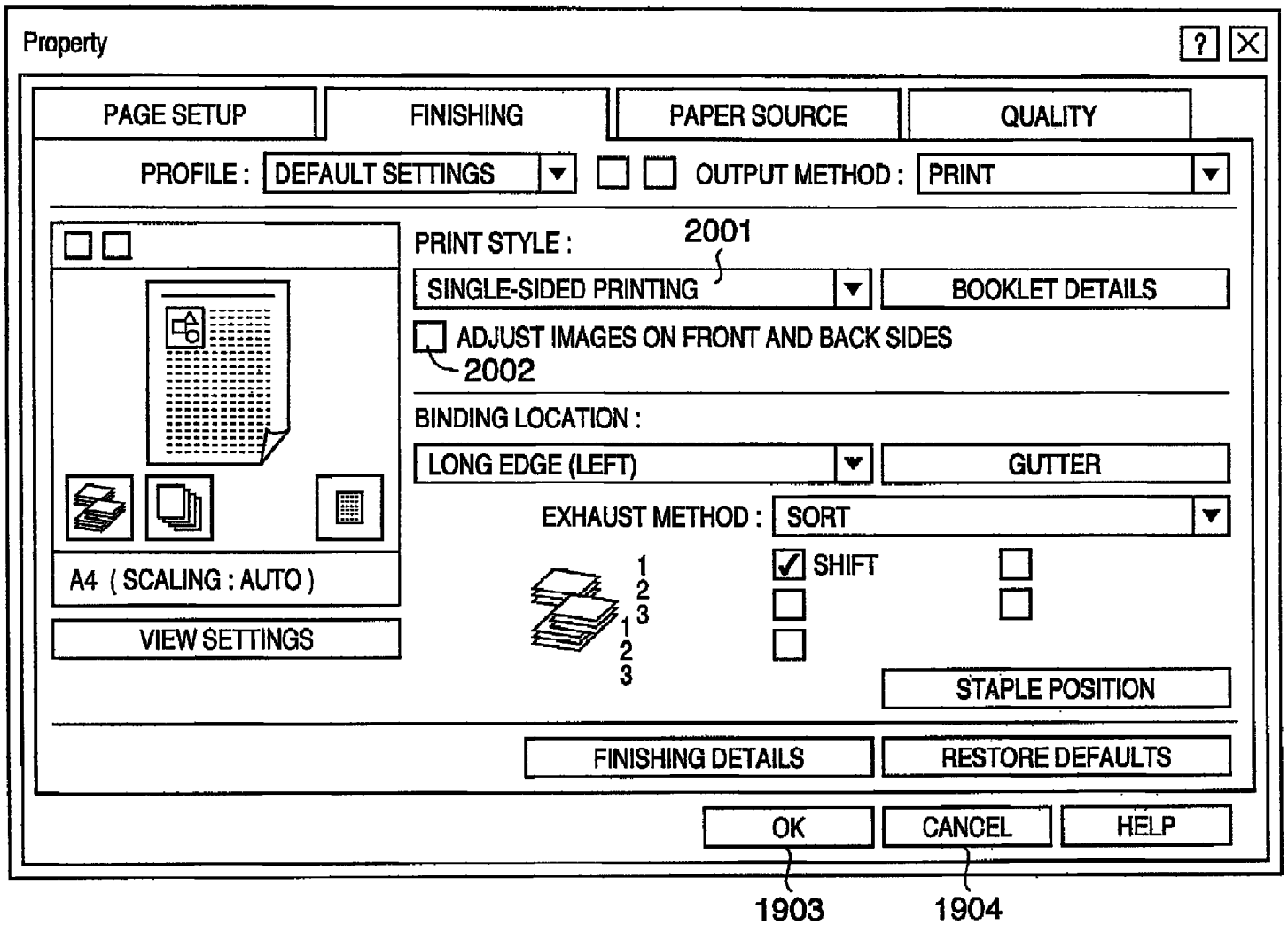
FIG. 20 is a view for explaining one example of the UI unit to be controlled by the embodiment of the present invention.

FIG. 20 shows, as an example of a window for allowing the user to set printing processing conditions, a property setting window associated with a print style (e.g., finishing processing or the like) of the data of the job to be printed, which belong to one of detailed printing processing condition settings of the printer driver. The controller of the PC 104 controls the display unit of the PC 104 to display a window shown in FIG. 20 in response to selection of a "Finishing" tab key 1902 on the window of FIG. 19 by the key operation of the operator of the PC 104.

The controller of the PC 104 accepts various printing processing conditions associated with the print style in printing processing of the job to be processed from the operator of the PC 104 via this window of FIG. 20. For example, the controller accepts from the user a printing processing condition for specifying a printing method, i.e., whether this printing apparatus executes single- or double-sided printing via a setting item "Print style" 2001 on the window of FIG. 20. For example, the controller can accept a printing condition for making the user specify a binding direction upon executing double-sided printing. Also, the controller can accept an instruction to execute various kinds of sheet processing such as staple processing, booklet processing, punch processing, and the like for the printed sheets from the user via the window of FIG. 20.

The window of FIG. 20 which is displayed on the display unit of the PC 104 under the control of the controller of the PC 104 includes a setting item "Adjust images on front and back sides" 2002. The controller can accept from the user an instruction to control the printing apparatus to execute image position alignment processing of images to be printed on the front and back sides of each sheet in double-sided printing operations by the printing apparatus of data of a double-sided printing job to be sent from the PC 104 to the printing apparatus via the setting item 2002.

In other words, when the user's request is accepted from the operator of the PC 104 via the setting item 2002, the controller of the PC 104 controls the printing apparatus to execute a series of double-sided printing operations including image shift processing for data of the double-sided printing job to be sent from the PC 104. Note that this embodiment adopts a scheme for preventing erroneous operations of the user. For example, when the user of the PC 104 makes a setting to execute double-sided printing for the job to be processed via the setting item 2001 on the window of FIG. 20, the controller permits to accept that designation from the user via the setting item 2002.

On the other hand, when the user of the PC 104 makes a setting to execute single-sided printing for the job to be processed via the setting item 2001 on the window of FIG. 20, the controller inhibits the designation from being accepted from the user via the setting item 2002. In this case, the controller of the PC 104 controls to hatch/gray out the item 2002. The controller of the PC 104 executes such inhibition control. By providing such function to the external apparatus side such as the PC 104 or the like, even for a double-sided printing job from the external apparatus, the position alignment request of images on the front and back sides can be accepted from the user of the external apparatus.

The controller of the PC 104 controls the display unit of the PC 104 to enable the display state of the setting item 2002 when the operator of the PC 104 selects "double-sided printing" via the setting item 2001 on the window of FIG. 20 displayed on the display unit of the PC 104.

Figure 21:
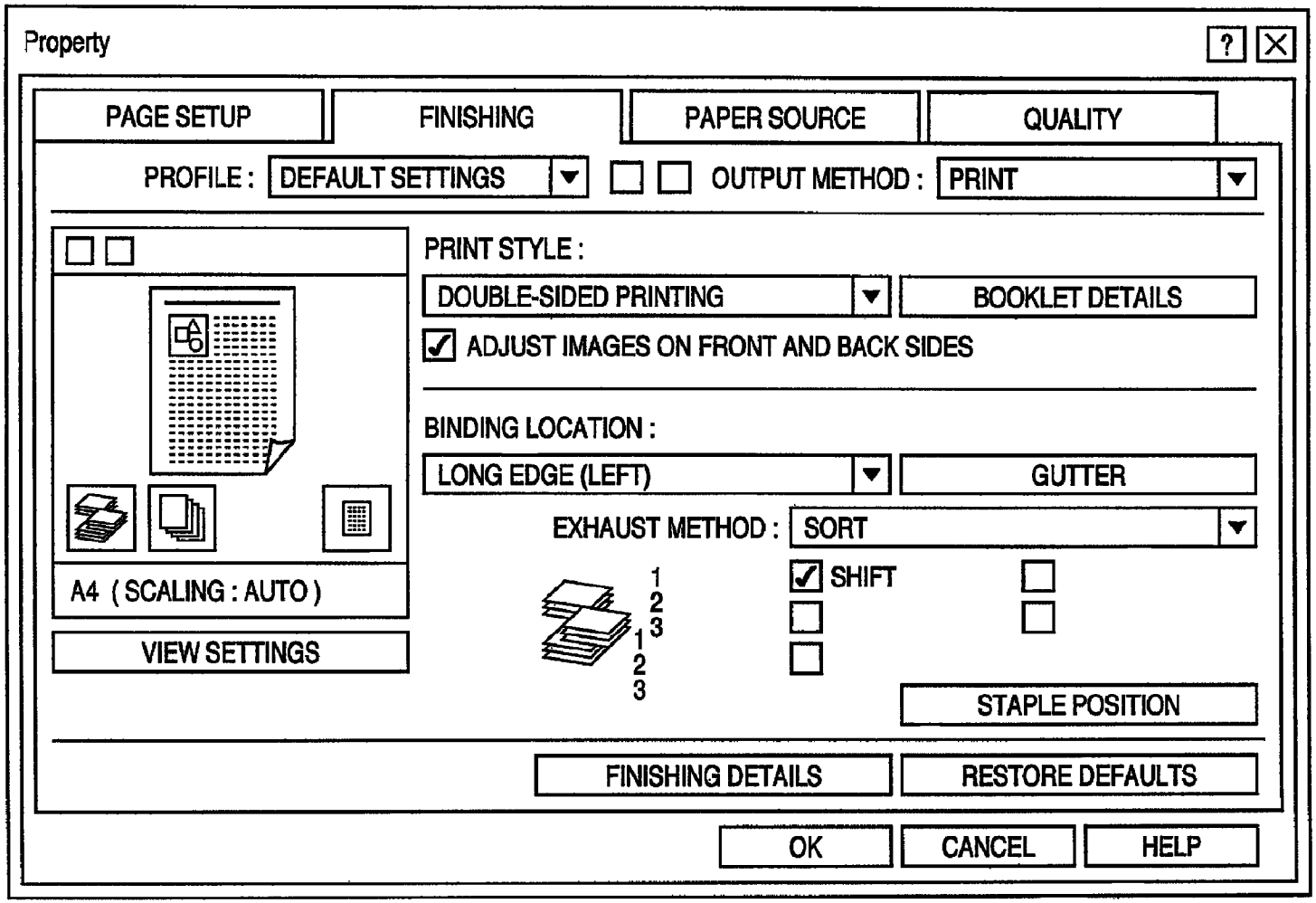
FIG. 21 is a view for explaining one example of the UI unit to be controlled by the embodiment of the present invention.

With this configuration, assume that the operator of the PC 104 requests "Double-sided printing" via the setting item 2001 on the window of FIG. 20, requests "Adjust images on front and back sides" via the setting item 2002, and then requests a printing start instruction via the key 1802. FIG. 21 shows a display example when this setting is made. In this case, the controller of the PC 104 determines that a print job to be sent from the PC 104 to the printing apparatus is a "double-sided printing job which requires position adjustment of images on the front and back sides".

On the other hand, assume that the operator of the PC 104 requests "Double-sided printing" via the setting item 2001 on the window of FIG. 20, and then requests a printing start instruction via the key 1802 without requesting "Adjust images on front and back sides" via the setting item 2002. In this case, the controller of the PC 104 determines that a print job to be sent from the PC 104 to the printing apparatus is a "double-sided printing job which does not require any position adjustment of images on the front and back sides".

Assume that the operator of the PC 104 requests "Single-sided printing" via the setting item 2001 on the window of FIG. 20, and then requests a printing start instruction via the key 1802. In this case, the controller of the PC 104 determines that a print job to be sent from the PC 104 to the printing apparatus is a "single-sided printing job". Note that this job does not obviously require position adjustment of images on the front and back sides since it is a single-sided printing job.

With the above configuration, in this printing system, the external apparatus such as the PC 104 or the like can transmit data of a job to be printed to the printing apparatus by the printing method of user's choice of the external apparatus from a plurality of different printing methods.

As a result, assume that the printing apparatus accepts a "double-sided printing job which requires position adjustment of images on the front and back sides" from the external apparatus such as the PC 104 or the like. In this case, the CPU 205 of this printing apparatus controls the printing apparatus to process print data of that job by a series of double-sided printing operations including the image shift processing in accordance with the user's request associated with the printing method from the external apparatus.

On the other hand, for example, assume that the printing apparatus accepts a "double-sided printing job which does not require any position adjustment of images on the front and back sides" from the external apparatus such as the PC 104 or the like. In this case, the CPU 205 of this printing apparatus controls the printing apparatus to process print data of that job by a series of double-sided printing operations in which the image shift processing is inhibited independently of the printing result of images on the front and back sides in accordance with the user's request associated with the printing method from the external apparatus.

For example, assume that the printing apparatus accepts a "single-sided printing job (which does not require any position adjustment of images on the front and back sides)" from the external apparatus such as the PC 104 or the like. In this case, the CPU 205 of this printing apparatus controls the printing apparatus to process print data of that job by a series of single-sided printing operations in which the image shift processing is inhibited in accordance with the user's request associated with the printing method from the external apparatus.

When the user of the PC 104 inputs a printing start request via the "OK" key 1802 upon completion of all settings of a series of printing conditions on the PC 104, the PC 104 sends print data to the printing apparatus together with printing condition data. Data (print data itself including a plurality of pages and printing condition data) of the job to be processed sent from the external apparatus such as the PC 104 or the like is received via the external I/F 202 of the printing apparatus. The CPU 205 of the printing apparatus stores the data of the job to be processed received from the external apparatus in the HDD 209 or RAM 208. In this case, the CPU 205 stores, in the HDD 209, all pages of all the print data including a plurality of pages, which are included in the data of the job. The CPU 205 of the printing apparatus controls the printer unit 203 to execute printing processing according to the printing conditions using the print data stored in the HDD 209.

<Image Printing Position Alignment Function upon Printing of Double-Sided Printing Job from External Apparatus by Printing Apparatus>

As described above, the CPU 205 of the printing apparatus (MFP 105 or 106) controls the printer unit 203 to print data of a print job from the external apparatus (server 103, PC 104, or the like) using the printing method designated by the external apparatus from a plurality of different printing methods.

One control example of the CPU 205 of the printing apparatus when the printing apparatus receives data of a job for which the user of the external apparatus has designated double-sided printing via the UI unit of the external apparatus and has issued an execution request of position adjustment of images on the front and back sides will be mainly explained below.

Note that the printing system of this embodiment comprises a plurality of multi-function image forming apparatuses such as the MFPs 105, 106, and the like as an example of printing apparatuses. All these MFPs have equivalent functions and configurations in association with principal parts described in this embodiment. In other words, the following description pertaining to the printing apparatus is that of the constituent elements of the MFP 105 or that of the constituent elements of the MFP 106. This point is common to all the embodiments including the first embodiment. Also, the printing system of this embodiment has information processing apparatuses such as the server 103, PC 104, and the like as an example of external apparatuses. The PC 104 will be representatively explained based on the above description. In other words, the same processing can also be executed using the server 103.

FIG. 22 is a flowchart showing the flow of the processing of the image printing position alignment function upon printing executed by the CPU 205 of the printing apparatus (MFP 105, 106, or the like) according to this embodiment.

In step S2201, the external I/F unit 202 of the printing apparatus receives data of a job to be printed (image data to be printed and various printing processing condition data set by the printer driver) sent from the PC 104. In response to this, the CPU 205 stores the data of the job in the storage unit (HDD 209 or RAM 208). In this case, the CPU 205 controls to store all pages of the print data of the job to be printed from the PC 104 in the HDD 209 in turn from the first page until the last page.

In step S2202, the CPU 205 interprets the header field of the image data received in step S2201. The CPU 2202 checks based on that interpretation result if the job is set with double-sided printing.

For example, when the operator of the PC 104 has set "single-sided printing" via the setting item 2001 on the printer driver detailed setting window in FIG. 20 (he or she has not set "double-sided printing"), the header field of the image data describes that information as printing processing condition data. In other words, the job to be processed is a "single-sided printing job (the job that does not require any position adjustment of image on the front and back sides)". In this case, the CPU 205 controls the flow to advance from the processing in step S2202 to that in step S2214. In step S2214, the CPU 205 reads out the print data of the job from the HDD 209 and controls the printer unit 203 to execute single-sided printing processing in accordance with the printing condition data of that job. When the flow advances to step S2214 as in this example, the CPU 205 controls the printer unit 203 to execute printing of the data of the job by a printing method other than the double-sided printing method.

On the other hand, for example, when the operator of the PC 104 sets "double-sided printing" via the setting item 2001 on the window in FIG. 20, as exemplified in FIG. 21, the header field of the image data describes that information as printing processing condition data. In this case, the CPU 205 controls the flow to advance from the processing in step S2202 to that in step S2203 since that job is a job to be double-sided printed.

The CPU 205 further interprets the header field of the received image data of the job which is determined as a double-sided printing job in step S2202. The CPU 205 checks based on that interpretation result if the job is a job to which the user has set to apply double-sided image printing position alignment. The CPU 205 executes this checking processing in step S2203.

For example, assume that the operator of the PC 104 has set "double-sided printing" via the setting item 2001 on the setting window of FIG. 20, but he or she has not issued any "adjust images on the front and back sides" instruction via the setting item 2202. In this case, the header field of the image data of the received job describes that information as printing processing condition data. In other words, the job to be processed is a "double-sided printing job that does not require any position adjustment of images on the front and back sides".

In this case, the CPU 205 controls the flow to advance from the processing in step S2203 to that in step S2213. In step S2213, the CPU 205 reads out the print data of the job from the HDD 209 and controls the printer unit 203 to execute double-sided printing processing in accordance with the printing condition data of that job. In this case, however, the CPU 205 controls the printer unit 203 to execute the double-sided printing operations while inhibiting execution of image shift processing (position alignment operation of images on the front and back sides) as the printing processing of the job. When the flow advances to step S2213 as in this example, the CPU 205 controls the printer unit 203 to execute printing processing of the data of the job by the double-sided printing method that does not require any image shift processing.

On the other hand, for example, assume that the operator of the PC 104 has set "double-sided printing" via the setting item 2001 on the setting window of FIG. 20, and has issued an "adjust images on the front and back sides" instruction via the setting item 2202. In this case, the header field of the image data of the received job describes that information as printing processing condition data. In other words, the job to be processed is a "double-sided printing job that requires position adjustment of images on the front and back sides". In this case, the CPU 205 controls the flow to advance from the processing in step S2203 to that in step S2204 since the double-sided printing job is a job that must execute double-sided image printing position alignment.

The CPU 205 controls the printer unit 203 to execute predetermined operations corresponding to the printing position adjustment operation of images to be double-sided printed required for that job in the processes in steps S2204 and S2205. More specifically, the CPU 205 controls the printer unit 203 to execute special (specific) double-sided printing operations as operations corresponding to printing position adjustment operations for the double-sided printing job which includes the user's request associated with printing position adjustment of images to be double-sided printed. For example, the CPU 205 controls the printer unit 203 to execute double-sided printing processing of print data for a predetermined number of pages to be adopted in practice as the printing result of the double-sided printing job that requires position adjustment of images on the front and back sides. In this example, the CPU 205 controls to print the print data of the first and second pages of that job on the front and back sides of one sheet. That is, the principal constituent elements associated with both the processes in steps S2204 and S2205 in the second embodiment described herein are equivalent to those associated with the processes in steps S1404 and S1405 in FIG. 14 of the first embodiment. Note that the principal constituent elements associated with processes in steps S2905 and S2907 of FIG. 29 in the third embodiment to be described later have the equivalent gist as those of these embodiments, since print data themselves to be printed in practice included in data of a job that requires position adjustment are used in the adjustment operation.

Note that a configuration common to all the embodiments will be further explained. In this embodiment, as one example of the specific double-sided printing operations required in the printing position adjustment operation of double-sided images, the CPU 205 controls the printer unit 203 to execute double-sided printing processing that actually uses print data themselves of the double-sided printing job which includes the user's request associated with printing position adjustment of double-sided image, as described above. This point has already been explained using FIG. 12 and FIGS. 30 to 32. An example of the effects of this configuration allows the printing system to cope with a printing environment such as the POD environment or the like, which often requires very severe printing precision.

In other words, occurrence of the problems assumed in the prior art is more likely to be suppressed when print data of a final product are to be used in practice. In the configuration in which the operator himself or herself visually confirms the double-sided printing result as in the first and second embodiments, he or she can make inspection with higher precision when he or she confirms the result using the print data actually requested from the customer. This function is provided since such use case is assumed.

However, as another embodiment of the specific double-sided printing operation required in the printing position adjustment operation of double-sided images, for example, the following configuration may be adopted. For example, the CPU 205 saves, in the HDD 209 or the like in advance, a series of sample image data of a plurality of pages which include sample image data for at least two pages to be printed on the two sides, i.e., the first and second sides of a sheet, and are dedicated to the printing position adjustment operation of double-sided images. Preferably, the CPU 205 saves, in the HDD 209 in advance, sample data in correspondence with the purposes (types) of print products required as desired articles from the customers in the POD environment such as "sample image data for a product manual", "sample image data for a brochure", and the like. The CPU 205 controls the printer unit 203 to execute the double-sided printing operations using such sample data as the special (specific) double-sided printing processing required in the printing position adjustment operation of double-sided images.

In other words, the CPU 205 controls the printer unit 203 to execute double-sided printing processing of the sample data in the processes in steps S1404 and S1405 in FIG. 14, those in steps S2204 and S2205 in FIG. 22, or those in steps S2905 and S2907 of FIG. 29 to be described later. Such configuration may be adopted.

Referring back to FIG. 22, the CPU 205 reads out the second page of the print data of the job to which the user (operator) has made the "adjust images on the front and back sides" request using the setting item 2002 on the window of FIG. 20 from the HDD 209 in step S2204. The CPU 205 controls to print an image based on the print data of the second page on the second side (back side) of a sheet, which is fed from the paper feed unit selected based on the paper settings designated by the user of the PC 104 via the window of FIG. 19 and is required in printing of that job. This sheet is reversed, and is conveyed to the image forming unit again.

Next, the CPU 205 reads out the first page of the print data of the job from the HDD 209 in step S2205. The CPU 205 controls to print an image based on the print data of the first page on the first side of the sheet on the second side of which the image of the second page has already been printed.

The CPU 205 controls to exhaust the sheet onto the tray 324 upon completion of the double-sided printing processing of the first and second pages of the job on the front and back sides of one sheet via the aforementioned processes in steps S2204 and S2205.

In step S2205, in response to exhaust of the first sheet required in the job onto the tray 324, the CPU 205 stops the printing operation of the job. In other words, when the double-sided printing result which includes the image of the first page of the job printed on the first side of the sheet and that of the second page printed on the second side of the sheet is output, the CPU 205 stops the printing operation. In this case, the CPU 205 stops the printing operation after the first sheet is exhausted. However, this embodiment is not limited to this. For example, the CPU 205 may control the printing apparatus to stop the printing operation in response to exhaust of an arbitrary designated number of double-sided printed sheets of the job based on a user's instruction onto the tray 324. Also, for example, the CPU 205 may control to accept a stop request from the user via the stop key 502 during the printing operation, and may control the printing apparatus to stop the printing operation upon reception of that request. In this way, the printing operation may be stopped based on the number of sheets or timing of operator's choice.

The CPU 205 stops the printing operation in step S2206 and controls the display unit of the operation unit 204 of the printing apparatus to display the window of FIG. 15 in step S2207. Note that the user's request that can be accepted from the user via the window of FIG. 15 and the control operation of the printing apparatus based on this request are the same as the constituent elements in the above first embodiment. Therefore, a description thereof will be omitted.

As described above, one example of the UI unit provided by the printing system of this embodiment corresponds to not only the operation unit 204 but also the UI unit of the external apparatus (information processing apparatus or the like such as the server 103, PC 104, or the like) as the transmission source of a print job. For example, the print job to be controlled in this example is that received from the PC 104. Therefore, a configuration in which the controller of the PC 104 mainly controls the display unit of the PC 104 to display the window of FIG. 15 may be adopted. In this case, the CPU 205 sends information that notifies the external apparatus of completion of the specific double-sided printing operations to the PC 104 via the external I/F unit 202. Upon reception of this information from the printing apparatus, the controller of the PC 104 controls the display unit of the PC 104 to display the window of FIG. 15 based on this received information. When such control operation is made, the PC 104 sends, to the printing apparatus, a control command that notifies the printing apparatus of user's requests (requests accepted via the keys 1501 to 1507) of the PC 104 accepted via the window of FIG. 15 displayed on the display unit of the PC 104. Upon reception of the command, the CPU 205 executes processing according to the user's requests of the PC 104, which are received from the PC 104 and are accepted via the window of FIG. 15, in the flowchart of FIG. 22. Likewise, the display unit of the PC 104 is controlled to display the window of FIG. 16 to be executed at the timing of step S2210 in FIG. 22 to be described later. Also, user's requests (keys 1601 to 1603) are accepted from the operator of the PC 104 via the window of FIG. 16. In this way, the processing of the flowchart of FIG. 22 may be configured to be executed using the display unit of the external apparatus corresponding to the transmission source of the print job that includes the user's request associated with double-sided image position adjustment.

In the control operation of this example, the operator visually confirms the double-sided printing result of the job exhausted onto the tray 324 at the timing of step S2207. Therefore, this operator must pick up the print product from the tray 324. In other words, the operator of the job may be in front of the printing apparatus. In consideration of such situation, the following description will be given using a control example that allows the display unit of the operation unit 204 of the printing apparatus to display the windows of FIGS. 15 and 16 although the job is sent from the PC 104.

The CPU 205 checks in step S2208 if a request that cancels the job is accepted from the user via the key 1507 on the window of FIG. 15. If the job cancel request is accepted, the CPU 205 controls the flow to jump from step S2208 to step S2212. Note that the job cancel processing in this example is the same as that in the first embodiment. For example, if YES is determined in step S2208, the CPU 205 erases all the pages of the print data of the job received from the PC 104 from the HDD 209.

If no job cancel request is received, the CPU 205 controls the processing to advance from step S2208 to step S2209. The CPU 205 checks in step S2209 if a redo request of the job is accepted from the user via the key 1505 on the window of FIG. 15. In other words, the CPU 205 checks if a change request of the printing position of an image of the job with respect to a sheet is accepted. If that request is accepted, the CPU 205 controls the processing to advance from step S2209 to the step S2211 side. The flow then returns to the processing in step S2204 again. Note that the principal operations associated with the constituent elements are equivalent to those in the first embodiment, except that the print data which are to be read out from the HDD 209 and to be re-printed are those of the first and second pages from the PC 104. That is, the configuration other than that which processes data from the scanner unit 201 in the first embodiment and that which processes data from the external apparatus is the same as that of the first embodiment.

When the flow advances from step S2209 to step S2211, the CPU 205 controls to execute the image shift processing of the job. As for constituent elements associated with the image shift processing are substantially the same as those in the first embodiment, except that data which is to undergo image shift processing is the print data from the PC 104, and a description thereof will be omitted.

Upon completion of the processing in step S2211, the flow returns to step S2204 to control to redo processing from the first printing operation of the second page. The flow that returns from step S2211 and reaches step S2209 is repeated until it is determined in step S2209 that the image printing position is not changed (that is, this flow is repeated until the user visually confirms the double-sided printing result and determines that the image printing positions on the front and back sides match). The constituent elements associated with these operations are substantially the same as those in the first embodiment, except that data to be processed are the print data from the PC 104, and a description thereof will be omitted.

On the other hand, if it is determined in step S2209 that the image printing position is not changed, the CPU 205 controls the flow to advance to the processing in step S2210. For example, if the user presses the printing proceeding key 1506 via the window of FIG. 15, the CPU 205 controls the processing to advance from step S2209 to step S2210. In this step, the CPU 205 controls the display unit of the operation unit 204 to display the window of FIG. 16. Various control operations related to the operations based on instructions from the keys 1601 to 1603 on the window of FIG. 16 are substantially the same as those in the first embodiment, except that data to be processed are the print data from the PC 104, and a description thereof will be omitted.

In step S2210, the CPU 205 proceeds with the printing operations of the remaining pages, i.e., the third pages and subsequent pages until image data of the last page in accordance with the double-sided image printing position alignment settings in step S2209. The constituent elements associated with those operations are also substantially the same as those in the first embodiment, except that data to be processed are the print data from the PC 104, and a description thereof will be omitted.

The CPU 205 checks in step S2212 if jobs to be processed still remain. If YES in step S2212, the flow returns to step S2202. On the other hand, if NO in step S2212, the processing ends. The constituent elements associated with such operations are also substantially the same as those in the first embodiment, except that data to be processed are the print data from the PC 104, and a description thereof will be omitted.

As described above, according to this embodiment, the control equivalent to that in the first embodiment is configured to be executed using the external apparatus (server 103, PC 104, or the like) which can send print data to be printed by this printing apparatus to the printing apparatus.

In addition to the effects which allow this printing system to provide those exemplified in the first embodiment, another effect that allows this printing system to provide the aforementioned effects when a print job from the external apparatus is to be processed can be provided. In this way, the convenience can be further improved compared to that of the first embodiment.

Third Embodiment

In the descriptions of the control examples of the first and second embodiments, the operator visually confirms the double-sided printing result of the specific double-sided printing operations executed by the CPU 205 as the position adjustment operation of images on the front and back sides in the double-sided printing job. In other words, in the above description, the CPU 205 controls to accept, via the window of FIG. 15, a practical correction instruction of the printing positions of images to be printed on the front and back sides of a sheet in the double-sided printing processing from the operator who executed the above request via at least one of the key 901 in FIG. 9 and the setting item 2002 of FIG. 20. However, this embodiment is not limited to this. For example, this embodiment may comprise constituent elements which take high productivity, high operability, and automation into account that may be requested together with high printing precision in the POD environment. One example of such constituent elements will be described below. In the following example, a configuration in which the CPU 205 controls this printing apparatus to detect and correct position misalignment by the printing apparatus itself using a specific sensor unit of the printing apparatus by obviating the need for confirmation by the operator will be described.

<Functional Arrangement of MFP>

Figure 23:
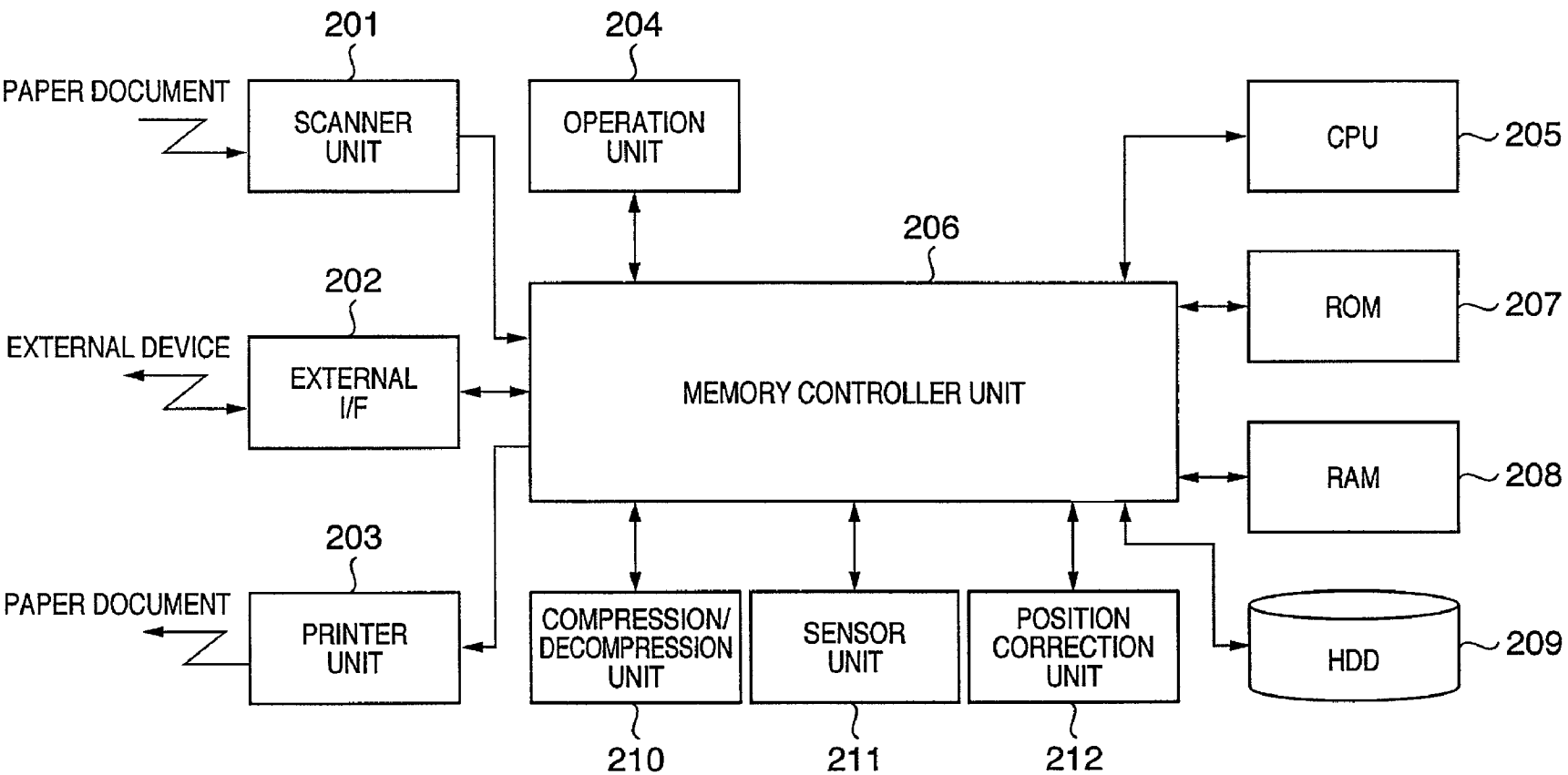
FIG. 23 is a block diagram showing another example of the arrangement of the printing apparatus to be controlled by the embodiment of the present invention.

FIG. 23 is a block diagram showing the arrangement of an MFP (Multi Function Peripheral) according to the third embodiment of the present invention. Note that the same reference numerals in FIG. 23 denote the same parts as in the arrangement of the MFP (FIG. 2) according to the first and second embodiment. That is, all constituent elements except for those associated with the following description are the same as those in the printing apparatus of the first and second embodiments.

A major difference of the arrangement from the printing apparatus (MFP 105 or 106) described in the first and second embodiments is that the printing apparatus comprises a sensor unit 211 and position correction unit 212. The sensor unit 211 has a sensor 332 as a mechanism shown in FIG. 24, and acquires detection information associated with a sheet conveyed inside the printer unit 203 in practice from the sensor 332. The sensor unit 211 detects image printing position misalignment of the printing result on the basis of information from the sensor 332 arranged on the sheet convey path, and sends the detected position misalignment amount to the CPU 205.

As one example, the sensor unit 211 detects the printing position of an image on the first side of a sheet which has undergone double-sided printing by the printer unit 203 in the specific double-sided printing operations described in the above embodiments. Also, the sensor unit 211 detects the printing position of an image on the second side of the sheet which has undergone double-sided printing by the printer unit 203 in the specific double-sided printing operations. Note that these results are converted into digital data to be used in checking processing of the CPU 205. Furthermore, the sensor unit 211 compares the image printing position information on the first side and that on the second side. Based on this comparison result information, the sensor unit 211 confirms which of the first and second sides of the sheet the image misaligns to that on the other side, and the direction and amount of misalignment. Then, the sensor unit 211 sends digital information indicating this confirmation result to the CPU 205. Note that information obtained by numerically converting the degree of position misalignment (position misalignment amount) indicating misalignment that has occurred will be referred to as a position misalignment amount hereinafter.

The position correction unit 212 is controlled by the CPU 205 as a unit that automatically adjusts the image printing positions on the front and back sides upon double-sided printing. For example, the position correction unit 212 compares the position misalignment amount detected by the sensor unit 211 with a position misalignment allowable value based on a user's setting that has already accepted from the user via the UI unit provided by this printing system. Note that the CPU 205 pre-stores digital data obtained by numerically converting the position misalignment allowable value accepted from the user in the HDD 209 to be able to be compared with the position misalignment amount. In other words, the CPU 205 registers in advance at least this position misalignment allowable value data in the HDD 209 before this printing apparatus accepts a double-sided printing job that requires position alignment of images on the front and back sides.

For example, assume that a value corresponding to the position misalignment amount, from the sensor unit 211, in the actual double-sided printing result output by the printer unit 203 in the specific double-sided printing operation exceeds a value corresponding to the position misalignment allowable value which has already been registered in advance in the HDD 209. In this case, the CPU 205 inhibits the UI unit from displaying the windows in FIGS. 15 and 16. That is, the CPU 205 controls the printer unit 203 to automatically execute a series of double-sided printing operations including image shift processing as those for the job to be processed without accepting an explicit correction instruction from the operator via the keys 1501 to 1507 on the window of FIG. 15.

In the image shift processing of the above configuration, the CPU 205 controls to execute image shift processing based on the information based on information (the information which allows the CPU 205 to confirm which of the sides the image misaligns and the direction and amount of misalignment) from the sensor unit 211. In the practical method of the image shift processing, the start address position of image data on the front or back side stored on the RAM 208 is adjusted. That is, all the constituent elements of the data processing method itself associated with this image shift processing are the same as those in the description of the first embodiment, and a description thereof will be omitted.

On the other hand, assume that a value corresponding to the position misalignment amount, from the sensor unit 211, in the actual double-sided printing result output by the printer unit 203 in the specific double-sided printing operation does not exceed a value corresponding to the position misalignment allowable value which has already registered in advance in the HDD 209. In this case, the CPU 205 inhibits execution of the aforementioned image shift processing.

That is, the CPU 205 controls the printer unit 203 to execute a series of double-sided printing operations that do not require any image shift processing as those for the job to be processed. In this case as well, the CPU 205 obviously inhibits the UI unit from displaying the windows of FIGS. 15 and 16. That is, the CPU 205 inhibits the image shift processing from being automatically executed without accepting any explicit correction instruction from the operator via the keys 1501 to 1507 on the window of FIG. 15.

<Hardware Arrangement of MFP>

The hardware arrangement of the MFP according to this embodiment will be described below using FIG. 24. Note that the same reference numerals in FIG. 24 denote the same parts as those in the arrangement of the MFP (FIG. 3) according to the first and second embodiments.

Figure 24:
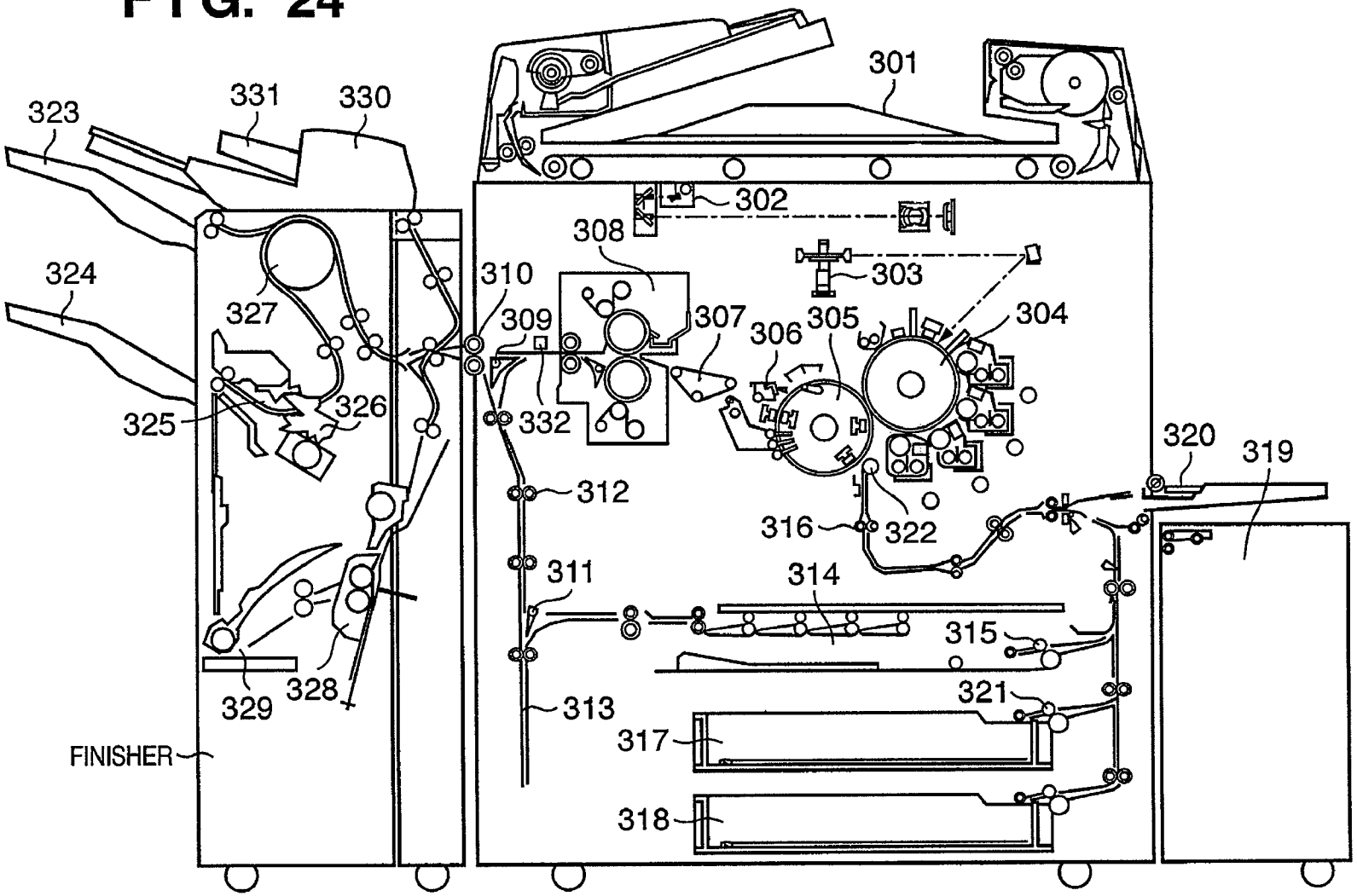
FIG. 24 is a sectional view showing another example of the hardware arrangement of the printing apparatus to be controlled by the embodiment of the present invention.

The sensor 332 in FIG. 24 of the sensor unit 211 in FIG. 23 is arranged on the convey path from the fixing unit 308 to the exhaust flapper 309, and detects the position misalignment amount of a predetermined image on a sheet material, on which the image is fixed, from a reference mark set beside the convey path.

<Layout of Sensor>

A of FIG. 25 shows an example of the layout of the sensor 332 on the paper convey path. As shown in A of FIG. 25, the sensor 332 is arranged above a sheet material which is conveyed from exhaust rollers 2501 in the fixing unit 308 and on which an image is fixed. The sensor 332 comprises a two-dimensional sensor, and is arranged in a direction perpendicular to the sheet material convey direction.

B of FIG. 25 shows the layout of a sheet material and a reference mark when viewed from above the sheet material convey path. In B of FIG. 25, a reference mark 2502 is arranged beside the sheet convey path, and is set in correspondence with the arrival position of a reference image (e.g., the index 1202 of the manual in this embodiment) of the sheet material just at the position detection timing.

The reference mark 2502 may be set at the arrival position of another reference image such as the frame 1201 or the like of the manual on the sheet material or the paper end of the sheet material. When an image to be printed on a sheet material does not include any image suited to position alignment, a test chart for position alignment may be printed first, and the reference mark 2502 may be set at the position of a reference image on the text chart. In other words, the CPU 205 may control this printing apparatus to execute double-sided printing processing using sample image data already registered in the HDD 209 by the printer unit 203.

<Description of UI Control Associated with Setting of Allowable Range of Double-Sided Image Printing Position Alignment>

The UI control associated with the setting of an allowable range of double-sided image printing position alignment so as to set the aforementioned position misalignment allowable value will be described below using FIG. 5 and FIGS. 26 to 28. The CPU 205 also executes the control operations to be described below.

Figure 26:
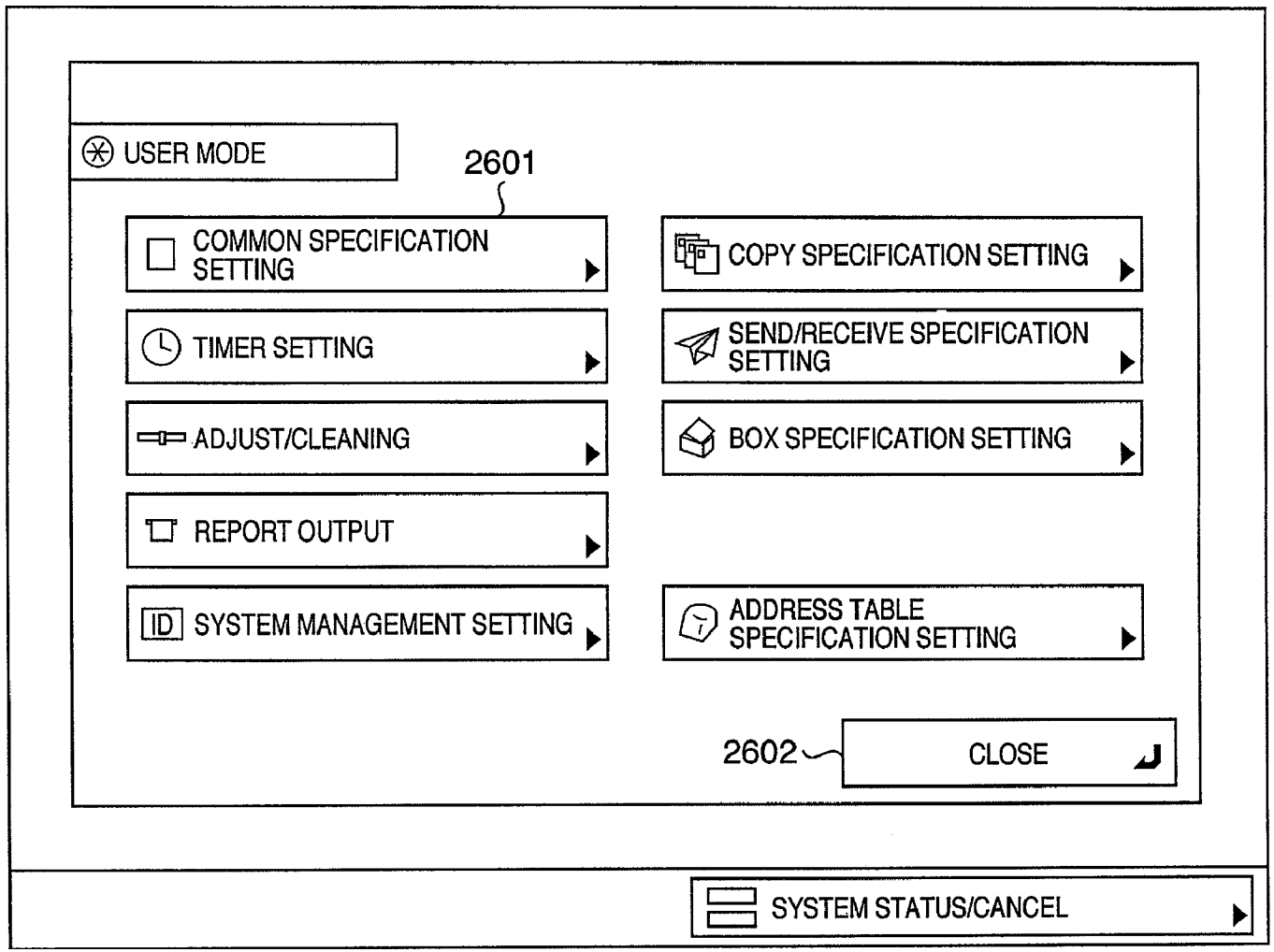
FIG. 26 is a view for explaining one example of the UI unit to be controlled by the embodiment of the present invention.

When the operator presses the user mode key 505 on the operation unit 204 shown in FIG. 5 corresponding to one example of the UI unit of this system, the CPU 205 controls the display unit of the operation unit 204 to display a window shown in FIG. 26. For example, the CPU 205 controls the display unit to display a user mode window shown in FIG. 26.

The window shown in FIG. 26 comprises a common specification setting key 2601 used to accept from the user an instruction to control the UI unit to make a display which allows the user to make various settings associated with the common specifications of this printing apparatus (MFP 105, 106, or the like). For example, when the user presses the key 2601, the CPU 205 controls the display unit of the operation unit 204 to display a window shown in FIG. 27. Also, upon depression of a "close" key 2602, the CPU 205 ends the setting processing of the user mode. In this case, the CPU 205 closes the window of FIG. 26 and returns the display on the operation unit 204 to the basic window.

Figure 27:
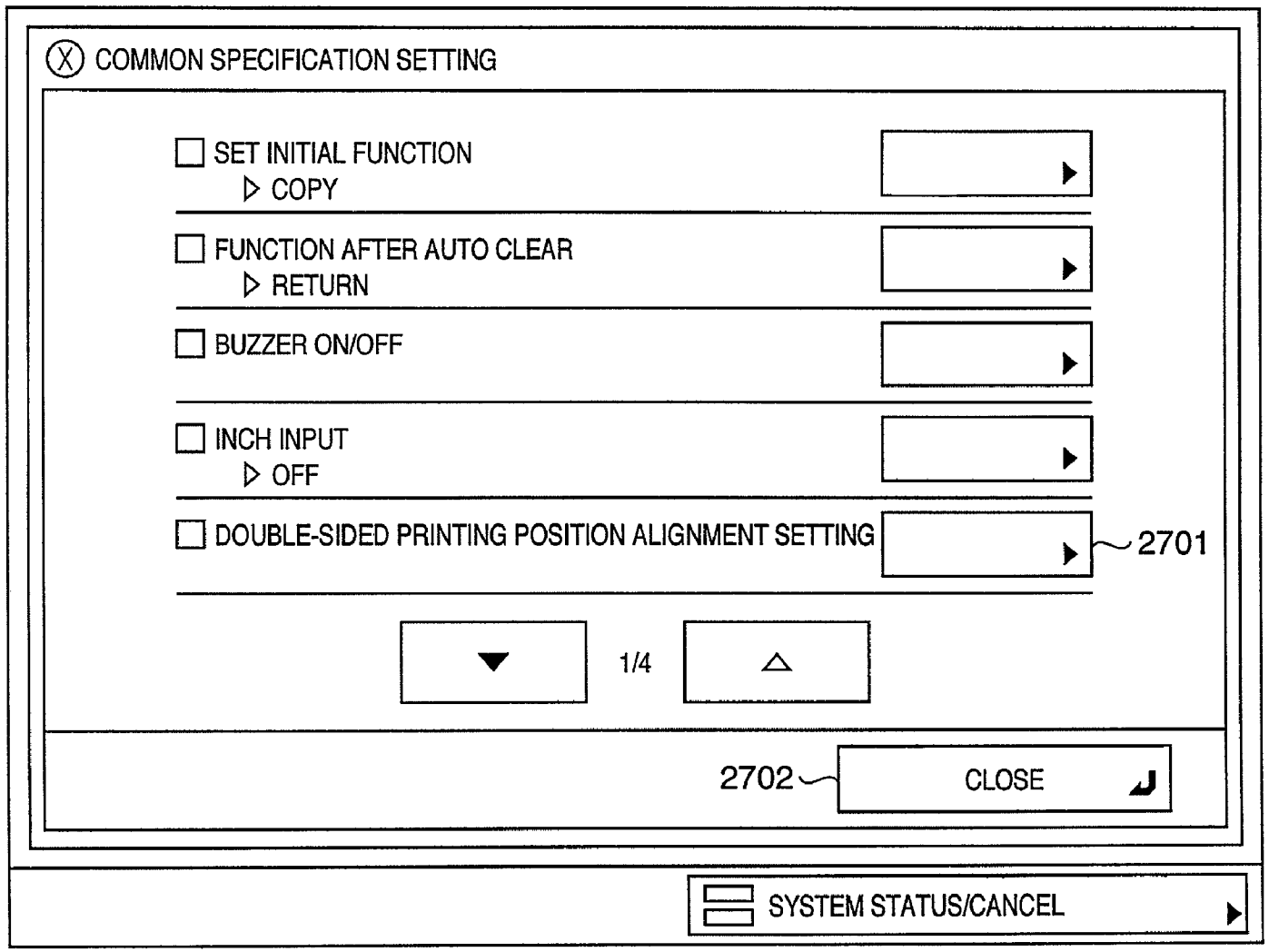
FIG. 27 is a view for explaining one example of the UI unit to be controlled by the embodiment of the present invention.

When the user presses the common specification setting key 2601 via the window of FIG. 26, the CPU 205 controls the display unit of the operation unit 204 to display the window of FIG. 27. FIG. 27 shows the common specification setting window of this example. The window of FIG. 27 displayed on the UI unit under the control of the CPU 205 comprises a double-sided image printing position alignment setting key 2701. The key 2701 is a display key used to accept from the user an instruction to control the UI unit to make a display that allows the user to set the allowable range of double-sided image printing position alignment. When the user presses a "close" key 2702 on the window of FIG. 27, the CPU 205 controls the display unit to close the common specification setting window of FIG. 27, and to return to the user mode window of FIG. 26.

Figure 28:
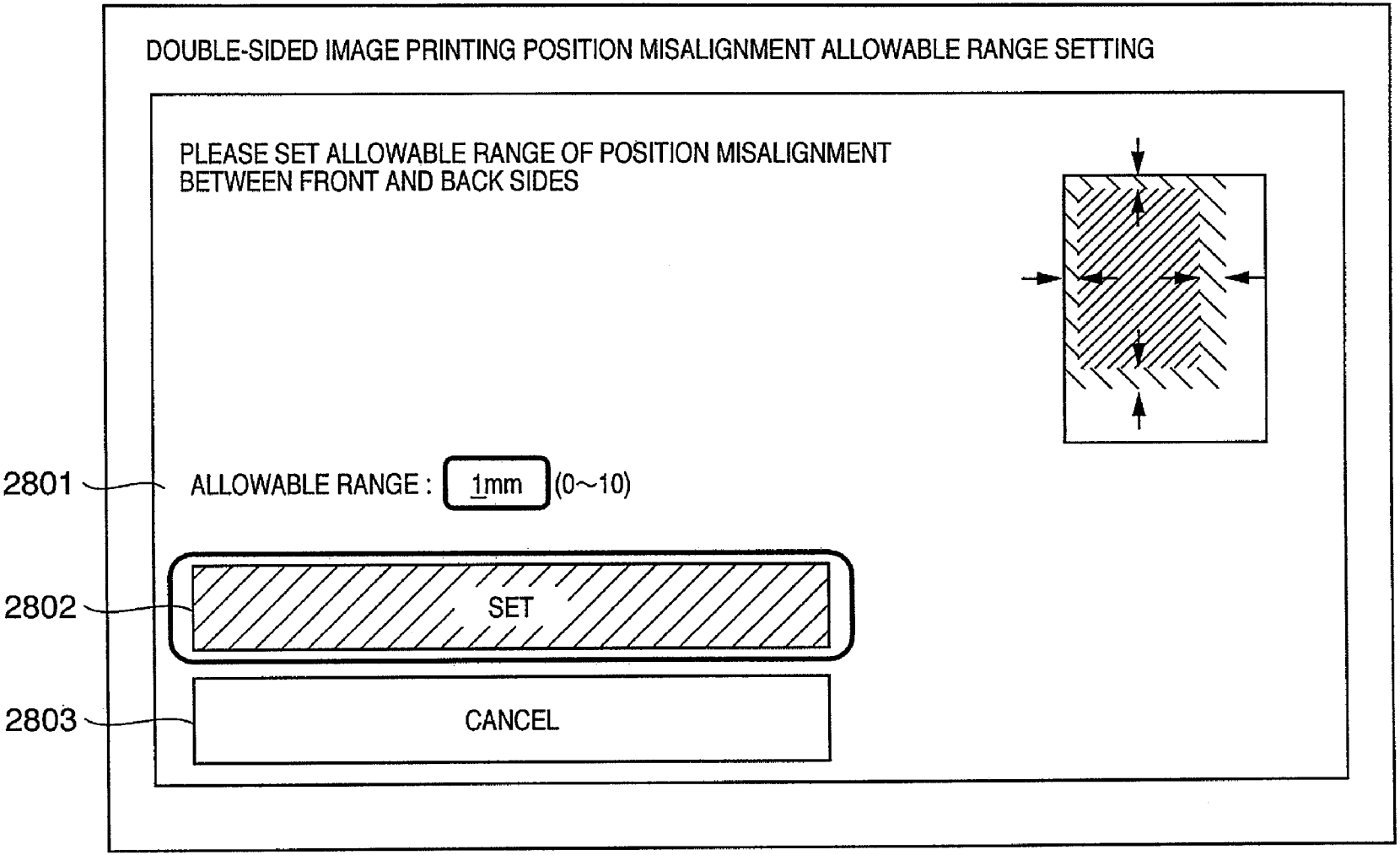
FIG. 28 is a view for explaining one example of the UI unit to be controlled by the embodiment of the present invention.

Assume that the user has pressed the double-sided image printing position alignment setting key 2701 on the window of FIG. 27 displayed on the display unit of the operation unit 204 under the control of the CPU 205. In this case, in response to this key operation, the CPU 205 controls the UI unit to set a display that allows the user to set the allowable range of double-sided image printing position alignment. As one example of this display, the CPU 205 controls the display unit of the operation unit 204 to display a window of FIG. 28. FIG. 28 shows an example of a double-sided position misalignment allowable range setting window. A setting item 2801 on the window of FIG. 28 is an allowable range setting display field. The CPU 205 can accept a maximum allowable amount of position misalignment of images to be printed on the front and back sides of a sheet of a double-sided printing job from the user via this setting item 2801.

In other words, the CPU 205 accepts from the user an allowable range indicating a maximum relative printing position misalignment amount between the image printing position of an image printed on the first side of a sheet of a double-sided printing job and that of an image on the second side of the sheet.

For example, assume that the misalignment amount, acquired from the sensor unit 211, of the printing positions of images on the front and back sides of a sheet that has undergone double-sided printing in practice by the printer unit 203 in the specific double-sided printing operations is a misalignment amount corresponding to a value that exceeds the setting value accepted from the user via the item 2801. In this case, the CPU 205 permits execution of the image shift processing. That is, in this case, the CPU 205 permits the printer unit 203 to automatically execute a series of double-sided printing operations including image shift processing as printing operation of print data of the double-sided printing job to be processed.

On the other hand, assume that the misalignment amount, acquired from the sensor unit 211, of the printing positions of images on the front and back sides of a sheet that has undergone double-sided printing in practice by the printer unit 203 in the specific double-sided printing operations is a misalignment amount corresponding to a value which is equal to or smaller than the setting value accepted from the user via the item 2801. In this case, the CPU 205 inhibits execution of the image shift processing. That is, in this case, the CPU 205 inhibits the printer unit 203 from automatically executing a series of double-sided printing operations including image shift processing as printing operation of print data of the double-sided printing job to be processed.

In other words, the CPU 205 controls the printer unit 203 to execute a series of double-sided printing operations in which execution of the image shift processing is inhibited as the printing operations of print data of the double-sided printing job to be processed. That is, even when misalignment of the printing positions of images on the front and back sides has occurred in the actual double-sided printing result, if the degree of misalignment (misalignment amount) is equal to or smaller than the misalignment amount corresponding to the value input via the item 2801, the CPU 205 permits to execute the double-sided printing operations without executing any printing position alignment operation of images.

As has been assumed in the prior art, the misalignment amount of 2 mm or more in an environment such as the POD environment or the like with very severe printing precision requirements is rejected as a print product of an article. However, even in such environment, if imperceptible position misalignment of 2 mm or less, which is inconspicuous as a print style, has occurred on a double-sided print product, that print product can be sufficiently adopted as an article. That is, the above scheme can flexibly cope with such user needs. That is, the above scheme can prevent double-sided printing operations from being repeated excessively. That is, the above scheme can prevent excessive use of resources or can prevent insignificant productivity drop. As described above, in this embodiment, the above scheme is configured to cope with a variety of use cases or user's needs as much as possible. In this example, the allowable range of position misalignment is "0 mm to 10 mm". That is, the CPU 205 inhibits the user from inputting a value that exceeds 10 mm via the setting item 2801. The value accepted via the setting item 2801 corresponds to the aforementioned position misalignment allowable value. The CPU 205 registers the setting value accepted from the user in the HDD 209 in advance, as described above.

In this example, the item 2801 is used to display an allowable value which is set using the numeric keypad 506 and serves as a criterion used to inspect whether or not the image printing position misalignment amount of the double-sided printing result falls within an allowable range and to sort the result onto the stack tray 324 or sample tray 323. Reference numeral 2802 denotes a setting key which is a display key used to set and register, in the HDD 209, the allowable value displayed in the allowable range setting display field 2801. Reference numeral 2803 denotes a cancel key used to cancel settings, and to return to the common specification setting window in FIG. 27.

The user setting accepted via the window of FIG. 28 indicates the display contents when "1 mm" is set as the position misalignment allowable range. With this setting, if the misalignment amount between the image printing positions on the front and back sides is equal to or smaller than 1 mm, the CPU 205 determines that the misalignment amount falls within the allowable range. In this case, the CPU 205 controls to exhaust the sheet double-sided printed by the printer 203 onto the tray 324 to adopt it as a final product.

On the other hand, if the print position misalignment amount of images exceeds 1 mm, the CPU 205 determines that the misalignment amount falls outside the allowable range. In this case, the CPU 205 controls to exhaust the sheet double-sided printed by the printer 203 onto the tray 323 as a stacking unit different from the tray 324 so as to reject it as a final product. In this manner, the CPU 205 controls this printing apparatus to execute a series of double-sided printing operations to be able to separate a print product to be adopted and a print product to be rejected in the double-sided printing sequence that automatically executes position misalignment correction of images on the front and back sides.

Upon depression of the setting key 2802 in FIG. 28, the allowable range is set and the common specification setting window is returned. Then, upon successive depressions of the "close" keys 2702 and 2602, the user mode window returns to the standby window, thus completing the settings of the allowable range. The CPU 205 executes a series of UI control operations required to control this printing apparatus to execute the aforementioned double-sided printing operations with an automatic correction function of images on the front and back sides.

<Description Upon Processing Double-Sided Printing Job Using Automatic Correction Function of Images on Front and Back Sides>

One example of the control operation of the CPU 205 upon controlling the printing apparatus (MFP 105, 106, or the like) of this embodiment to automatically execute the image printing position alignment operation without any intervention operation of the operator in double-sided printing of data of a double-sided printing job to be processed by that apparatus will be described below.

Figure 29:
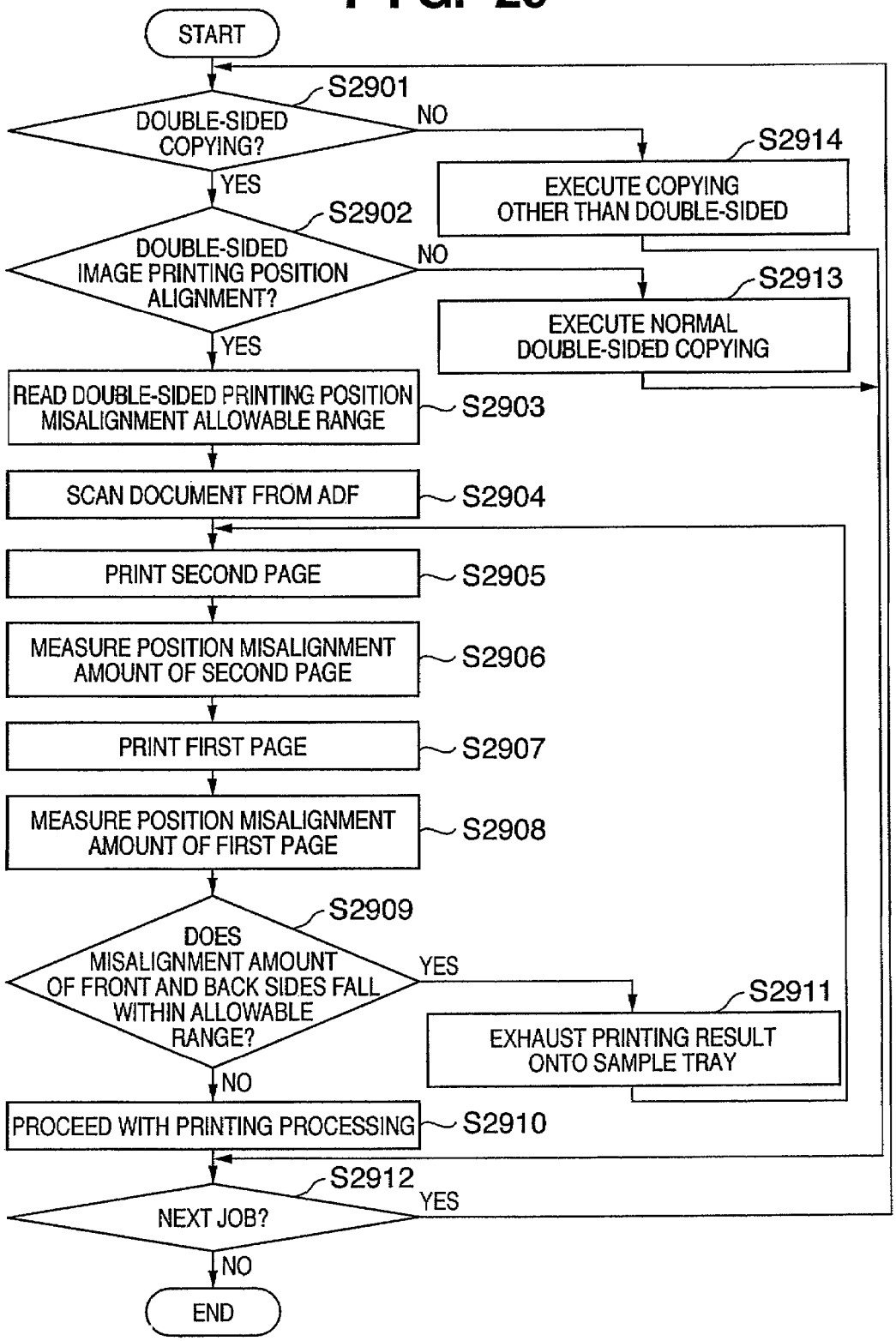
FIG. 29 is a flowchart for explaining one example of the data processing method of a print job to be controlled by the embodiment of the present invention.

FIG. 29 is a flowchart showing the flow of the processing to be executed by the CPU 205 in the above operation. This program data is also stored in the HDD 209 or ROM 207 in the same manner as in the processes of other flowcharts (FIGS. 14 and 22). The CPU 205 reads out and refers to the programs of these processes from the memory unit as needed. In the following example, processes other than those in steps S2903, S2906, S2908, S2909, and S2911 are the same as those in the first embodiment. Therefore, since constituent elements which are not described in the following description are the same as those of the first embodiment, a description thereof will be omitted.

Upon depression of the start key 503, the CPU 205 checks in step S2901 if double-sided copying is to be executed. If it is not set to execute double-sided copying, the flow advances to step S2914 to execute copying other than double-sided copying. On the other hand, if it is set to execute double-sided copying, the flow advances to step S2902.

The CPU 205 checks in step S2902 if it is set to apply double-sided image printing position alignment. If it is not set to apply double-sided image printing position alignment, the flow advances to step S2913 to execute normal double-sided copying. On the other hand, if it is set to apply double-sided image printing position alignment, the flow advances to step S2903.

In step S2903, the CPU 205 reads the allowable range of the image printing position misalignment amount between the front and back sides upon double-sided copying, which is set via the position misalignment amount allowable range setting window in FIG. 28. The CPU 205 reads this value as a criterion used to inspect using the sensor 332 whether or not the misalignment amount of the image printing positions falls within the allowable range as a result of double-sided printing and to sort the result onto the stack tray 324 or sample tray 323.

In step S2904, the CPU 205 controls to scan documents set on the ADF 301 in turn, and to store the scanned image data in the RAM 208.

In step S2905, the CPU 205 controls to print the second page corresponding to the back side of the first sheet. In step S2906, the CPU 205 controls to measure the distance from the reference mark 2502 to the leading end of the index 1202 of the fixed output image of the second page at the predetermined detection timing using the sensor 332 and to store that distance as the position misalignment amount of the back side in the RAM 208.

In step S2907, the CPU 205 controls to print the first page corresponding to the front side of the first sheet. In step S2908, the CPU 205 controls to measure the distance from the reference mark 2502 to the leading end of the index 1202 of the fixed output image of the first page at the predetermined detection timing using the sensor 332 and to store that distance as the position misalignment amount of the front side in the RAM 208.

In step S2909, the CPU 205 calculates the image printing position misalignment amount between the front and back sides based on the image printing position misalignment amount of the back side of the first sheet measured in step S2906 and that of the front side of the first sheet measured in step S2908, and compares the calculated amount with the allowable range value which is set in advance in step S2903.

If the calculated image printing position misalignment amount falls with the allowable range, the flow advances to step S2910 to proceed with printing of the remaining pages. At this time, the printing results are exhausted onto the stack tray 324.

On the other hand, if the calculated image printing position misalignment amount exceeds the allowable range, the flow advances to step S2911 to exhaust the print result at that time onto the sample tray 323. Then, image data of one of the front and back sides stored on the RAM 208 is shifted by coordinates corresponding to the position misalignment amount between the front and back sides calculated by the CPU 205. After the image data of one of the front and back sides is shifted, the flow returns to step S2905, and the CPU 205 controls to redo copying from the first page. The flow that returns from step S2911 to step S2905 is repeated until the image printing position misalignment amount between the front and back sides falls within the allowable range in step S2909.

If the shift setting has been made to make the image printing position misalignment amount fall within the allowable range and to match the image printing positions in step S2909, the CPU 205 controls to proceed with printing operations of the remaining pages, i.e., the third page and subsequent pages until image data of the last page in accordance with the shift control in step S2909 in step S2910.

If it is determined in step S2912 that jobs to be processed still remain, and copying processing is to be successively executed, the flow returns to step S2902 to make an operation from the initial window on the operation unit 204 in the standby mode shown in FIG. 5. On the other hand, if no job to be processed remains, the processing ends.

As can be seen from the above description, when the CPU 205 controls the printing apparatus to execute double-sided printing processing, it allows to accept the user's request via the double-sided image printing position alignment setting key in advance. After a desired number of pages are printed after the beginning of printing operations, the CPU 205 controls the sensor unit to detect the image printing position misalignment amounts of the front and back sides on each actually printed sheet. If the misalignment amount falls outside the allowable range, the CPU 205 controls this printing apparatus to automatically execute double-sided image printing position alignment.

On the other hand, if the misalignment amount falls within the allowable range, the CPU 205 inhibits double-sided image printing position alignment, and controls to proceed with the double-sided printing processing. In this way, the aforementioned effects can be provided without any intervention operations of the operator in the above embodiments. As a result, the operator need not execute double-sided image printing position alignment, and the work load on the operator can be greatly reduced. More specifically, the effects exemplified in the first and second embodiments can be further improved.

The third embodiment has explained the control example upon executing double-sided printing of print data from the scanner unit 201 in response to a printing start request from the operation unit 204. However, the present invention is not limited to such specific example. For example, the present invention can be similarly applied even when print data from the external apparatus is to be processed, as described in the second embodiment. Especially, the present invention can be similarly applied to printing operations via the printer driver on the client PC 104.

As has been explained in the first to third embodiments, according to the present invention, upon processing a job using the aforementioned printing apparatus which can print data of a job to be processed on the first and second sides of a sheet, the controller of the printing apparatus and/or the host computer control/controls as main bodies/a main body to process data of the job to be double-sided printed to shift the printing position of data on the second side of the sheet with respect that of data on the first side of the sheet in a predetermined direction.

In addition, upon processing the job using the printing apparatus, the controller of the printing apparatus and/or the host computer control/controls to selectively execute a first mode that controls to print data to be printed on the second side of a sheet on the second side of the sheet to have a predetermined shift amount from the printing position of data on the first side of the sheet in a predetermined direction, and a second mode that controls to print data to be printed on the second side of a sheet on the second side of the sheet irrespective of the predetermined shift amount and predetermined direction.

Furthermore, according to the present invention, the controller of the printing apparatus and/or the host computer control/controls to selectively execute the first and second modes for each of jobs to be double-sided printed.

Moreover, the present invention is configured to allow the user to determine an operation mode to be executed of the first and second modes via a user interface such as an operation unit of the printing apparatus, a printing setting window of a computer on which a printer driver of the printing apparatus is installed, or the like.

The present invention is configured to allow the user to determine the operation mode to be executed of the first and second modes via the aforementioned user interface as an initial setting of the printing apparatus.

Also, the present invention is configured to allow the controller of the printing apparatus or the like to automatically determine the operation mode to be executed of the first and second modes using an image position detection sensor or the like of the printing apparatus, as described above.

In addition, the present invention is configured to allow the user to manually select the first mode via the aforementioned user interface or to allow the controller of the printing apparatus to automatically select it based on information from the aforementioned sensor after the printing apparatus is controlled to execute double-sided printing processing for a predetermined number of pages of a job to be double-sided printed (e.g., two pages, i.e., the first and second pages of the job to be double-sided printed).

Furthermore, the present invention is configured to set the predetermined direction to be that based on a user's instruction set via the aforementioned user interface.

Moreover, the present invention is configured to set the predetermined shift amount to be that based on a user's instruction set via the aforementioned user interface.

Also, an arrangement which can bring about effects in the following POD environment may be further provided by applying the arrangements of the first to third embodiments of the present invention. The following arrangement can also be called a specification that adds a situation assumed in the POD environment. For example, in the POD environment, how to efficiently process print jobs in large quantities to improve the productivity of the whole system is important. As the specification that adds such situation, a box function of the aforementioned printing apparatus is utilized. The CPU 205 controls this printing apparatus to allow a double-sided printing job to be processed by the box function to use the printing position adjustment function of images on the front and back sides.

For example, assume that the user presses the box tab 603 used to select the box function on the window of FIG. 6 which is displayed on the display unit of the operation unit 204 under the control of the CPU 205. In response to this key operation, the CPU 205 controls to display a box selection window (not shown) on the display unit of the operation unit 204. The printing apparatus of this arrangement comprises a plurality of data storage boxes in the HDD 209, as described above. The CPU 205 controls to allow the user himself or herself to select a desired one of the plurality of boxes via the UI unit. For example, the CPU 205 accepts selection of a box of user's choice via the box selection window (not shown).

Figure 33:
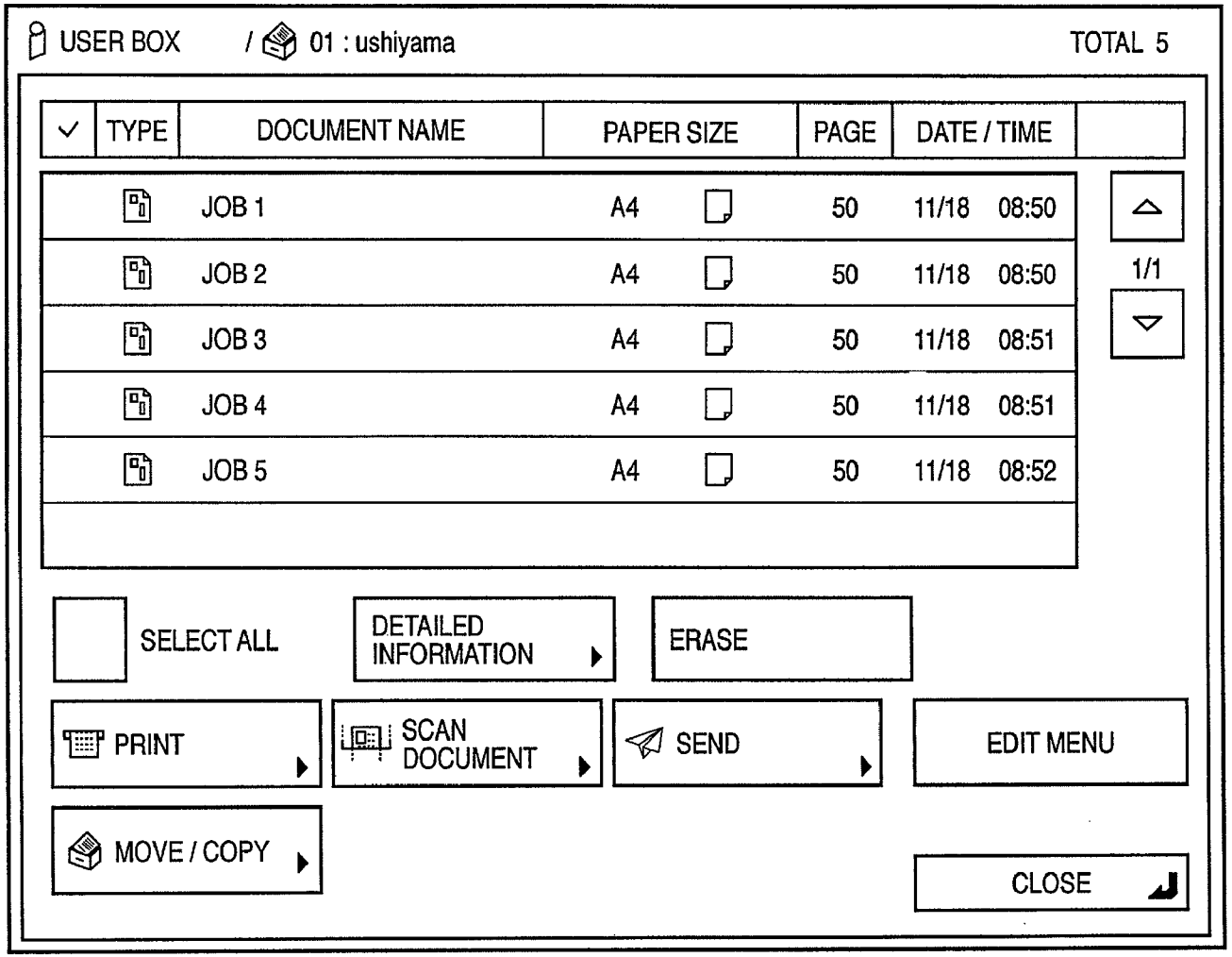
FIG. 33 is a view for explaining one example of the UI unit to be controlled by the embodiment of the present invention.

Also, when the user selects the desired box via the UI unit, the CPU 205 controls the UI unit to make a display that allows the user to select a desired one from data of a plurality of jobs to be printed, which have already been stored in that box. For example, assume that the user selects one of the plurality of boxes via the box selection window (not shown). In response to this user operation, the CPU 205 controls the display unit of the operation unit 204 to display a document selection window that allows the user to select desired one of a plurality of document data stored in the box selected by this user. FIG. 33 shows this display example.

As shown in FIG. 33, one box of user's choice can save data of a plurality of independent jobs each of which includes a plurality of pages. In the example of FIG. 33, five document data are stored, and each job includes document data of 50 pages. Note that these data are stored in the HDD 209 in practice, as described above. Also, each box can store not only data of a job accepted via the scanner unit 201 but also data of a job from the external apparatus accepted via the external I/F unit 202, as described above.

Figure 34:
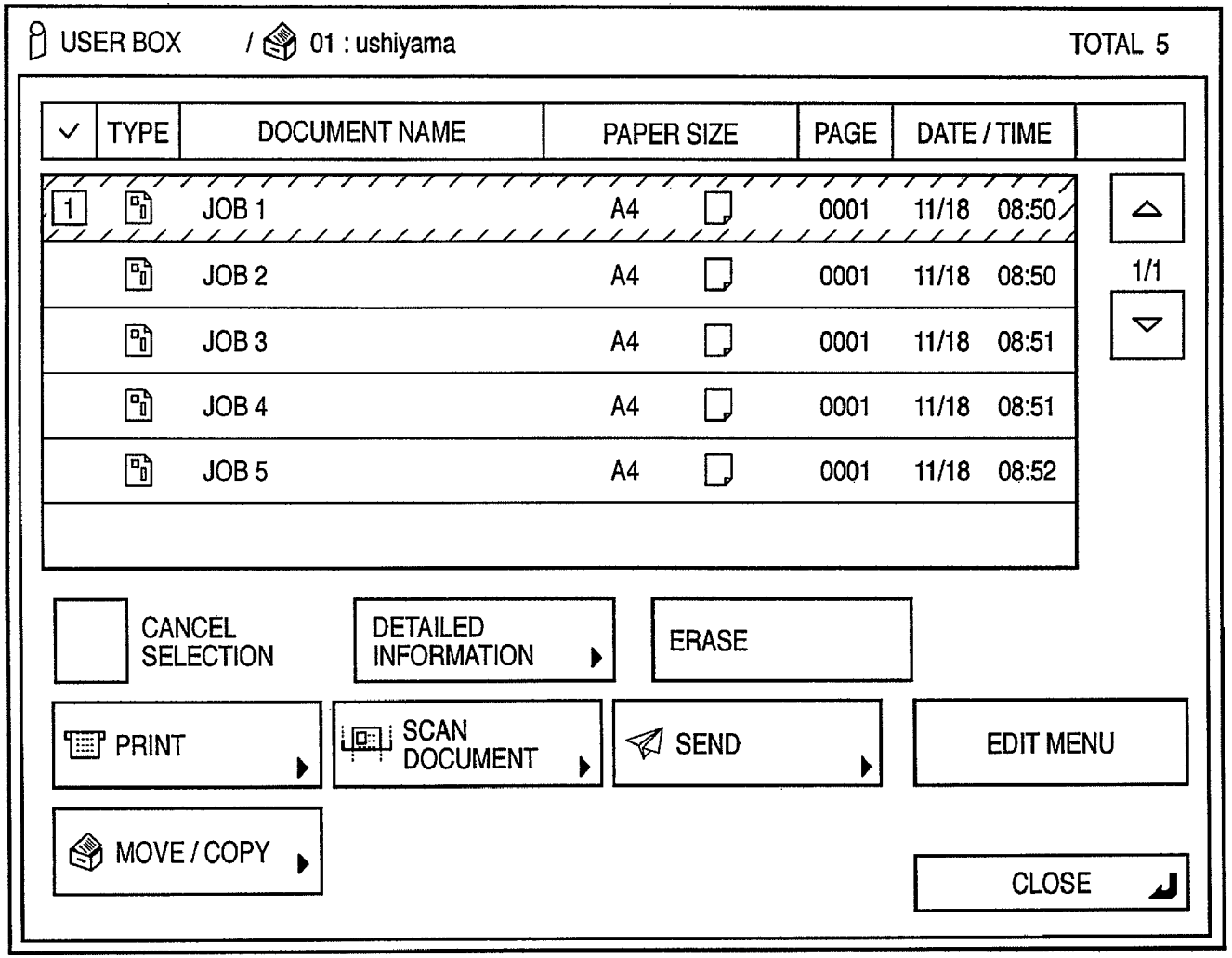
FIG. 34 is a view for explaining one example of the UI unit to be controlled by the embodiment of the present invention.

The CPU 205 controls to allow the user to select a desired job via a document selection column on the window of FIG. 33 displayed on the display unit of the operation unit 204. For example, assume that the user selects "job 1" via the window of FIG. 33. In this case, the CPU 205 controls to allow the user himself or herself to determine via the UI unit the processing to be executed by this printing apparatus as that for data of job 1. FIG. 34 shows this example. For example, assume that the user wants to execute printing by this apparatus as the processing for the data of the job selected by the user via the document selection column. In this case, the CPU 205 accepts a print execution request from the user via a "print" key on the window of FIG. 34 displayed on the display unit of the operation unit 204 under its control. On the other hand, assume that the user wants to send data to the external apparatus by this apparatus as the processing for the data of the job selected by the user via the document selection column. In this case, the CPU 205 accepts a send execution request from the user via a "send" key on the window of FIG. 34 displayed on the display unit of the operation unit 204 under its control.

Figure 35:
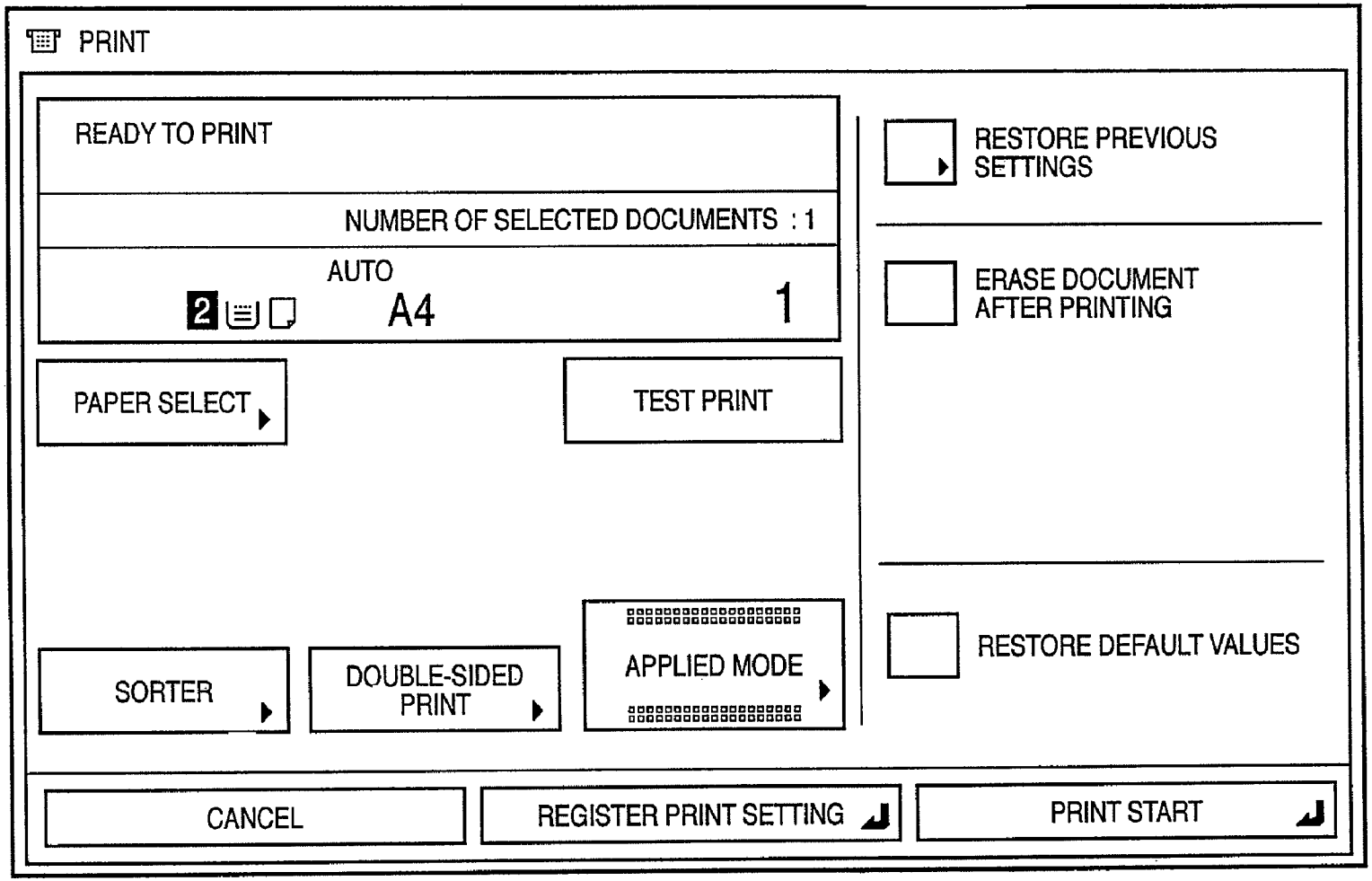
FIG. 35 is a view for explaining one example of the UI unit to be controlled by the embodiment of the present invention.

With this configuration, assume that the user selects, e.g., the "print" key on the window of FIG. 34. In this case, the CPU 205 controls to accept, from the user via the UI unit, printing conditions for the data of the job selected by the user via the document selection column. FIG. 35 shows this example. Via a window of FIG. 35, the CPU 205 accepts, from the user, various printing conditions (settings of finishing, output paper size, applied mode, and the like) for the data of the job to be printed in the box function selected by the user.

Figure 36:
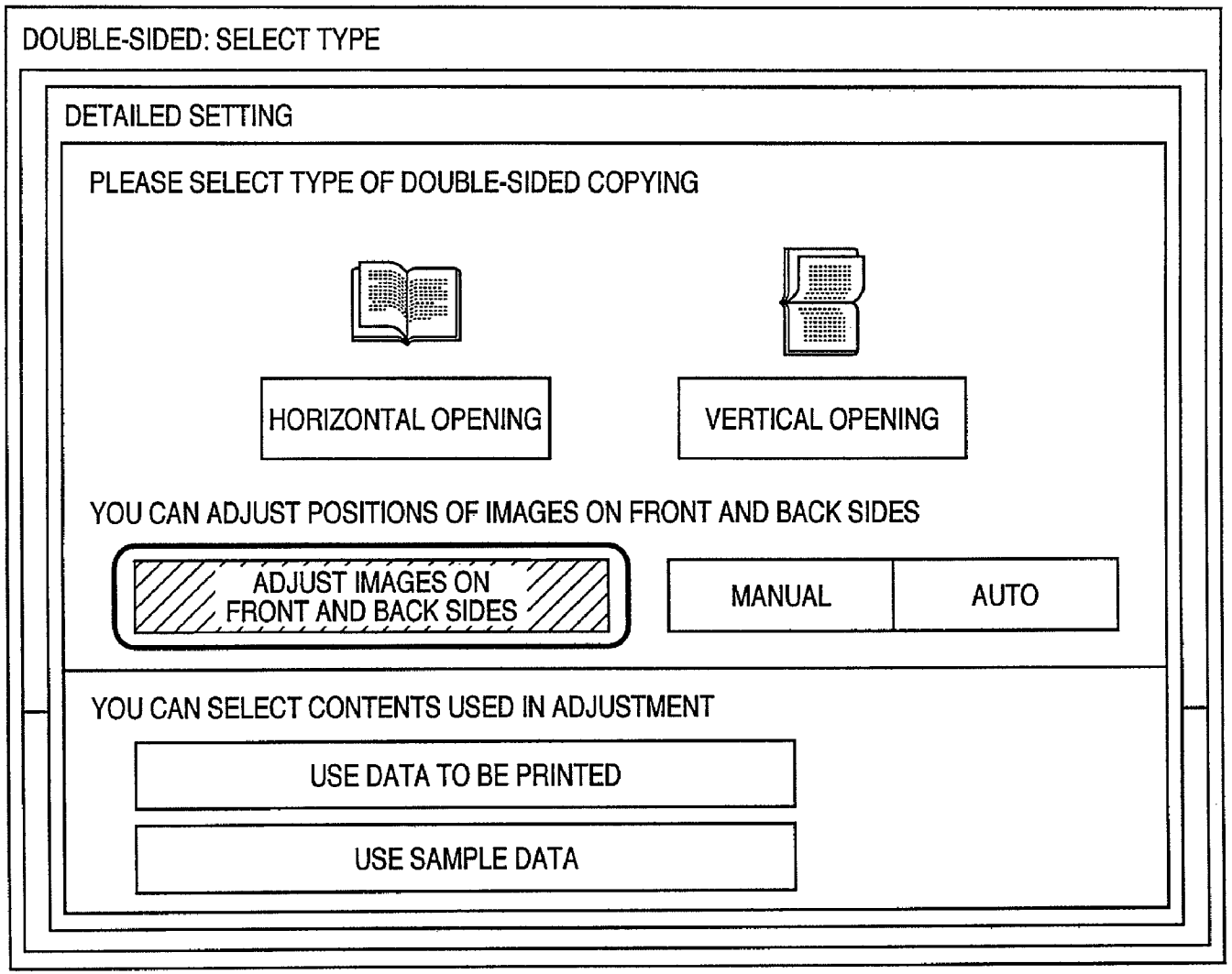
FIG. 36 is a view for explaining one example of the UI unit to be controlled by the embodiment of the present invention.

The present invention can use the printing position adjustment function of images on the front and back sides even for data of a job of such box function. For example, assume that the CPU 205 accepts a double-sided printing execution request via a "double-sided print" key on the window of FIG. 35 displayed on the display unit. The CPU 205 controls to display the window of FIG. 8 on the display unit of the operation unit 204. Also, assume that the user presses the key 1801 via the window of FIG. 8. In response to this operation, the CPU 205 accepts, from the user via the UI unit, a request associated with position alignment of images on the back and front sides in double-sided printing of the job selected from the box. That is, the CPU 205 controls to display the window of FIG. 9 on the display unit of the operation unit 204. In this case, the CPU 205 provides a scheme to which all the aforementioned embodiments are applied. FIG. 36 shows this example. Upon accepting the double-sided printing execution request from the user via the display unit of the operation unit 204 upon operation of the "double-sided print" key on the window of FIG. 35, the CPU 205 controls to display a window of FIG. 36 on the display unit of the operation unit 204.

Each of the above embodiments is configured to selectively determine a side which is to undergo image shift of the first side (front side) and second side (back side) of a printing medium (it is also called a sheet, printing material, or paper sheet in the present invention). Also, each embodiment is configured to selectively determine a direction to shift the image to be shifted from a plurality of options (e.g., four directions, i.e., up, down, right, and left directions). Furthermore, each embodiment is configured to selectively determine the shift amount of the image to be shifted. With this configuration, the user himself or herself can determine these three different items to be determined associated with image shift (three items, i.e., the print side which is to undergo image shift, the direction which is to undergo image shift, and its shift amount) via the window of FIG. 15 in the first and second embodiments. In other words, this configuration can be defined as a user manual adjustment mode for position alignment of images on the front and back sides in double-sided printing.

On the other hand, in the third embodiment, the CPU 205 itself can automatically determine these three items using the sensor unit 211. In other words, this configuration can be defined as an automatic adjustment mode for position alignment of images on the front and back sides in double-sided printing. In each of the aforementioned first to third embodiments, the printer unit 203 is controlled to execute specific double-sided printing processing so as to align images on the front and back sides. One example of such processing is the double-sided printing operation using print data to be printed to which position adjustment of images on the front and back sides is to be applied in practice. Also, another example is the double-sided printing operation using sample data for position adjustment of images on the front and back sides, which is stored in advance in the HDD 209. In this way, each embodiment is configured to selectively execute the specific double-sided printing operations.

Hence, the present invention is configured to allow the user to select these control sequences. For example, the CPU 205 can accept a user request of user's choice from a plurality of user requests listed below via the window of FIG. 36 displayed on the display unit of the operation unit 204.

For example, assume that the user presses an "adjust positions of images on front and back sides" key on the window of FIG. 36. In response to acceptance of the user request based on this key, the CPU 205 enables the display states of two keys, i.e., "manual" and "auto" keys to be displayed at right neighboring positions of that key. Also, the CPU 205 enables the display states of two keys, i.e., "use data to be printed" and "use sample data" keys to be displayed at lower positions of the window. The CPU 205 executes such display control according to the key operations for the display unit of the operation unit 204.

Assume that the user then selects the "adjust positions on images on front and back sides" key on the window of FIG. 36 and presses the "manual" key of FIG. 36. Upon accepting these two user requests, the CPU 205 processes print data of job 1 including document data of a total of 50 pages, which job is selected from the box via the window of FIG. 34 and is to be double-sided printed, using the control sequence of the first embodiment. In addition to these user requests, assume that a user request based on the "use data to be printed" key is accepted from the user. In this case, the CPU 205 controls this apparatus to execute double-sided printing processing using print data of the first and second pages of the job as the specific double-sided printing operation by the printer unit 203 in the same control sequence as in the first embodiment.

On the other hand, assume that a user request based on the "use sample data" key is accepted from the user. In this case, the CPU 205 controls this apparatus to execute double-sided printing processing using sample data for position adjustment of images of two pages on the front and back sides, which are registered in advance in the HDD 209, as the specific double-sided printing operation by the printer unit 203 in the same control sequence as in the first embodiment. Note that the control to be executed by the CPU 205 in this case is substantially the same as that implemented by all the constituent elements in the first embodiment, except that data to be processed is the print data stored in the box. Therefore, a description thereof will be omitted.

However, strictly speaking, upon executing the same control sequence as in the first embodiment, data of the box has already been stored in the HDD 209. Therefore, the CPU 205 executes a program from which the processing in step S1403 in FIG. 14 is omitted. As one example of such processing, the CPU 205 reads out a series of program data including program codes corresponding to steps S1404 to S1412 in FIG. 14 from a memory, and processes job 1 above. For example, after the user has completed the above settings via the window of FIG. 36, the CPU 205 controls to display the window of FIG. 35 on the display unit of the operation unit 204 again. Also, assume that a print execution request based on a "print start" key on the window of FIG. 35 is accepted from the user. In response to this operation, the CPU 205 reads out and executes this program, and controls the printing apparatus to start processing of job 1 in accordance with a program corresponding to a control sequence according to the user request accepted via the window of FIG. 35.

When the same operation as in the third embodiment is to be executed for job 1 above, the CPU 205 operates as follows.

For example, assume that the user selects the "adjust positions of images on front and back sides" key on the window of FIG. 36 and presses the "auto" key of FIG. 36. Upon reception of these two user requests, the CPU 205 processes print data of job 1 including document data of a total of 50 pages, which job is selected from the box via the window of FIG. 34 and is to be double-sided printed, using the control sequence of the third embodiment. In addition to these user requests, assume that a user request based on the "use data to be printed" key is accepted from the user. In this case, the CPU 205 controls this apparatus to execute double-sided printing processing using print data of the first and second pages of the job as the specific double-sided printing operation by the printer unit 203 in the same control sequence as in the third embodiment.

On the other hand, assume that a user request based on the "use sample data" key is accepted from the user. In this case, the CPU 205 controls this apparatus to execute double-sided printing processing using sample data for position adjustment of images of two pages on the front and back sides, which are registered in advance in the HDD 209, as the specific double-sided printing operation by the printer unit 203 in the same control sequence as in the third embodiment. Note that the control to be executed by the CPU 205 in this case is substantially the same as that implemented by all the constituent elements in the third embodiment, except that data to be processed is the print data stored in the box. Therefore, a description thereof will be omitted.

However, strictly speaking, upon executing the same control sequence as in the third embodiment, data of the box has already been stored in the HDD 209. Therefore, the CPU 205 executes a program from which the processing in step S2904 in FIG. 29 is omitted. As one example of such processing, the CPU 205 reads out a series of program data including program codes corresponding to steps S2903 and S2905 to S2912 in FIG. 29 from a memory, and processes job 1 above. For example, after the user has completed the above settings via the window of FIG. 36, the CPU 205 controls to display the window of FIG. 35 on the display unit of the operation unit 204 again. Also, assume that a print execution request based on a "print start" key on the window of FIG. 35 is accepted from the user. In response to this operation, the CPU 205 reads out and executes this program, and controls the printing apparatus to start processing of job 1 in accordance with a program corresponding to a control sequence according to the user request accepted via the window of FIG. 35.

By comprising the above configuration, the user can select a desired one of a plurality of control sequences described in the first to third embodiments. Also, the configuration can be applied to data of the box function. That is, the aforementioned effects can be further improved.

If no sample data is registered in the HDD 209, the CPU 205 disables the display state of the "use sample data" key on the window of FIG. 36. That is, the CPU 205 inhibits the user request based on that key operation from being accepted.

Likewise, assume that the printing apparatus is of a type which does not comprise at least one of the mechanical sensor 332 in FIG. 24 and the sensor unit 211 in FIG. 23. In this case, the CPU 205 disables the display state of the "auto" key on the window of FIG. 36. That is, the CPU 205 inhibits the user request based on that key operation from being accepted.

By further comprising such configuration, operation errors of the user and apparatus in the above configuration can be prevented. Also, the aforementioned effects can be further improved.

A configuration that further expands these configurations for the POD environment may be adopted. For example, how to efficiently process print jobs in large quantities is important for the POD environment. A scheme that assumes such situation is adopted. For example, in the present invention, the box function comprises a multiple job continuous printing function. This function allows the user to select data of a plurality of desired jobs from the HDD 209, which stores data of a plurality of independent jobs, via the UI unit of the present invention. Also, this function can control the printer unit 203 to continuously print the data of the plurality of jobs selected by the user via the UI unit together in response to a single print execution start request input by the user. The CPU 205 controls this printing apparatus to execute such operation. In this example, the aforementioned control sequence can be executed in the continuous printing function. One example of such processing will be explained below.

Figure 37:
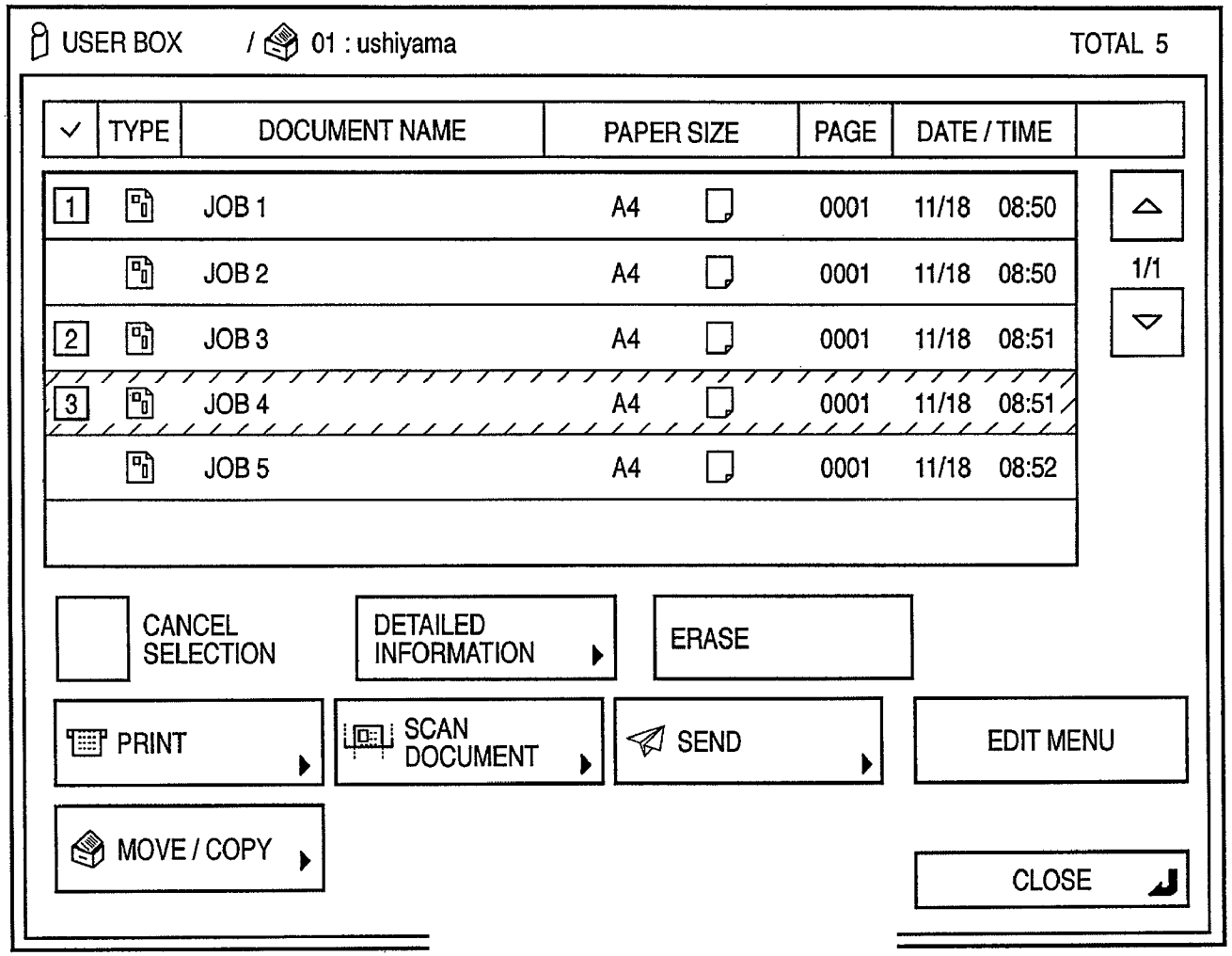
FIG. 37 is a view for explaining one example of the UI unit to be controlled by the embodiment of the present invention.

For example, the CPU 205 allows the user to select document data of a plurality of jobs via the document selection column on the window of FIG. 33 displayed on the display unit of the operation unit 204. For example, assume that the user selects a total of three jobs, i.e., jobs 1, 3, and 4, via the window of FIG. 33. In this case, the CPU 205 controls the window in a display mode that allows the user to identify selection of the jobs, and the selection order of the jobs selected by the user. FIG. 37 shows this display control example. Assume that job 3 is selected after job 1 is selected, and job 4 is then selected, i.e., a total of three jobs are selected, as shown in the window of FIG. 37. Note that each of these jobs includes a total of 50 pages.

When the user presses a "print" key on the window of FIG. 37 after he or she selects these three jobs via the window of FIG. 37, the CPU 205 controls the display unit of the operation unit 204 to display the window of FIG. 35. Upon depression of the "double-sided print" key on the window of FIG. 35, the CPU 205 controls the display unit of the operation unit 204 to display the window of FIG. 36 via the window of FIG. 8 as in the above case. Also, the CPU 205 can accept respective user requests described above via the window of FIG. 36 displayed on the display unit under its control. After the user has completed the above settings via the window of FIG. 36, the CPU 205 controls to display the window of FIG. 35 on the display unit of the operation unit 204 again. Also, assume that a print execution request based on the "print start" key on the window of FIG. 35 is accepted from the user. In response to this operation, the CPU 205 controls the printing apparatus to execute processing for jobs 1, 3, and 4 in accordance with a program corresponding to the control sequence according to the user requests accepted via the window of FIG. 35. For example, the CPU 205 processes these jobs in the following procedures.

(Procedure 1) A print execution request is accepted from the UI unit upon depression of the "print start" key on the window of FIG. 35. In response to this request, the CPU 205 reads out print data of the first and second pages of job 1 from the HDD 209. Also, the CPU 205 controls the printer unit 203 to execute double-sided printing processing of the first and second pages of job 1 on the front and back sides of one sheet required in the double-sided printing of job 1 as the specific double-sided printing operations.

(Procedure 2) The user visually confirms the double-sided printing result of the sheet printed by the printer unit 203 in the specific double-sided printing operations in accordance with the control sequence of the first embodiment. Or the sensor 221 detects the double-sided printing result of the sheet in accordance with the control sequence of the third embodiment. As a result, assume that an image to be printed on the second side of a sheet must be shifted downward by 2 mm. In this case, the CPU 205 processes the plurality of jobs as follows.

(Procedure 3) Upon printing images of pages corresponding to odd pages to be printed on the first sides of sheets of the first to fiftieth pages of job 1, the CPU 205 controls to execute printing processing on the first sides without any image shift. Upon printing images of pages corresponding to even pages to be printed on the second sides of sheets of the first to fiftieth pages of job 1, the CPU 205 controls to execute printing processing on the second sides by shifting images upward by 2 mm. In other words, the CPU 205 controls this printing apparatus to execute "a series of double-sided printing operations including printing position adjustment processing that shifts an image to be printed on the second side upward by 2 mm of the first and second sides of each sheet required to print job 1" from the first to last pages of job 1.

(Procedure 4) Upon completion of the series of printing operations of job 1, the CPU 205 controls to start printing processing of the second job selected after job 1, i.e., job 3, as shown in the window of FIG. 37. In this case, no print execution request based on the "print start" key on the window of FIG. 35 is accepted from the user. That is, the CPU 205 controls the printer unit 203 to automatically start processing of job 3 without accepting any print start request from the user after completion of the series of double-sided printing operations of job 1. More specifically, the CPU 205 reads out print data of job 3 from HDD 209. The CPU 205 processes the print data of job 3 by double-sided printing processing. In this case, the CPU 205 processes job 3 in the same manner as in job 1. In other words, the CPU 205 controls this printing apparatus to execute "a series of double-sided printing operations including printing position adjustment processing that shifts an image to be printed on the second side upward by 2 mm of the first and second sides of each sheet required to print job 3" from the first to last (fiftieth) pages of job 3.

(Procedure 5) Upon completion of the series of printing operations of job 3, the CPU 205 controls to start printing processing of the third job selected after job 3, i.e., job 4, as shown in the window of FIG. 37. In this case as well, no print execution request based on the "print start" key on the window of FIG. 35 is accepted from the user. That is, the CPU 205 controls the printer unit 203 to automatically start processing of job 4 without accepting any print start request from the user after completion of the series of double-sided printing operations of job 3.

More specifically, the CPU 205 reads out print data of job 4 from HDD 209. The CPU 205 processes the print data of job 4 by double-sided printing processing. In this case, the CPU 205 processes job 4 in the same manner as in jobs 1 and 3. In other words, the CPU 205 controls this printing apparatus to execute "a series of double-sided printing operations including printing position adjustment processing that shifts an image to be printed on the second side upward by 2 mm of the first and second sides of each sheet required to print job 4" from the first to last (fiftieth) pages of job 4.

The CPU 205 controls this printing apparatus to execute the operations of (procedure 1)→(procedure 2)→(procedure 3)→(procedure 4)→(procedure 5) described above. That is to say, the CPU 205 can control to automatically and continuously print a total of three jobs, i.e., jobs 1, 3, and 4 above together while executing the printing position adjustment processing of images on the front and back sides.

Assume that the user visually confirms that "no image shift is required as a determination result based on the double-sided printing result of the first and second pages of job 1" in accordance with the control sequence of the first embodiment in (procedure 2). Or assume that the CPU 205 automatically determines based on information from the sensor unit 211 that "no image shift is required as a determination result based on the double-sided printing result of the first and second pages of job 1" in accordance with the control sequence of the third embodiment. If no image shift need be executed in this way, the CPU 205 processes as follows.

(Procedure 3') Upon printing images of pages corresponding to odd pages to be printed on the first sides of sheets of the first to fiftieth pages of job 1, the CPU 205 controls to execute printing processing on the first sides without any image shift. Upon printing images of pages corresponding to even pages to be printed on the second sides of sheets of the first to fiftieth pages of job 1 as well, the CPU 205 controls to execute printing processing on the second sides without any image shift. In other words, the CPU 205 controls this printing apparatus to execute "a series of double-sided printing operations that do not require any printing position adjustment processing of all images to be printed on both the first and second sides of sheets required to print job 1 (without any image shift)". In this case, the first and second pages of job 1 have already been double-sided printed without any problem. Therefore, in this procedure, the CPU 205 controls the printer unit 203 to execute the series of double-sided printing operations from the third to last pages of job 1.

(Procedure 4') Upon completion of the series of printing operations of job 1, the CPU 205 controls to start printing processing of the second job selected after job 1, i.e., job 3, as shown in the window of FIG. 37. In this case, no print execution request based on the "print start" key on the window of FIG. 35 is accepted from the user. That is, the CPU 205 controls the printer unit 203 to automatically start processing of job 3 without accepting any print start request from the user after completion of the series of double-sided printing operations of job 1.

More specifically, the CPU 205 reads out print data of job 3 from HDD 209. The CPU 205 processes the print data of job 3 by double-sided printing processing. In this case, the CPU 205 processes job 3 in the same manner as in job 1. In other words, the CPU 205 controls this printing apparatus to execute "a series of double-sided printing operations that do not require any printing position adjustment processing of all images to be printed on both the first and second sides of sheets required to print job 3 (without any image shift)" from the first to last (fiftieth) pages of job 3.

(Procedure 5') Upon completion of the series of printing operations of job 3, the CPU 205 controls to start printing processing of the third job selected after job 3, i.e., job 4, as shown in the window of FIG. 37. In this case as well, no print execution request based on the "print start" key on the window of FIG. 35 is accepted from the user. That is, the CPU 205 controls the printer unit 203 to automatically start processing of job 4 without accepting any print start request from the user after completion of the series of double-sided printing operations of job 3. More specifically, the CPU 205 reads out print data of job 4 from HDD 209. The CPU 205 processes the print data of job 4 by double-sided printing processing. In this case, the CPU 205 processes job 4 in the same manner as in jobs 1 and 3. In other words, the CPU 205 controls this printing apparatus to execute "a series of double-sided printing operations that do not require any printing position adjustment processing of all images to be printed on both the first and second sides of sheets required to print job 4 (without any image shift)" from the first to last (fiftieth) pages of job 4.

The CPU 205 controls this printing apparatus to execute the operations of (procedure 1)→(procedure 2)→(procedure 3')→(procedure 4')→(procedure 5') described above. That is to say, the CPU 205 can control to automatically and continuously print a total of three jobs, i.e., jobs 1, 3, and 4 above together without any printing position adjustment processing of images on the front and back sides.

This printing system can provide the aforementioned function. The same processing can be executed even when sample data already registered in the HDD 209 are used in place of data of the first and second pages of job 1 in the specific double-sided printing operations. In this case, since the data of job 1 are not used, the processing is started from the double-sided printing processing of data of the first and second pages of job 1 after (procedure 2) independently of necessity of position adjustment.

Note that constituent elements other than those described in the control example associated with the box function described using FIGS. 33 to 37 are the same as those described in the above embodiments, and a description thereof will be omitted.

In this way, the continuous printing function of controlling the printer unit 203 to continuously print data of a plurality of jobs selected by the user via the UI unit together in response to a single print execution start request input by the user is provided. Upon execution of this function, the aforementioned control sequences can be executed. In this manner, since double-sided printing jobs that require position adjustment of images on the front and back sides can be continuously and automatically processed in large quantities, the productivity can be further improved compared to that in the first to third embodiments. A convenient printing environment, which can also be effectively used in the POD environment assumed as an environment that processes jobs in large quantities, can be built. That is, the effects exemplified in all the aforementioned embodiments can be further improved.

In this fashion, since various schemes are included, a convenient environment which can prevent the problems assumed in the prior art, and can flexibly meet various needs from the users (a reduction of the load on the operator and the like) in double-sided printing processing can be built, and the work load on the operator can be reduced and so forth upon, e.g., executing image position alignment required to correct any position misalignment of images upon printing in a printing apparatus which can execute double-sided printing processing on a printing material (to be also simply referred to as a sheet), thus providing various effects.

Other Embodiments

Note that the present invention may be applied to either a system constituted by a plurality of devices (e.g., a host computer, interface device, reader, printer, and the like), or an apparatus consisting of a single equipment (e.g., a copying machine, facsimile apparatus, or the like).

The objects of the present invention are also achieved by supplying a storage medium, which records a program code of a software program that can implement the functions of the above-mentioned embodiments to the system or apparatus, and reading out and executing the program code stored in the storage medium by a computer (or a CPU or MPU) of the system or apparatus.

In this case, the program code itself read out from the storage medium implements the functions of the above-mentioned embodiments, and the storage medium which stores the program code constitutes the present invention.

As the storage medium for supplying the program code, for example, a Floppy® disk, hard disk, optical disk, magneto-optical disk, CD-ROM, CD-R, magnetic tape, nonvolatile memory card, ROM, and the like may be used.

The functions of the above-mentioned embodiments may be implemented not only by executing the readout program code by the computer but also by some or all of actual processing operations executed by an OS (operating system) running on the computer on the basis of an instruction of the program code.

Furthermore, the functions of the above-mentioned embodiments may be implemented by some or all of actual processing operations executed based on the instructions of the program codes by a CPU or the like arranged in a function extension board or a function extension unit, which is inserted in or connected to the computer, after the program codes read out from the storage medium are written in a memory of the extension board or unit.

The present invention is not limited to the above embodiments and various changes and modifications can be made within the spirit and scope of the present invention. Therefore to apprise the public of the scope of the present invention, the following claims are made.

This application claims the benefit of Japanese Application No. 2005-007986 filed on Jan. 14, 2005, and No. 2005-359536 filed on Dec. 13, 2005, which are hereby incorporated by reference herein in their entirety.

What is claimed is:

1. A printing system comprising:

a printing unit configured to execute a double-sided printing job for printing an image on a first side and a second side of a sheet;

a setting unit configured to set an adjustment value for adjusting a positional relationship of the image to be printed on the first side and the image to be printed on the second side of the sheet;

a control unit configured to control said printing unit to adjust the positional relationship of the image to be printed on the first side and the image to be printed on the second side of the sheet based on the adjustment value set by said setting unit when said printing unit executes a first double-sided printing job; and a selecting unit configured to select whether or not said printing unit uses the adjustment value set by said setting unit for a second double-sided printing job which is executed after said printing unit executes the first double-sided printing job, wherein, if said selecting unit selects to use the adjustment value for the second double-sided printing job, said control unit controls said printing unit to adjust the positional relationship of the image to be printed on the first side and the image to be printed on the second side of the sheet based on the adjustment value set by said setting unit when said printing unit executes the second double-sided printing job, wherein said setting unit sets the adjustment value after said printing unit prints images on a number of pages from the first double-sided printing job, and, if the adjustment value is set by said setting unit, said control unit controls said printing unit to adjust the positional relationship of the image to be printed on the first side and the image to be printed on the second side of the sheet based on the adjustment value set by said setting unit and to print the image again from the image for the first page of the first double-sided printing job.

2. A printing system according to claim 1, wherein said setting unit sets the adjustment value for adjusting a position of the image to be printed on the first side of the sheet.

3. A printing system according to claim 1, wherein said setting unit sets the adjustment value for adjusting a position of the image to be printed on the second side of the sheet.

4. A printing system according to claim 1, further comprising a determination unit configured to determine whether or not the positional relationship of the image to be printed on the first side and the image to be printed on the second side of the sheet is to be adjusted when said printing unit executes the first double-sided printing job, wherein said setting unit sets the adjustment value if said determination unit determines to adjust the positional relationship.

5. A control method for a printing system which comprises a printing unit that executes a double-sided printing job for printing an image on a first side and a second side of a sheet, comprising:

a setting step of setting an adjustment value for adjusting a positional relationship of the image to be printed on the first side and the image to be printed on the second side of the sheet;

a first control step of controlling the printing unit to adjust the positional relationship of the image to be printed on the first side and the image to be printed on the second side of the sheet based on the adjustment value set at said setting step when the printing unit executes a first double-sided printing job;

a selection step of selecting whether or not the printing unit uses the adjustment value set at said setting step for a second double-sided printing job which is executed after the printing unit executed the first double-sided printing job; and, a second control step of, if to use the adjustment value for the second double-sided printing job is selected at said selection step, controlling the printing unit to adjust the positional relationship of the image to be printed on the first side and the image to be printed on the second side of the sheet based on the adjustment value set at said setting step when the printing unit executes the second double-sided printing job, wherein the adjustment value is set at said setting step after the printing unit prints images on a number of pages from the first double-sided printing job, and, if the adjustment value is set at said setting step, the printing unit is controlled at said first control step to adjust the positional relationship of the image to be printed on the first side and the image to be printed on the second side of the sheet based on the adjustment value set at said setting step and to print the image again from the image for the first page of the first double-sided printing job.

6. A control method according to claim 5, wherein the adjustment value for adjusting a position of the image to be printed on the first side of the sheet is set at said setting step.

7. A control method according to claim 5, wherein the adjustment value for adjusting a position of the image to be printed on the second side of the sheet is set at said setting step.

8. A control method according to claim 5, further comprising a determination step of determining whether or not the positional relationship of the image to be printed on the first side and the image to be printed on the second side of the sheet is to be adjusted when said printing unit executes the first double-sided printing job, wherein the adjustment value is set at setting step if adjustment of the positional relationship is determined at said determination step.

* * * * *